US010672376B1

(12) United States Patent
Pickens et al.

(10) Patent No.: US 10,672,376 B1
(45) Date of Patent: Jun. 2, 2020

(54) ACOUSTIC LUMINAIRES

(71) Applicant: Eaton Intelligent Power Limited, Dublin (IE)

(72) Inventors: Ashley Pickens, Evergreen, CO (US); Gregory Parker, Denver, CO (US); Timothy Bingaman, Thornton, CO (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/371,952

(22) Filed: Apr. 1, 2019

(51) Int. Cl.

| | |
|---|---|
| ***G10K 11/162*** | (2006.01) |
| ***F21V 15/015*** | (2006.01) |
| ***F21V 23/02*** | (2006.01) |
| ***F21S 8/06*** | (2006.01) |

(52) U.S. Cl.
CPC ..... *G10K 11/162* (2013.01); *F21V 15/015* (2013.01); *F21V 23/023* (2013.01); *F21S 8/06* (2013.01)

(58) Field of Classification Search
CPC ..... F21V 23/025; F21V 33/00; F21V 23/023; F21V 21/008; F21S 8/06; F21S 4/20; F21S 2/005; E04B 9/001; E04B 1/84; E04B 1/8409; E04B 9/006; E04B 1/8227; E04B 1/82; G01K 11/162; F21Y 2215/10; F21Y 2103/10
See application file for complete search history.

(56) References Cited

U.S. PATENT DOCUMENTS

| | | | | |
|---|---|---|---|---|
| 2,715,449 | A * | 8/1955 | Smith | E04B 1/8209 181/30 |
| 2,730,942 | A * | 1/1956 | Peterson | F21V 33/0092 454/251 |
| 2,759,094 | A | 8/1956 | Goddard | |
| 2,850,109 | A | 9/1958 | Reuben | |
| 3,353,016 | A | 11/1967 | Robinson | |
| 3,591,794 | A | 7/1971 | Dail | |
| 4,712,168 | A * | 12/1987 | Scherrer | E04B 9/006 362/150 |
| 5,623,130 | A | 4/1997 | Noxon | |
| 7,520,370 | B2 * | 4/2009 | Gudim | E04B 1/8209 181/284 |
| 7,971,680 | B2 | 7/2011 | Morgan, III | |
| 7,989,715 | B2 * | 8/2011 | Saito | H01H 3/62 200/313 |

(Continued)

OTHER PUBLICATIONS

Accoustic Solutions. https://www.focalpointlights.com/acousticsolutions Retrieved Jun. 20, 2019. pp. 1-6.

(Continued)

*Primary Examiner* — Peggy A Neils
(74) *Attorney, Agent, or Firm* — King & Spalding LLP

(57) ABSTRACT

A luminaire can include a power source housing that houses at least one light fixture component. The luminaire can also include a light engine tray disposed proximate to the power source housing. The luminaire further can include a first acoustic feature coupled to the power source housing and the light engine tray, where the first acoustic feature comprises a first side wall having a first configuration, where the first configuration of the first side wall absorbs sound.

20 Claims, 24 Drawing Sheets

(56) References Cited

U.S. PATENT DOCUMENTS

| | | | | |
|---|---|---|---|---|
| 8,607,925 | B2 * | 12/2013 | Gideonse | E04B 1/8209 181/210 |
| 8,967,823 | B2 | 3/2015 | D'Antonio | |
| 9,147,390 | B2 | 9/2015 | Swinkels | |
| D814,691 | S | 4/2018 | Clark | |
| 10,030,850 | B2 * | 7/2018 | Vissenberg | E04B 9/0464 |
| 10,359,163 | B1 * | 7/2019 | Hettwer | F21S 8/06 |
| 2009/0268437 | A1 | 10/2009 | Mabuchi | |
| 2016/0232885 | A1 * | 8/2016 | Schnitta | G10K 11/16 |
| 2018/0334804 | A1 | 11/2018 | Patterson | |
| 2018/0336875 | A1 * | 11/2018 | Patterson | F21S 2/00 |
| 2019/0088241 | A1 * | 3/2019 | Czech | G10K 11/162 |
| 2020/0018066 | A1 * | 1/2020 | Kaump | E04B 9/006 |

OTHER PUBLICATIONS

Lightart.com; Slim Beams; LA2 Specifications; Aug. 30, 2018.
Lightart.com; Static; Acoustic static Overview; Apr. 20, 2019.

* cited by examiner

ACOUSTIC LUMINAIRES

TECHNICAL FIELD

Embodiments described herein relate generally to luminaires, and more particularly to systems, methods, and devices for luminaires with acoustic properties.

BACKGROUND

Luminaires (e.g., light fixtures) can be located in any of a number of locations within a room. For example, a luminaire can be mounted to a ceiling, mounted to a wall, placed on a table, or suspended in the air. Luminaires also can have various shapes and sizes. In some cases, there is an opportunity for a luminaire to perform one or more additional functions aside from emitting light.

SUMMARY

In general, in one aspect, the disclosure relates to a luminaire that includes a power source housing that houses at least one light fixture component. The luminaire can also include a light engine tray disposed proximate to the power source housing. The luminaire can further include a first acoustic feature coupled to the power source housing and the light engine tray, where the first acoustic feature includes a first side wall having a first configuration, where the first configuration of the first side wall absorbs sound.

These and other aspects, objects, features, and embodiments will be apparent from the following description and the appended claims.

BRIEF DESCRIPTION OF THE DRAWINGS

The drawings illustrate only example embodiments of devices and methods for acoustic luminaires and are therefore not to be considered limiting of its scope, as devices and methods for acoustic luminaires may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
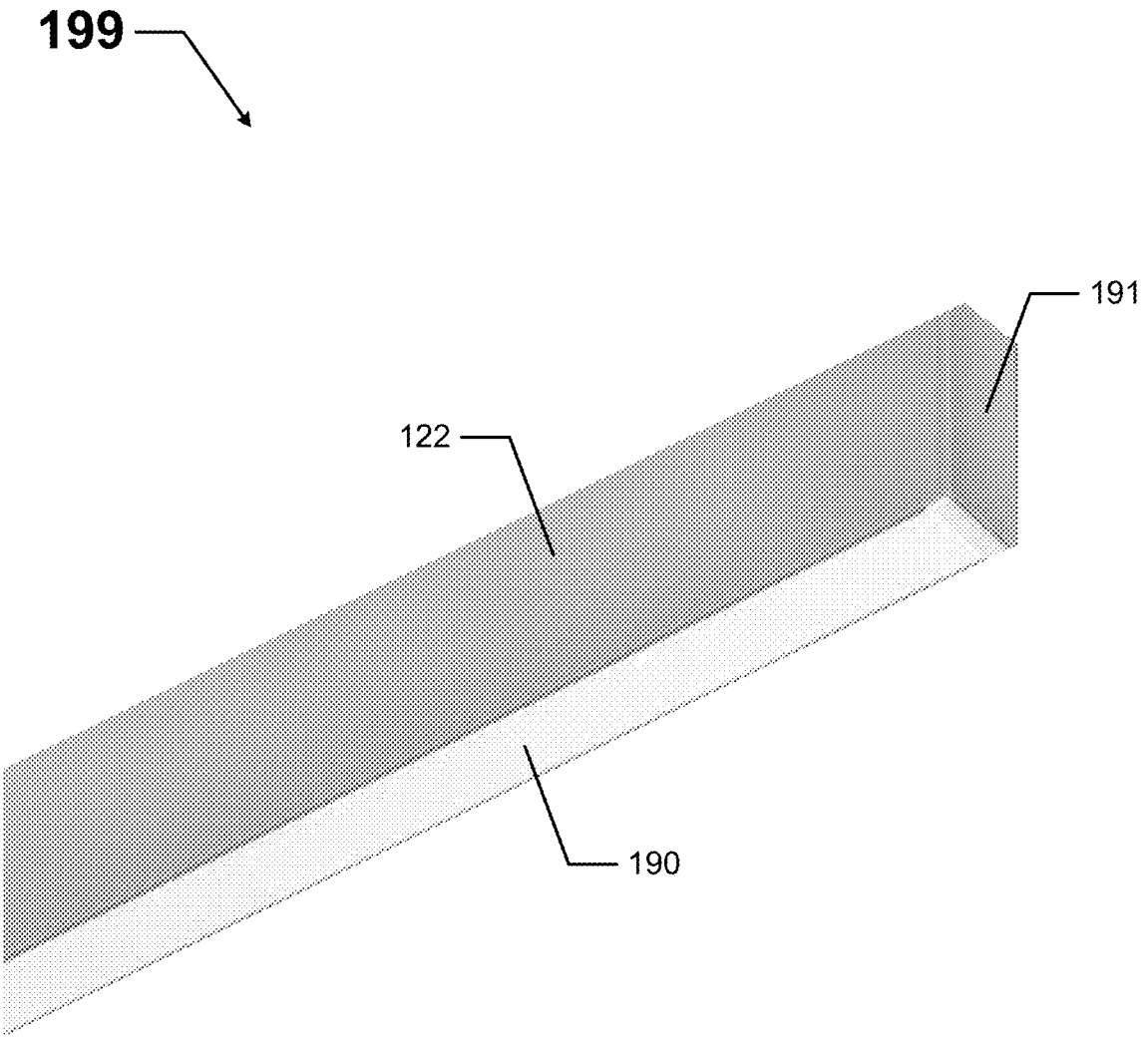
FIG. 1 (Prior Art)
FIG. 1 shows a luminaire currently used in the art.

The example embodiments discussed herein are directed to systems, methods, and devices for acoustic luminaires. Example embodiments can be used with any type of luminaire. For example, a luminaire described herein can include, but is not limited to, a linear light fixture, a surface mounted fixture, a troffer, a down can fixture, an under cabinet light fixture, a pendant light, a table lamp, a floodlight, a spot light, an architectural light, and a high-bay fixture. Example embodiments can be used with new luminaires or retrofitted to existing luminaires. Further, luminaires with which example embodiments can be used can be located in any environment (e.g., indoor, outdoor, high humidity, low temperature, sterile, high vibration).

Further, light fixtures described herein can use one or more of a number of different types of light sources, including but not limited to light-emitting diode (LED) light sources, organic LEDs, fluorescent light sources, organic LED light sources, incandescent light sources, and halogen light sources. Therefore, light fixtures described herein should not be considered limited to having a particular type of light source. When a light fixture described herein uses LED light sources, those LED light sources can include any type of LED technology, including, but not limited to, chip on board (COB) and discrete die.

A user may be any person that interacts with a luminaire. Examples of a user may include, but are not limited to, a homeowner, a tenant, a landlord, a property manager, an engineer, an electrician, an instrumentation and controls technician, a consultant, a contractor, an installer, a manufacturer, and a manufacturer's representative. Example acoustic luminaires (including components thereof) described herein can be made of one or more of a number of materials, including but not limited to plastic (e.g., polyethylene terephthalate (PET)), thermoplastic, copper, aluminum, rubber, stainless steel, synthetics, foam, and ceramic. Such materials can be integrated with the component itself, coating the component, added to the component, or otherwise part of the example acoustic luminaires.

In some cases, example acoustic luminaires are subject to meeting certain standards and/or requirements. For example, the National Electric Code (NEC), the National Electrical Manufacturers Association (NEMA), the International Electrotechnical Commission (IEC), the California Energy Commission (CEC), Underwriters Laboratories (UL), the Acoustical Society of America (ASA), and the Institute of Electrical and Electronics Engineers (IEEE) set standards that can apply to various aspects of example acoustic luminaires. Use of example embodiments described herein meet and/or allow the associated luminaire to meet such standards when required.

Any example acoustic luminaires, or components thereof, described herein can be made from a single piece (e.g., as from a mold, injection mold, die cast, 3-D printing process, extrusion process, stamping process, or other prototype methods). In addition, or in the alternative, an example acoustic luminaire (or components thereof) can be made from multiple pieces that are mechanically coupled to each other. In such a case, the multiple pieces can be mechanically coupled to each other using one or more of a number of coupling methods, including but not limited to epoxy, welding, soldering, etching, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example acoustic luminaire to become coupled, directly or indirectly, to another portion of the example acoustic luminaire and/or some external component (e.g., a wall, a ceiling). A coupling feature can include, but is not limited to, a snap, a clamp, a portion of a hinge, an aperture, a recessed area, a protrusion, a slot, a spring clip, a tab, a detent, and mating threads. One portion of an example acoustic luminaires can be coupled to another component of the example acoustic luminaires or external component by the direct use of one or more coupling features.

In addition, or in the alternative, a portion of an example acoustic luminaire can be coupled to another portion of the acoustic luminaire or another component using one or more independent devices that interact with one or more coupling features disposed on the example acoustic luminaire. Examples of such devices can include, but are not limited to, a pin, a hinge, a fastening device (e.g., a bolt, a screw, a rivet), epoxy, a sealing member (e.g., an O-ring, a gasket), glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of acoustic luminaires are described more fully hereinafter with reference to the accompanying drawings, in which example embodiments of acoustic luminaires are shown. Acoustic luminaires may, however, be embodied in many different forms and should not be construed as limited to the example embodiments set forth herein. Rather, these example embodiments are provided so that this disclosure will be thorough and complete, and will fully convey the scope of acoustic luminaires to those or ordinary skill in the art. Like, but not necessarily the same, elements (also sometimes called components) in the various figures are denoted by like reference numerals for consistency.

Terms such as "first", "second", "top", "bottom", "outer", "inner", "height", "width", thickness", "lower", "upper", "side", "front", "distal", "proximal", and "within" are used merely to distinguish one component (or part of a component or state of a component) from another. Such terms are not meant to denote a preference or a particular orientation, and they are not meant to limit embodiments of acoustic luminaires. For example, the term "top wall" can be used in terms of describing how a component or part of a component is oriented in a certain figure, but the orientation in the figure may not match how the component (or portion thereof) is oriented when an associated luminaire is installed. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a perspective view of a luminaire 199 currently used in the art. The luminaire 199 of FIG. 1 is a type of linear light fixture that has two side walls 122, an end cap 191, and an optical device 190 (e.g., a lens) disposed along a bottom end of the side walls 122 and the end cap 191. This luminaire 199 is typically suspended a large distance from a high ceiling in a large room or or other volume of space.

Common open-office spaces and other volumes of space lack mechanical features such as ceilings and walls that improve acoustic properties for occupants. Acoustic baffles and panels can be added to walls and ceilings, but the associated costs can run quite high. In addition, such acoustic baffles and panels are often not aesthetically pleasing. The addition of acoustic panels to light fixtures has emerged in the market, but the simple design does little for effectively controlling the acoustics in a volume of space, and the aesthetic appeal of these panels is lacking in many cases. The luminaire 199 of FIG. 1 does not include any of these acoustic panels.

Figure 2:
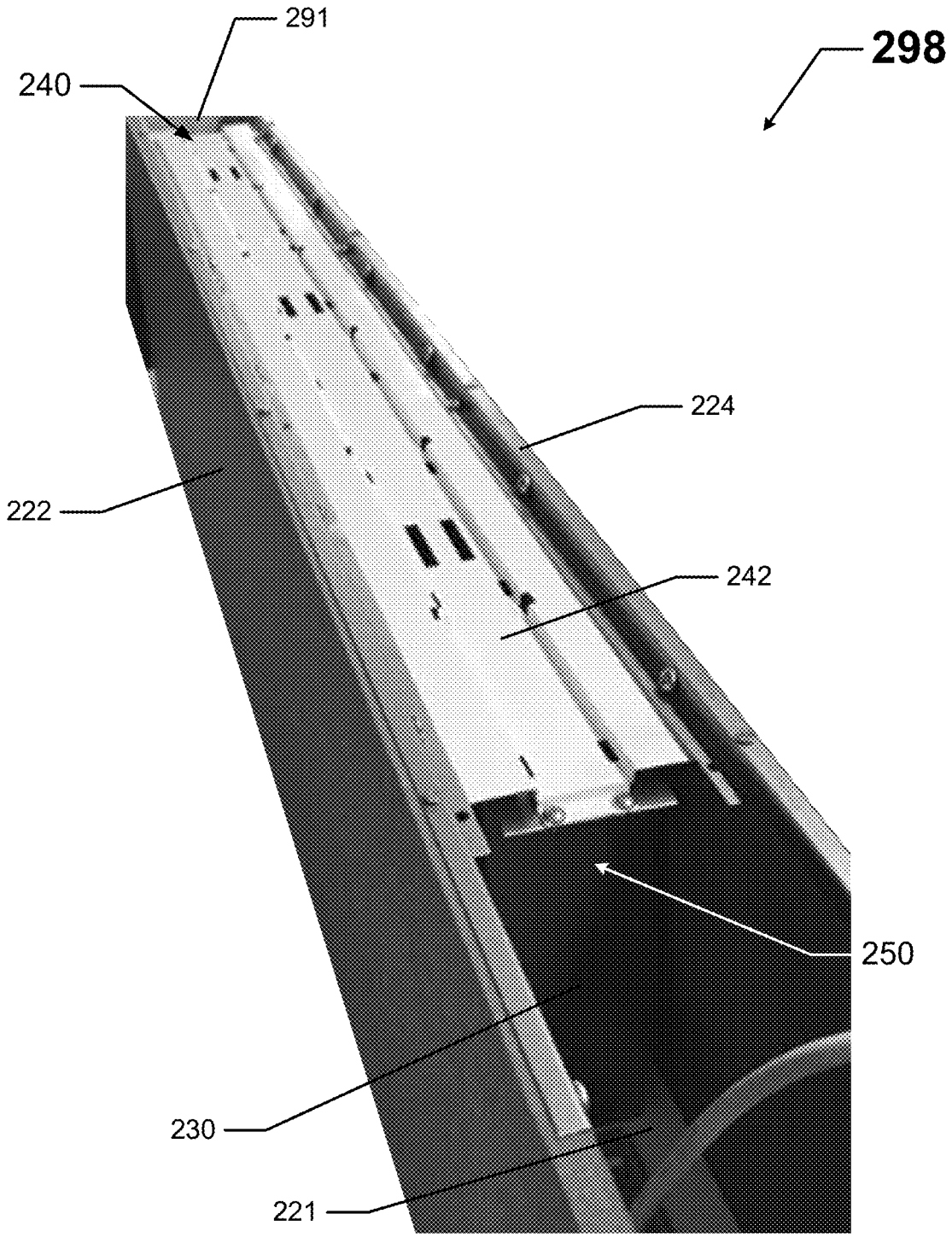
FIG. 2 shows a portion of a luminaire in accordance with certain example embodiments.

FIG. 2 shows a perspective view of a portion of a luminaire 298 in accordance with certain example embodiments. Referring to FIGS. 1 and 2, the portion of the luminaire 298 of FIG. 2 is another type of linear light fixture that has two side walls 222 and an end cap 291. The optical device (such as the optical device 190 of FIG. 1 above) is removed so that the cavity of the luminaire 298, formed by the side walls 222 and end cap 291, is exposed. To help hold the optical device in place, extending inward a small distance from the distal end of the side walls 222 are top walls 224, as shown in FIG. 2.

Within the cavity formed in part by the side walls 222, a bottom wall 221, the end cap 291, and the light engine tray 240 is a power source housing 230, which can house (at least in part) the power source, the controller, a battery system, one or more light sources, circuit boards, discrete components, switches, a heat sink, and/or any other components of the luminaire 298. Above the power source housing 230 (as shown in FIG. 2) is a light engine tray 240, which can include a mounting surface 242. In some cases, as in FIG. 2, the light engine tray 240 can be coupled to the top walls 224 and/or one or both side walls 222. While not shown in FIG. 2, a number of light sources and related components can be disposed on the mounting surface 242 of the light engine tray 240. In some cases, such light sources can be used for uplighting. As with the luminaire 199 of FIG. 1, the luminaire 298 of FIG. 2 is typically suspended a large distance from a high ceiling in a large room or other volume of space. Also, the luminaire 298 of FIG. 2 is not designed to have any enhancements that promote acoustical improvements for the room in which it is mounted.

One way that the luminaire 298 of FIG. 2 differs from luminaires in the current art is that there is at least one internal air gap 250 between the power source housing 230 and the light engine tray 240. Another way that the luminaire 298 of FIG. 2 differs from luminaires in the current art is that the side walls 222 can include sound-dampening materials to attenuate noise at select frequencies. Example embodiments also optimize the distribution of light emitted by example acoustic luminaires by moving the lighting arrays and related optics to the optimal height to provide uniform illumination on the ceiling, avoiding hot spots typically found when luminaires are mounted or suspended close to a surface (e.g., a ceiling).

Figure 3A:
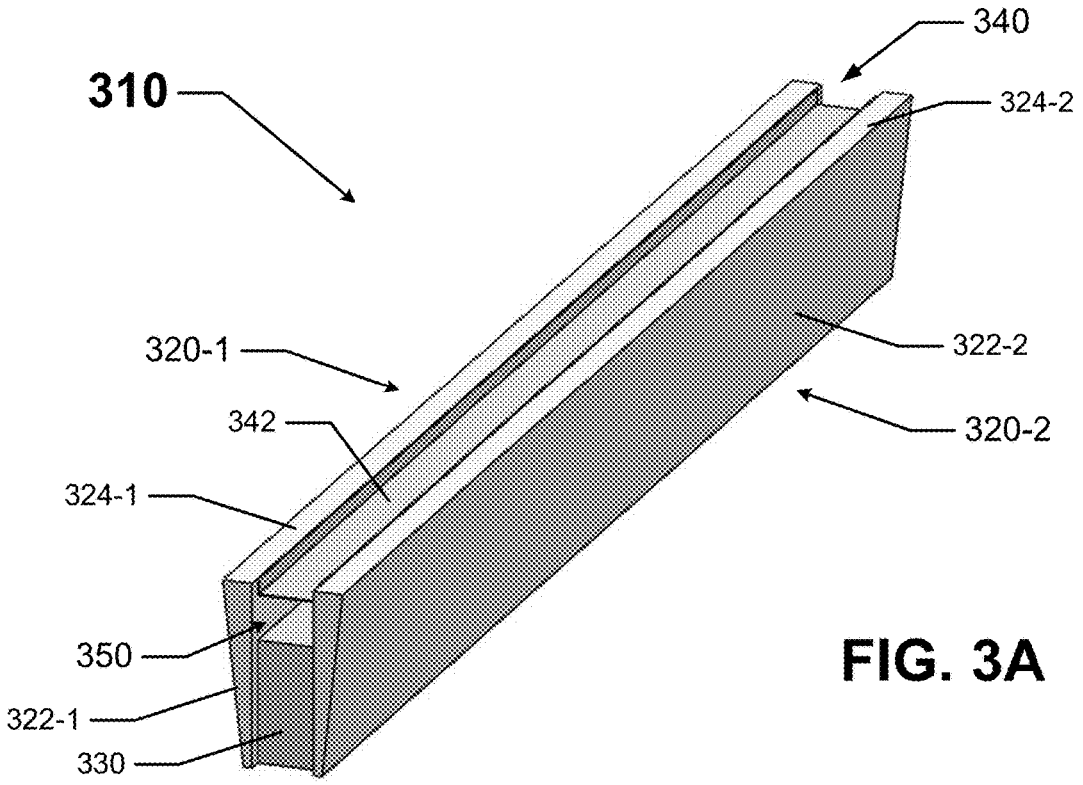
FIGS. 3A and 3B show a cross-sectional perspective view and a cross-sectional front view, respectively, of a portion of a luminaire in accordance with certain example embodiments.
Figure 3B:
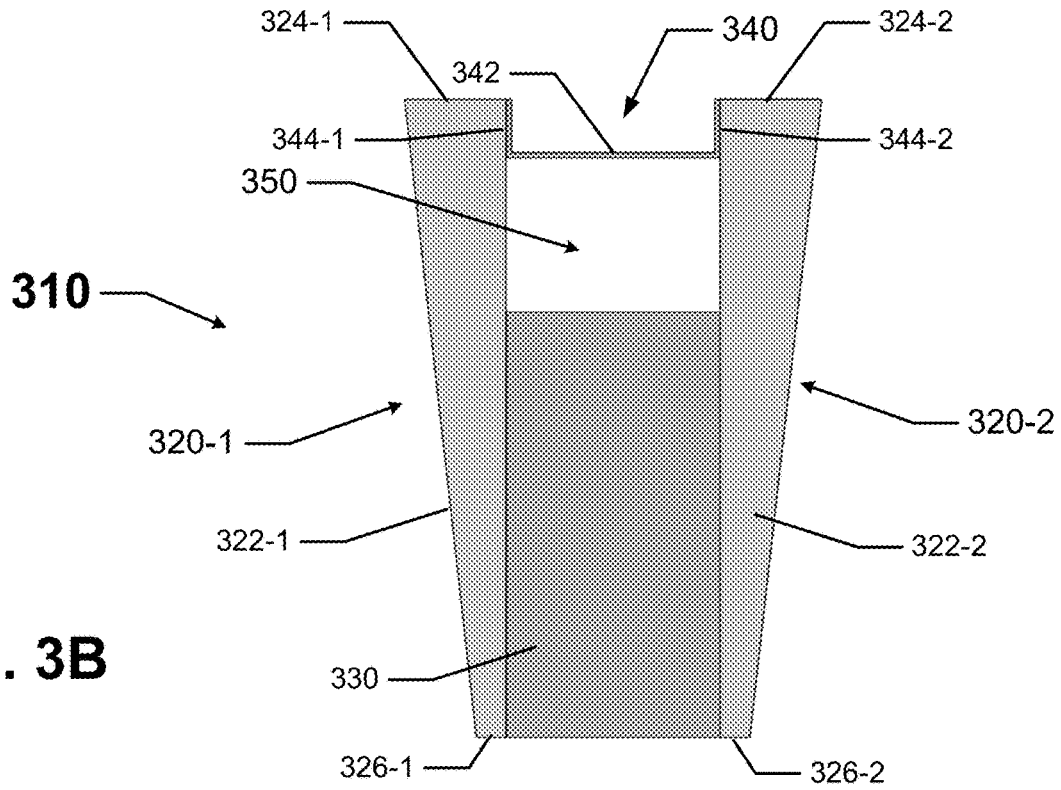

FIGS. 3A and 3B show a cross-sectional perspective view and a cross-sectional front view, respectively, of a portion of a luminaire 310 in accordance with certain example embodiments. Referring to FIGS. 1 through 3B, the portion of the luminaire 310 of FIGS. 3A and 3B has two acoustic features 320. Specifically, acoustic feature 320-1 is on one side (e.g., the left side) of the portion of the luminaire 310, and acoustic feature 320-2 is on the opposite side (e.g., the right side) of the portion of the luminaire 310 relative to acoustic feature 320-1.

Acoustic feature 320-1 includes a side wall 322-1 that is wedge-shaped when viewed from the front, having the largest width along surface 324-1 adjacent to the light engine tray 340 (at the top of FIGS. 3A and 3B, which is also toward the bottom when the luminaire 310 is hung for operation to provide light in a downward direction) and the smallest width along surface 326-1 at the opposite end (at the bottom of FIGS. 3A and 3B, which is also toward the top when the luminaire 310 is hung for operation). The transition of the width of the side wall 322-1 from surface 324-1 to surface 326-1 is linear in this case. Varying the thickness of the side wall 322-1 (as with any side wall described herein) changes the acoustic attenuation properties of the side wall 322-1.

Acoustic feature 320-2 in this case is a mirror image of acoustic feature 320-1 relative to a vertical axis through the portion of the luminaire 310. Specifically, acoustic feature 320-2 includes a side wall 322-2 that is wedge-shaped when viewed from the front, having the largest width along surface 324-2 adjacent to the light engine tray 340 (at the top of FIGS. 3A and 3B, which is also toward the bottom when the luminaire 310 is hung for operation) and the smallest width along surface 326-2 at the opposite end (at the bottom of FIGS. 3A and 3B, which is also toward the top when the luminaire 310 is hung for operation). The transition of the width of the side wall 322-2 from surface 324-2 to surface 326-2 is linear in this case.

The angled outer surface of side wall 322-1 and side wall 322-2 (relative to the vertical orientation of the inner surface of side wall 322-1 and side wall 322-2) can help diffuse sound, limit destructive interference, and mitigate distortion of that sound. Acoustic feature 320-1 and acoustic feature 320-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 320-1 can be the same as, or different than, the one or more materials of acoustic feature 320-2. Similarly, the configuration of acoustic feature 320-1 can be the same as, or different than, the configuration of acoustic feature 320-2.

The portion of the luminaire 310 of FIGS. 3A and 3B also includes a light engine tray 340, which includes mounting surface 342, side wall 344-1 disposed at one end (e.g., the left end) of the mounting surface 342, and side wall 344-2 disposed at the opposite end (e.g., the right end) of the mounting surface 342. Side wall 344-1 and side wall 344-2 are substantially parallel to each other and are substantially perpendicular to the mounting surface 342. In this case, side wall 344-1 is coupled to the inner surface of the side wall 322-1 of acoustic feature 320-1, and side wall 344-2 is coupled to the inner surface of the side wall 322-2 of acoustic feature 320-2. The light engine tray 340 can be substantially similar to the light engine tray 240 discussed above with respect to FIG. 2 as to its form, purpose, and function.

The portion of the luminaire 310 of FIGS. 3A and 3B also includes a power source housing 330. The power source housing 330 of the luminaire 310 of FIGS. 3A and 3B can be substantially similar to the power source housing 230 of FIG. 2. However, in this case, rather than the power source housing 330 and the mounting surface 342 of the light engine tray 340 abutting against each other, there is an air chamber 350 (also called an air gap 350) between the power source housing 330, the mounting surface 342 of the light engine tray 340, the inner surface of side wall 322-1, and the inner surface of side wall 322-2.

In this case, when viewed from the front, the air chamber 350 has a rectangular cross-sectional shape. The air chamber 350 can be formed by extending the length of the side walls 322 and/or by reducing the height of the power source housing 330 relative to the corresponding components of luminaires currently used in the art, such as the luminaire 199 of FIG. 1 and the luminaire 298 of FIG. 2. In certain example embodiments, the air chamber 350 can be considered a type of acoustic feature (as with acoustic features 320-1 and acoustic feature 320-2). The air chamber 350 can be filled with no material. Alternatively, some or all of the air chamber 350 can be filled with one or more of a number of materials (e.g., fiberglass) that can help the air chamber 350 perform one or more acoustic functions, including but not limited to attenuating sound, diffusing sound, limiting destructive interference, and mitigating distortion of sound.

Figure 4A:
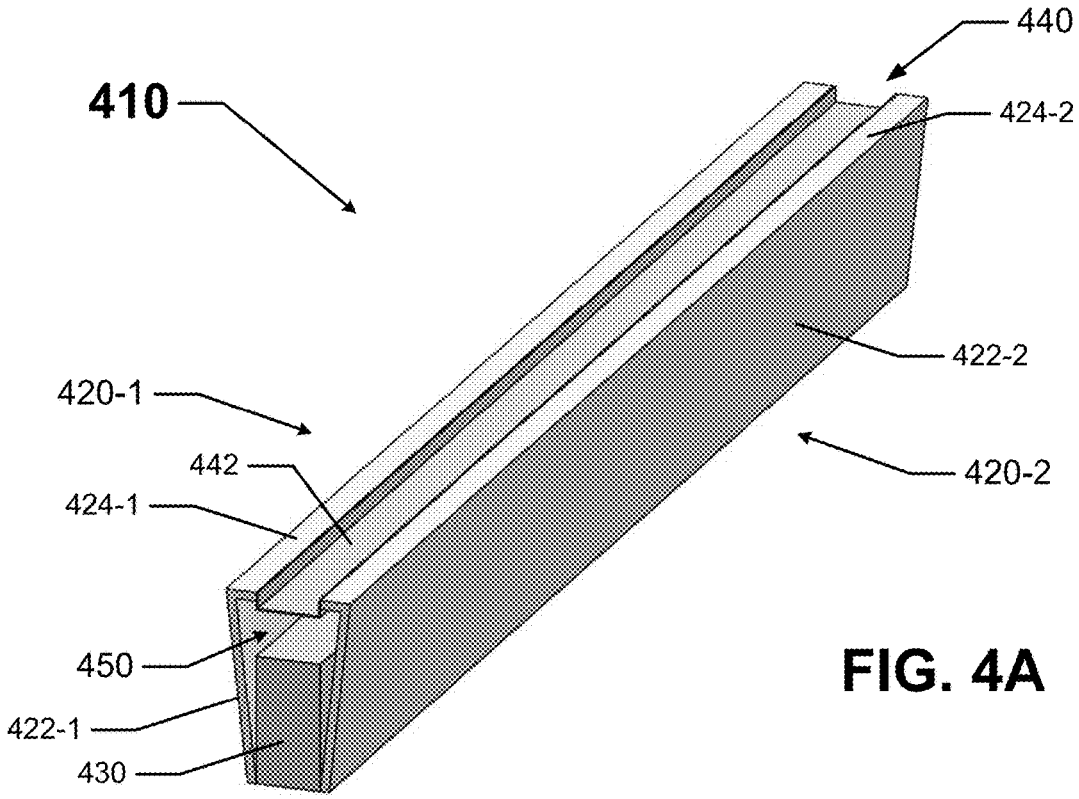
FIGS. 4A and 4B show a cross-sectional perspective view and a cross-sectional front view, respectively, of a portion of another luminaire in accordance with certain example embodiments.
Figure 4B:
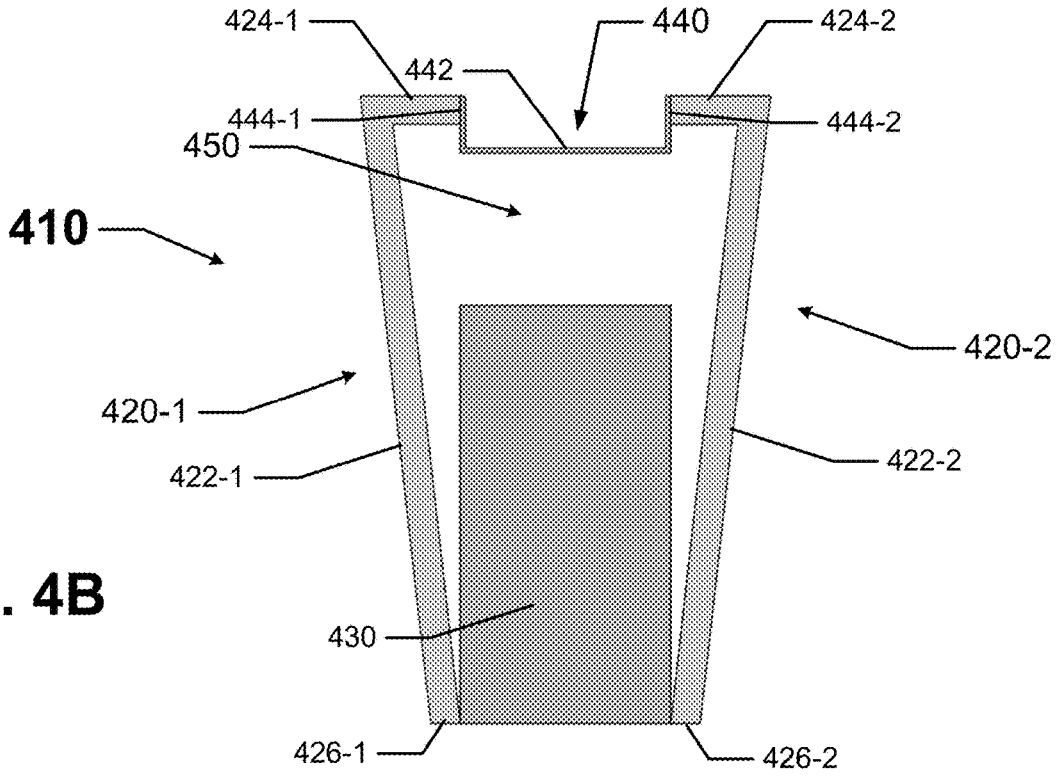

FIGS. 4A and 4B show a cross-sectional perspective view and a cross-sectional front view, respectively, of a portion of another luminaire 410 in accordance with certain example embodiments. Referring to FIGS. 1 through 4B, the portion of the luminaire 410 of FIGS. 4A and 4B has two acoustic features 420. Specifically, acoustic feature 420-1 is on one side (e.g., the left side) of the portion of the luminaire 410, and acoustic feature 420-2 is on the opposite side (e.g., the right side) of the portion of the luminaire 410 relative to acoustic feature 420-1.

Acoustic feature 420-1 includes a side wall 422-1 and a top wall 424-1 that is somewhat L-shaped with respect to each other when viewed from the front, where the width of the side wall 422-1 and the top wall 424-1 is substantially uniform along their lengths. The bottom surface 426-1 of side wall 422-1 is coupled to the bottom of the power source housing 430, and the rest of the side wall 422-1 is substantially planar and forms an angle (in this case, a small acute angle) with the adjacent side of the power source housing 430. At the top of the side wall 422-1, the top wall 424-1 extends inward in a substantially horizontal direction. The side wall 422-1 and the top wall 424-1 in this case are planar segments.

Acoustic feature 420-2 in this case is a mirror image of acoustic feature 420-1 relative to a vertical axis through the portion of the luminaire 410. Specifically, acoustic feature 420-2 includes a side wall 422-2 and a top wall 424-2 that is somewhat L-shaped with respect to each other when viewed from the front, where the width of the side wall 422-2 and the top wall 424-2 is substantially uniform along their lengths. The bottom surface 426-2 of side wall 422-2 is coupled to the bottom of the power source housing 430, and the rest of the side wall 422-2 is substantially planar and forms an angle (in this case, a small acute angle) with the adjacent side of the power source housing 430. At the top of the side wall 422-2, the top wall 424-2 extends inward in a substantially horizontal direction. The side wall 422-2 and the top wall 424-2 in this case are planar segments.

The angled outer surface of side wall 422-1 and side wall 422-2 (relative to the vertical axis defined by the sides of the power source housing 430) can help diffuse sound, limit destructive interference, and mitigate distortion of that sound. Acoustic feature 420-1 and acoustic feature 420-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 420-1 can be the same as, or different than, the one or more materials of acoustic feature 420-2. Similarly, the configuration of acoustic feature 420-1 can be the same as, or different than, the configuration of acoustic feature 420-2.

The portion of the luminaire 410 of FIGS. 4A and 4B also includes a light engine tray 440, which includes mounting surface 442, side wall 444-1 disposed at one end of the mounting surface 442, and side wall 444-2 disposed at the opposite end of the mounting surface 442. Side wall 444-1 and side wall 444-2 are substantially parallel to each other and are substantially perpendicular to the mounting surface 442. In this case, side wall 444-1 is coupled to top wall 424-1 of acoustic feature 420-1, and side wall 444-2 is coupled to top wall 424-2 of acoustic feature 420-2. The light engine tray 440 can be substantially similar to the light engine trays discussed above as to, for example, its form, purpose, and function.

The portion of the luminaire 410 of FIGS. 4A and 4B also includes a power source housing 430. The power source housing 430 of the luminaire 410 of FIGS. 4A and 4B can be substantially similar to the power source housings discussed above. In this case, as was the case with the portion of the luminaire 310 of FIGS. 3A and 3B, rather than the power source housing 430 and the mounting surface 442 of the light engine tray 440 abutting against each other, there is an air chamber 450 (also called an air gap 450) between the power source housing 430, the mounting surface 442 of the light engine tray 440, the inner surface of side wall 422-1, and the inner surface of side wall 422-2.

In this case, when viewed from the front, the air chamber 450 has an irregular but vertically-symmetrical cross-sectional shape. The air chamber 450 can be formed by extending the length of the side walls 422 and/or by reducing the height of the power source housing 430 relative to the corresponding components of luminaires currently used in the art, such as the luminaire 199 of FIG. 1 and the luminaire 298 of FIG. 2. In certain example embodiments, the air chamber 450 can be considered a type of acoustic feature (as with acoustic features 420-1 and acoustic feature 420-2). The air chamber 450 can be filled with no material. Alternatively, some or all of the air chamber 450 can be filled with one or more of a number of materials (e.g., fiberglass) that can help the air chamber 450 perform one or more acoustic functions, including but not limited to attenuating sound, diffusing sound, limiting destructive interference, and mitigating distortion of sound.

Figure 5A:
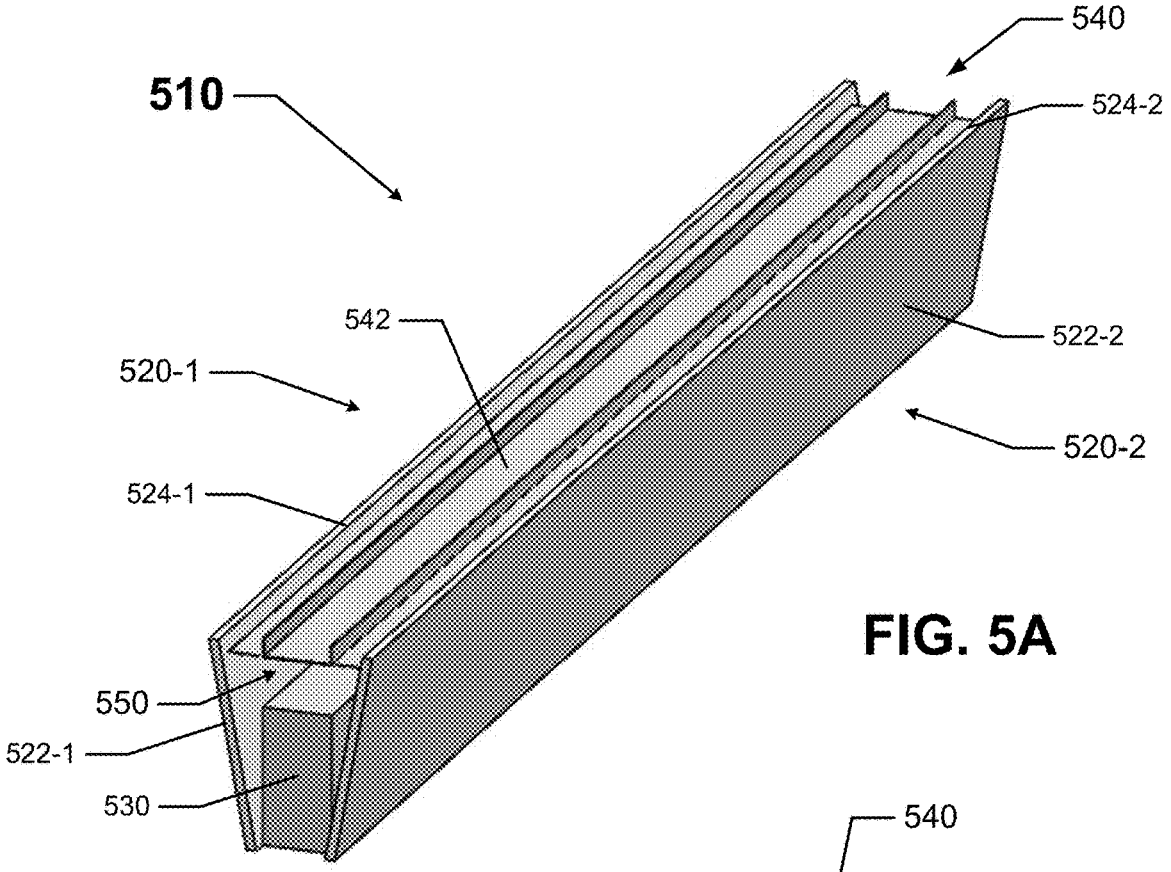
FIGS. 5A and 5B show a cross-sectional perspective view and a cross-sectional front view, respectively, of a portion of yet another luminaire in accordance with certain example embodiments.
Figure 5B:
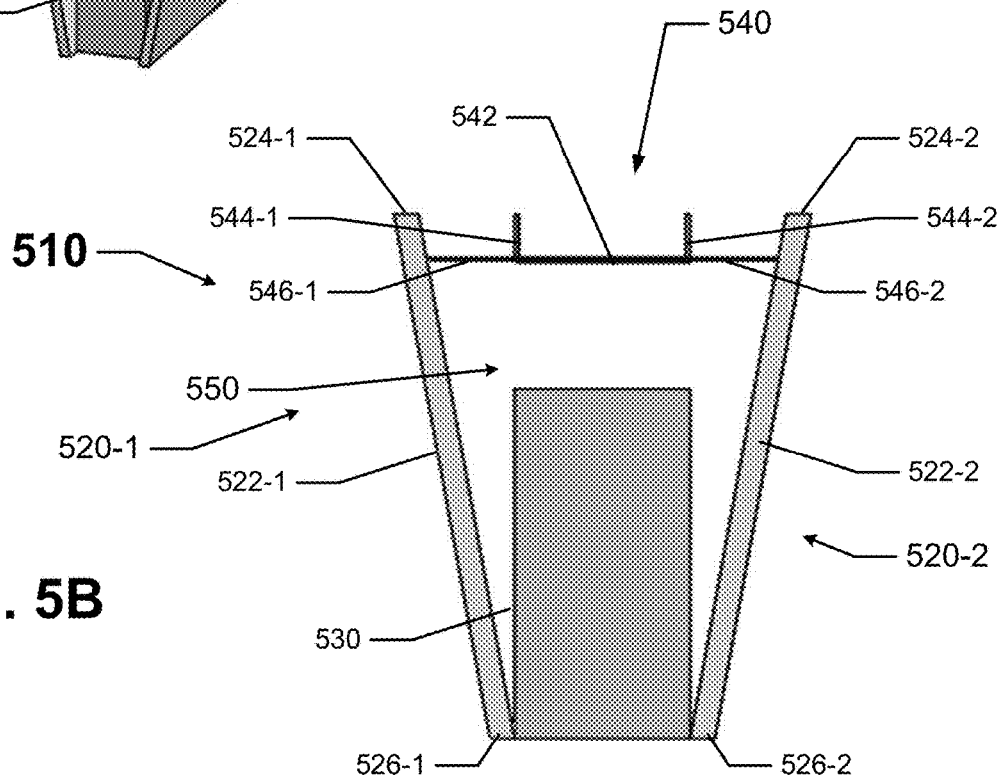

FIGS. 5A and 5B show a cross-sectional perspective view and a cross-sectional front view, respectively, of a portion of yet another luminaire in accordance with certain example embodiments. Referring to FIGS. 1 through 5B, the portion of the luminaire 510 of FIGS. 5A and 5B has two acoustic features 520. Specifically, acoustic feature 520-1 is on one side (e.g., the left side) of the portion of the luminaire 510, and acoustic feature 520-2 is on the opposite side (e.g., the right side) of the portion of the luminaire 510 relative to acoustic feature 520-1.

Acoustic feature 520-1 includes a side wall 522-1, but does not include a top wall, such as top wall 424-1 in FIGS. 4A and 4B. The width of the side wall 522-1 is substantially uniform along its length. The bottom surface 526-1 of side wall 522-1 is coupled to the bottom of the power source housing 530, and the rest of the side wall 522-1 is substantially planar and forms an angle (in this case, a small acute angle) with the adjacent side of the power source housing 530. A top surface 524-1 defines the top of the side wall 522-1.

Acoustic feature 520-2 in this case is a mirror image of acoustic feature 520-1 relative to a vertical axis through the portion of the luminaire 510. Specifically, acoustic feature 520-2 includes a side wall 522-2, but does not include a top wall, such as top wall 424-2 in FIGS. 4A and 4B. The width of the side wall 522-2 is substantially uniform along its length. The bottom surface 526-2 of side wall 522-2 is coupled to the bottom of the power source housing 530, and the rest of the side wall 522-2 is substantially planar and forms an angle (in this case, a small acute angle) with the adjacent side of the power source housing 530. A top surface 524-2 defines the top of the side wall 522-2.

The angled outer surface of side wall 522-1 and side wall 522-2 (relative to the vertical axis defined by the sides of the power source housing 530) can help diffuse sound, limit destructive interference, and mitigate distortion of that sound. Acoustic feature 520-1 and acoustic feature 520-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 520-1 can be the same as, or different than, the one or more materials of acoustic feature 520-2. Similarly, the configuration of acoustic feature 520-1 can be the same as, or different than, the configuration of acoustic feature 520-2.

The portion of the luminaire 510 of FIGS. 5A and 5B also includes a light engine tray 540, which includes mounting surface 542, side wall 544-1 disposed at one end (e.g., left end) of the mounting surface 542, side wall 544-2 disposed at the opposite end (e.g., right end) of the mounting surface 542, extension 546-1 that extends laterally away from one end (e.g., left end) of the mounting surface 542, and extension 546-2 that extends laterally away from one end (e.g., right end) of the mounting surface 542. Side wall 544-1 and side wall 544-2 are substantially parallel to each other and are substantially perpendicular to the mounting surface 442. In this case, extension 546-1 is coupled to side wall 522-1 of acoustic feature 520-1, and extension 546-2 is coupled to side wall 522-2 of acoustic feature 520-2. The light engine tray 540 (or portions thereof) can be substantially similar to the light engine trays discussed above as to, for example, its form, purpose, and function.

The portion of the luminaire 510 of FIGS. 5A and 5B also includes a power source housing 530. The power source housing 530 of the luminaire 510 of FIGS. 5A and 5B can be substantially similar to the power source housings discussed above. In this case, as was the case with the portion of the luminaire 310 of FIGS. 3A and 3B, rather than the power source housing 530 and the mounting surface 542 of the light engine tray 540 abutting against each other, there is an air chamber 550 (also called an air gap 550) between the power source housing 530, the mounting surface 542 of the light engine tray 540, extension 546-1 of the light engine tray 540, extension 546-2 of the light engine tray 540, the inner surface of side wall 522-1, and the inner surface of side wall 522-2.

In this case, when viewed from the front, the air chamber 550 has an irregular but vertically-symmetrical cross-sectional shape. The air chamber 550 can be formed by extending the length of the side walls 522 and/or by reducing the height of the power source housing 530 relative to the corresponding components of luminaires currently used in the art, such as the luminaire 199 of FIG. 1 and the luminaire 298 of FIG. 2. In certain example embodiments, the air chamber 550 can be considered a type of acoustic feature (as with acoustic features 520-1 and acoustic feature 520-2). The air chamber 550 can be filled with no material. Alternatively, some or all of the air chamber 550 can be filled with one or more of a number of materials (e.g., fiberglass) that can help the air chamber 550 perform one or more acoustic functions, including but not limited to attenuating sound, diffusing sound, limiting destructive interference, and mitigating distortion of sound.

In certain example embodiments, one or more components of the portion of an acoustic feature 520 of the luminaire 510 (or any example acoustic feature of any luminaire shown or described herein) can be adjustable. For example, the angle formed between the side wall (e.g., side wall 522-1) of an acoustic feature (e.g., acoustic feature 520-1) and the power source housing 530 can be increased or decreased by a user. As another example, an extension (e.g., extension 546-1) of a light engine tray (e.g., light engine tray 540) can be lengthened or shortened by a user. As yet another example, a user can insert or remove a material from the air chamber 550. Any of these adjustments can be made at any time, including but not limited to during manufacturing, on site before installation, and after installation.

As still another example, a wall (e.g., a side wall 522, and end wall) can be removable, adjustable, and/or replaceable by a user. For instance, an end wall (or portions thereof) of a linear segment of a luminaire that has no acoustic feature can be removed and replaced with another end wall (or corresponding portions thereof) that has one or more acoustic features (e.g., covered in a certain material, having extensions). Similarly, one or more side walls (or portions thereof) can be removed and replaced with another side wall (or corresponding portions thereof) that has one or more acoustic features.

In certain example embodiments, one or more acoustic features of a wall are removable, adjustable, insertable, and/or replaceable. In such a case, particular acoustic features can be added and/or replaced without changing the corresponding wall of the luminaire. For example, a wall of an example luminaire can have one or more coupling features (e.g., slots, tabs, snap fittings) for receiving a panel that couples to an outer surface of the wall using complementary coupling features. Such a panel can have one or more acoustic features (e.g., covered in a certain material, having extensions). As another example, the angle at which an extension (e.g., extension 1028, discussed below) forms with a wall (e.g., a side wall) can be adjusted by a user. Generically speaking, changing (e.g., adding, adjusting, replacing, removing) any of the acoustic features of any part of a luminaire can be described as changing the configuration of the acoustic feature of the luminaire.

Figure 6A:
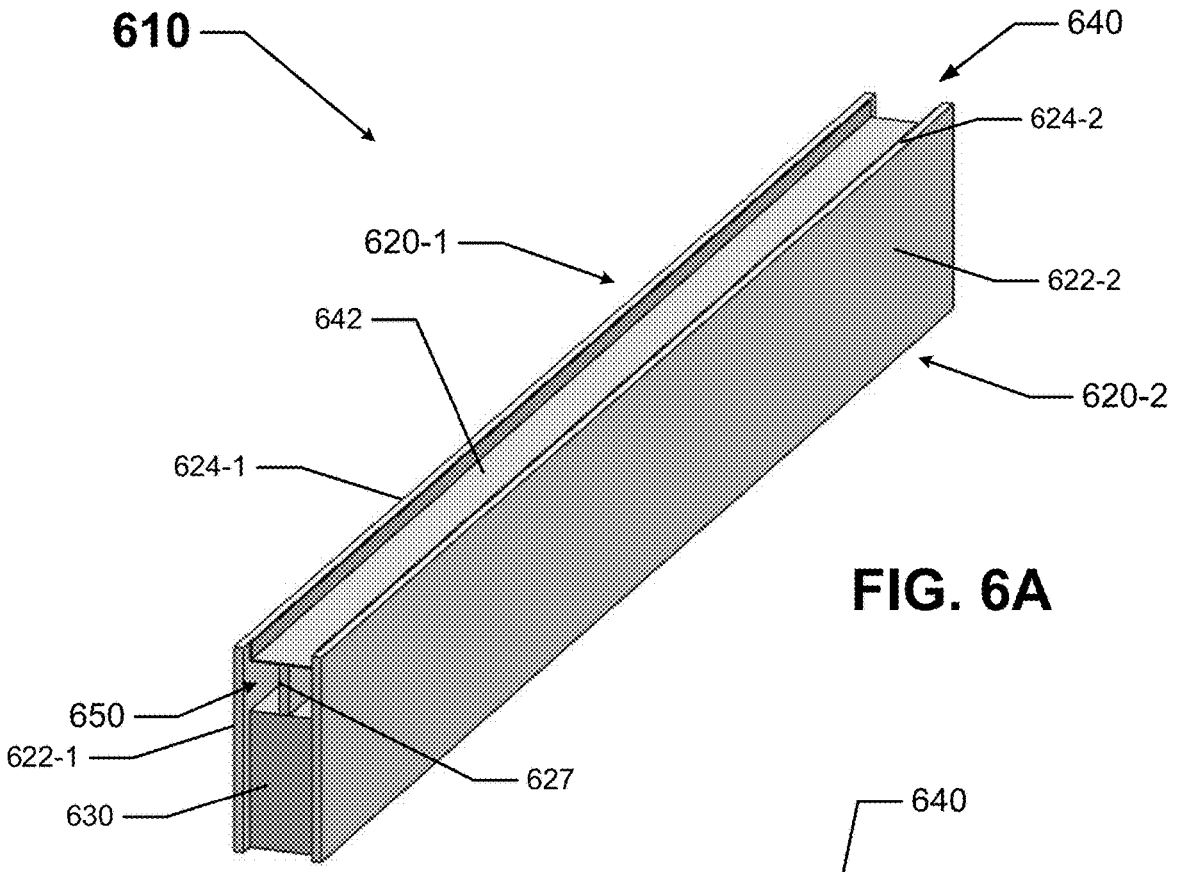
FIGS. 6A and 6B show a cross-sectional perspective view and a cross-sectional front view, respectively, of a portion of still another luminaire in accordance with certain example embodiments.
Figure 6B:
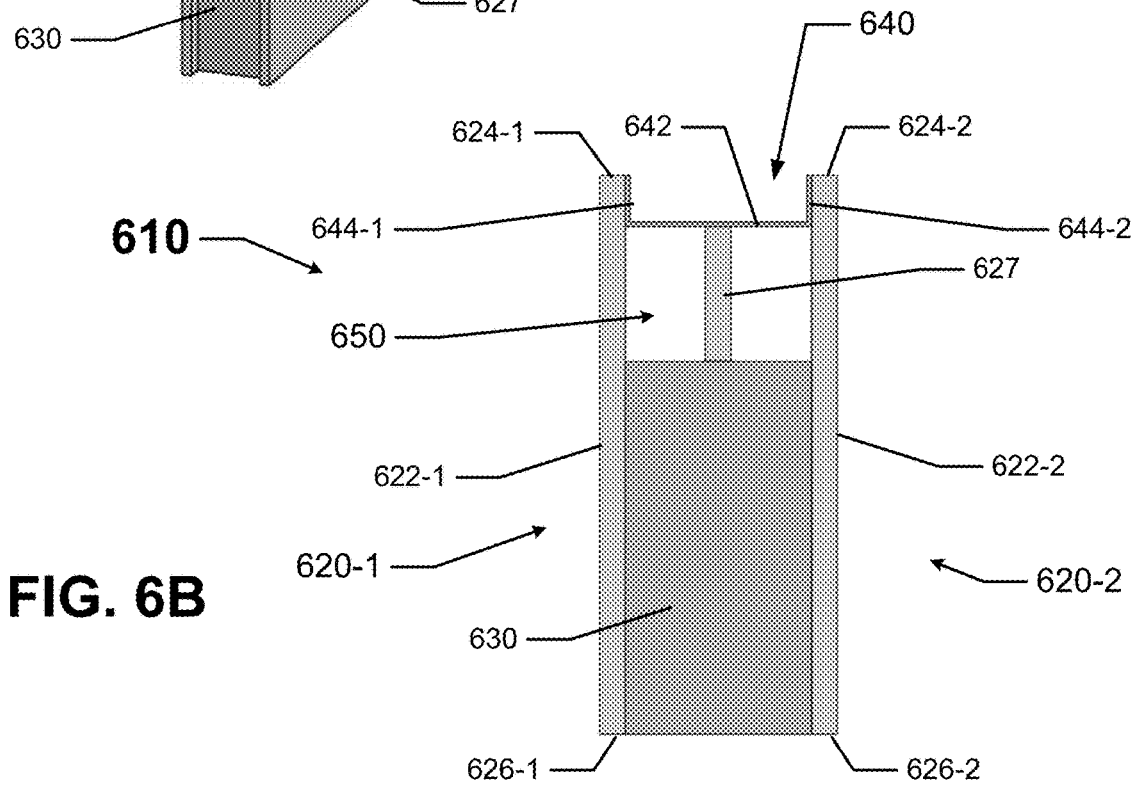

FIGS. 6A and 6B show a cross-sectional perspective view and a cross-sectional front view, respectively, of a portion of still another luminaire 610 in accordance with certain example embodiments. Referring to FIGS. 1 through 6B, the portion of the luminaire 610 of FIGS. 6A and 6B has two acoustic features 620. Specifically, acoustic feature 620-1 is on one side (e.g., the left side) of the portion of the luminaire 610, and acoustic feature 620-2 is on the opposite side (e.g., the right side) of the portion of the luminaire 610 relative to acoustic feature 620-1.

Acoustic feature 620-1 includes a side wall 622-1 that is planar (not wedge-shaped) when viewed from the front, where the side wall 622-1 has a top surface 624-1 and a bottom surface 626-1. Acoustic feature 620-2 in this case is a mirror image of acoustic feature 620-1 relative to a vertical axis through the portion of the luminaire 610. Specifically, acoustic feature 620-2 includes a side wall 622-2 that is planar (not wedge-shaped) when viewed from the front, where the side wall 622-2 has a top surface 624-2 and a bottom surface 626-2. In this case, side wall 622-1 and side wall 622-2 are parallel to each other.

Even though side wall 622-1 and side wall 622-2 are planar and parallel to each other, side wall 622-1 and side wall 622-2 can help diffuse sound, limit destructive interference, and mitigate distortion of that sound based on the material of acoustic feature 620-1 and acoustic feature 620-2. Acoustic feature 620-1 and acoustic feature 620-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 620-1 can be the same as, or different than, the one or more materials of acoustic feature 620-2. Similarly, the configuration of acoustic feature 620-1 can be the same as, or different than, the configuration of acoustic feature 620-2.

The portion of the luminaire 610 of FIGS. 6A and 6B also includes a light engine tray 640, which includes mounting surface 642, side wall 644-1 disposed at one end (e.g., the left end) of the mounting surface 642, and side wall 644-2 disposed at the opposite end (e.g., the right end) of the mounting surface 642. Side wall 644-1 and side wall 644-2 are substantially parallel to each other and are substantially perpendicular to the mounting surface 642. In this case, side wall 644-1 is coupled to the inner surface of the side wall 622-1 of acoustic feature 620-1, and side wall 644-2 is coupled to the inner surface of the side wall 622-2 of acoustic feature 620-2. The light engine tray 640 can be substantially similar to the light engine trays discussed above with respect to its form, purpose, and function.

The portion of the luminaire 610 of FIGS. 6A and 6B also includes a power source housing 630. The power source housing 630 of the luminaire 610 of FIGS. 6A and 6B can be substantially similar to the power source housings discussed above. In this case, there is an air chamber 650 (also called an air gap 650) between the power source housing 630, the mounting surface 642 of the light engine tray 640, the inner surface of side wall 622-1, and the inner surface of side wall 622-2.

In this case, when viewed from the front, the air chamber 650 has a rectangular cross-sectional shape. The air chamber 650 can be formed by extending the length of the side walls 622 and/or by reducing the height of the power source housing 630 relative to the corresponding components of luminaires currently used in the art, such as the luminaire 199 of FIG. 1 and the luminaire 298 of FIG. 2. In certain example embodiments, the air chamber 650 can be considered a type of acoustic feature (as with acoustic features 620-1 and acoustic feature 620-2).

The air chamber 650 in this case has a baffle 627 disposed therein. In alternative embodiments, there can be multiple baffles disposed in the air chamber 650. A baffle 627 can be used to divide the air chamber 650, in whole or in part, into multiple portions. A baffle 627 can have any shape and/or size. A baffle 627 can be continuous along the length of the luminaire 610 (or portion thereof). In this case, the baffle 627 is continuous along the length of the power source housing 630 and the mounting surface 642 of the light engine tray 640. Also, the baffle 627 in this example is coupled to (e.g., abuts against) the top of the power source housing 630 and the bottom of the mounting surface 642 of the light engine tray 640. In this way, the two portions of the air chamber 650 are physically isolated from each other.

Any sound waves that pass through acoustic feature 620-1 or acoustic feature 620-2 can be further attenuated or eliminated using the baffle 627. In other words, the baffle 627 can trap and/or attenuate additional sound, and the multiple portions of the air chamber 650 can greatly reduce or eliminate sound waves from escaping the air chamber once they are attenuated. A portion of the air chamber 650 can be filled with no material. Alternatively, some or all of a portion of the air chamber 650 can be filled with one or more of a number of materials (e.g., fiberglass) that can help the portion of the air chamber 650 perform one or more acoustic functions, including but not limited to attenuating sound, diffusing sound, limiting destructive interference, and mitigating distortion of sound.

Figure 7A:
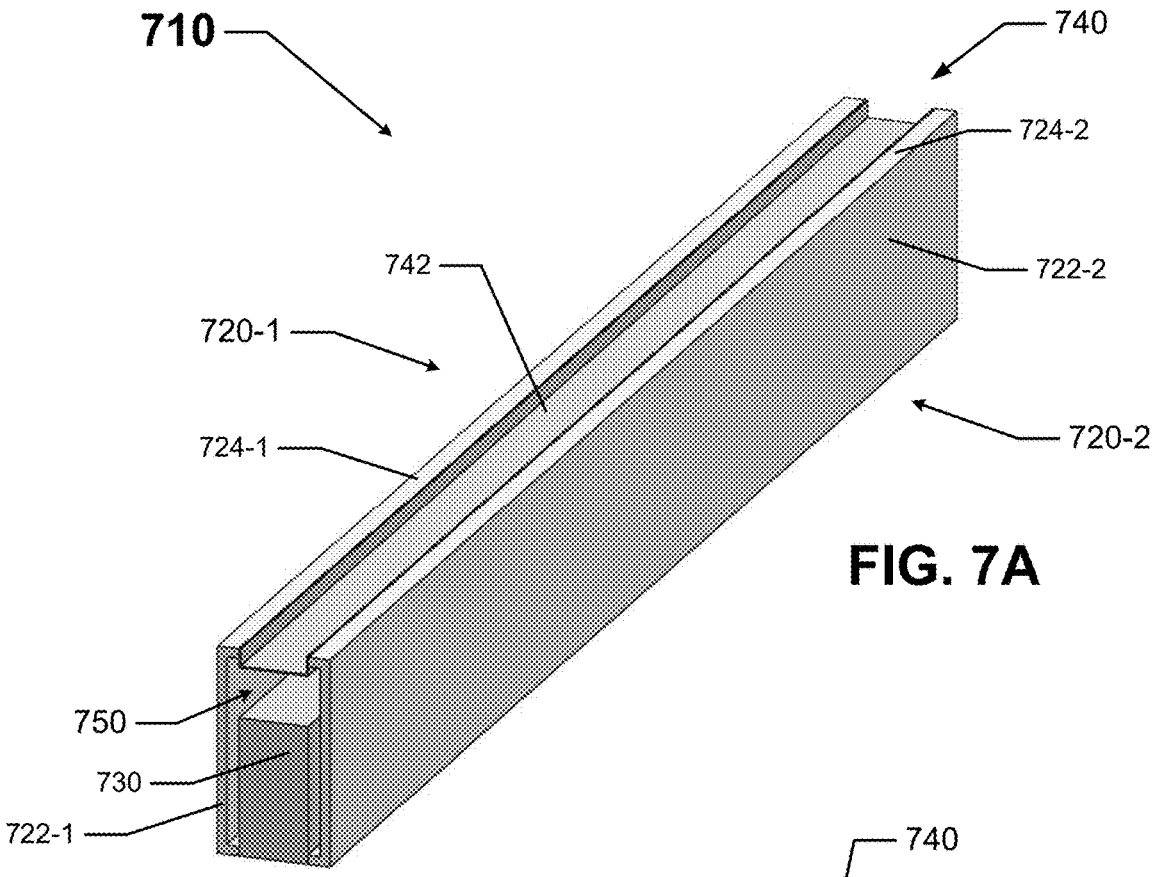
FIGS. 7A and 7B show a cross-sectional perspective view and a cross-sectional front view, respectively, of a portion of yet another luminaire in accordance with certain example embodiments.
Figure 7B:
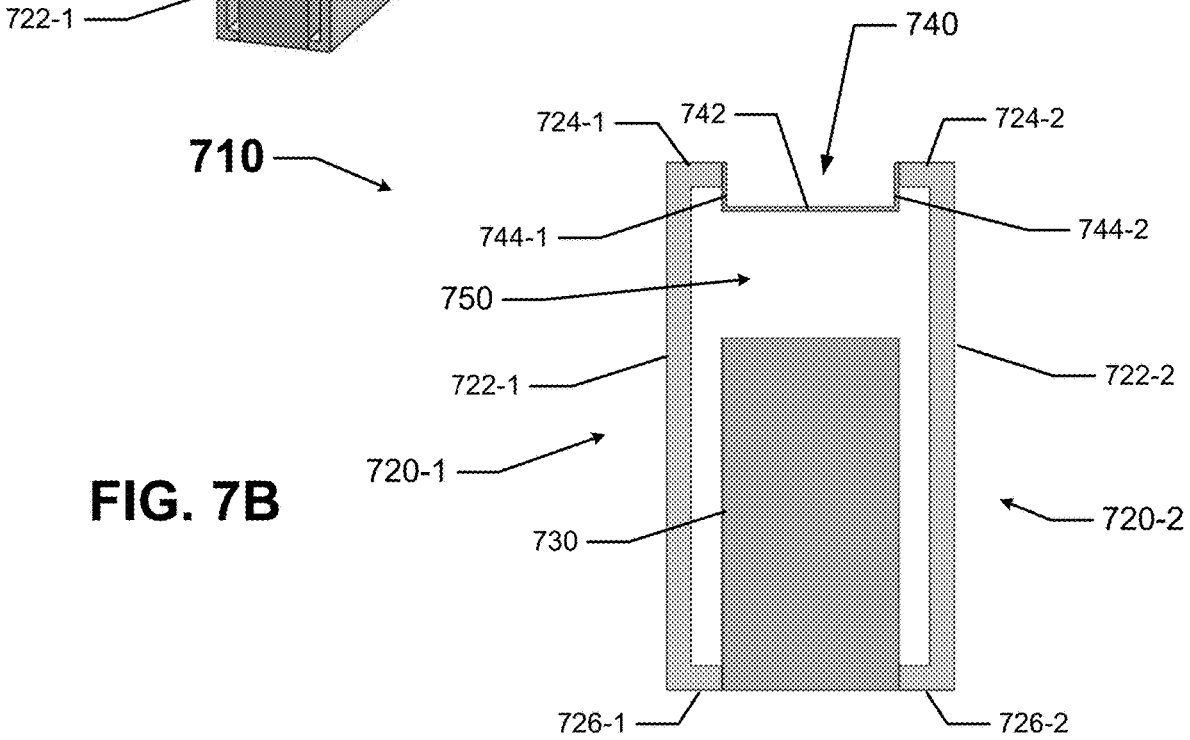

FIGS. 7A and 7B show a cross-sectional perspective view and a cross-sectional front view, respectively, of a portion of yet another luminaire 710 in accordance with certain example embodiments. Referring to FIGS. 1 through 7B, the portion of the luminaire 710 of FIGS. 7A and 7B has two acoustic features 720. Specifically, acoustic feature 720-1 is on one side (e.g., the left side) of the portion of the luminaire 710, and acoustic feature 720-2 is on the opposite side (e.g., the right side) of the portion of the luminaire 710 relative to acoustic feature 720-1.

Acoustic feature 720-1 includes a side wall 722-1 that is planar (not wedge-shaped) when viewed from the front. Acoustic feature 720-1 also includes a top wall 724-1 and a bottom wall 726-1, which are also planar. The width of the side wall 722-1, the bottom wall 726-1, and the top wall 724-1 is substantially uniform along their lengths. At the top of the side wall 722-1, the top wall 724-1 extends inward in a substantially horizontal direction, and the distal end of the top wall 724-1 is coupled to a side wall 744-1 of the light engine tray 740. Similarly, at the bottom of the side wall 722-1, the bottom wall 726-1 extends inward in a substantially horizontal direction (and so is in parallel with the top wall 724-1), and the distal end of the bottom wall 726-1 is coupled to bottom of the power source housing 730. This means that part of the air chamber 750 is disposed between the side wall 722-1 of the acoustic feature 720-1 and the power source housing 730.

Acoustic feature 720-2 in this case is a mirror image of acoustic feature 720-1 relative to a vertical axis through the portion of the luminaire 710. Specifically, acoustic feature 720-2 includes a side wall 722-2 that is planar (not wedge-shaped) when viewed from the front. Acoustic feature 720-2 also includes a top wall 724-2 and a bottom wall 726-2, which are also planar. The width of the side wall 722-2, the bottom wall 726-2, and the top wall 724-2 is substantially uniform along their lengths. At the top of the side wall 722-2, the top wall 724-2 extends inward in a substantially horizontal direction, and the distal end of the top wall 724-2 is coupled to a side wall 744-2 of the light engine tray 740.

Similarly, at the bottom of the side wall 722-2, the bottom wall 726-2 extends inward in a substantially horizontal direction (and so is in parallel with the top wall 724-2), and the distal end of the bottom wall 726-2 is coupled to bottom of the power source housing 730. This means that part of the air chamber 750 is disposed between the side wall 722-2 of the acoustic feature 720-2 and the power source housing 730. In this case, side wall 722-1 and side wall 722-2 are parallel to each other. Also, top wall 724-1 and top wall 724-2 are substantially planar with each other, and bottom wall 726-1 and bottom wall 726-2 are substantially planar with each other.

Even though side wall 722-1 and side wall 722-2 are planar and parallel to each other, side wall 722-1 and side wall 722-2 can help diffuse sound, limit destructive interference, and mitigate distortion of that sound based on the material of acoustic feature 720-1 and acoustic feature 720-2. Acoustic feature 720-1 and acoustic feature 720-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 720-1 can be the same as, or different than, the one or more materials of acoustic feature 720-2. Similarly, the configuration of acoustic feature 720-1 can be the same as, or different than, the configuration of acoustic feature 720-2.

The portion of the luminaire 710 of FIGS. 7A and 7B also includes a light engine tray 740, which includes mounting surface 742, side wall 744-1 disposed at one end (e.g., the left end) of the mounting surface 742, and side wall 744-2 disposed at the opposite end (e.g., the right end) of the mounting surface 742. Side wall 744-1 and side wall 744-2 are substantially parallel to each other and are substantially perpendicular to the mounting surface 742. In this case, side wall 744-1 is coupled to the distal end of top wall 724-1 of acoustic feature 720-1, and side wall 744-2 is coupled to the distal end of top wall 724-2 of acoustic feature 720-2. The light engine tray 740 can be substantially similar to the light engine trays discussed above with respect to its form, purpose, and function.

The portion of the luminaire 710 of FIGS. 7A and 7B also includes a power source housing 730. The power source housing 730 of the luminaire 710 of FIGS. 7A and 7B can be substantially similar to the power source housings discussed above. In this case, there is an air chamber 750 (also called an air gap 750) between the power source housing 730, the mounting surface 742 of the light engine tray 740, and the inner surfaces of top wall 724-1, side wall 722-1, bottom wall 726-1, top wall 724-2, side wall 722-2, and bottom wall 726-2.

In this case, when viewed from the front, the air chamber 750 has a "n" cross-sectional shape. The air chamber 750 can be formed by extending the length of the side walls 722, changing the length of the top walls 724 and/or the bottom walls 726, and/or by reducing the height of the power source housing 730 relative to the corresponding components of luminaires currently used in the art, such as the luminaire 199 of FIG. 1 and the luminaire 298 of FIG. 2. Increasing the size of the air chamber 750 can allow for increased attenuation. In certain example embodiments, the air chamber 750 can be considered a type of acoustic feature (as with acoustic features 720-1 and acoustic feature 720-2).

Figure 8A:
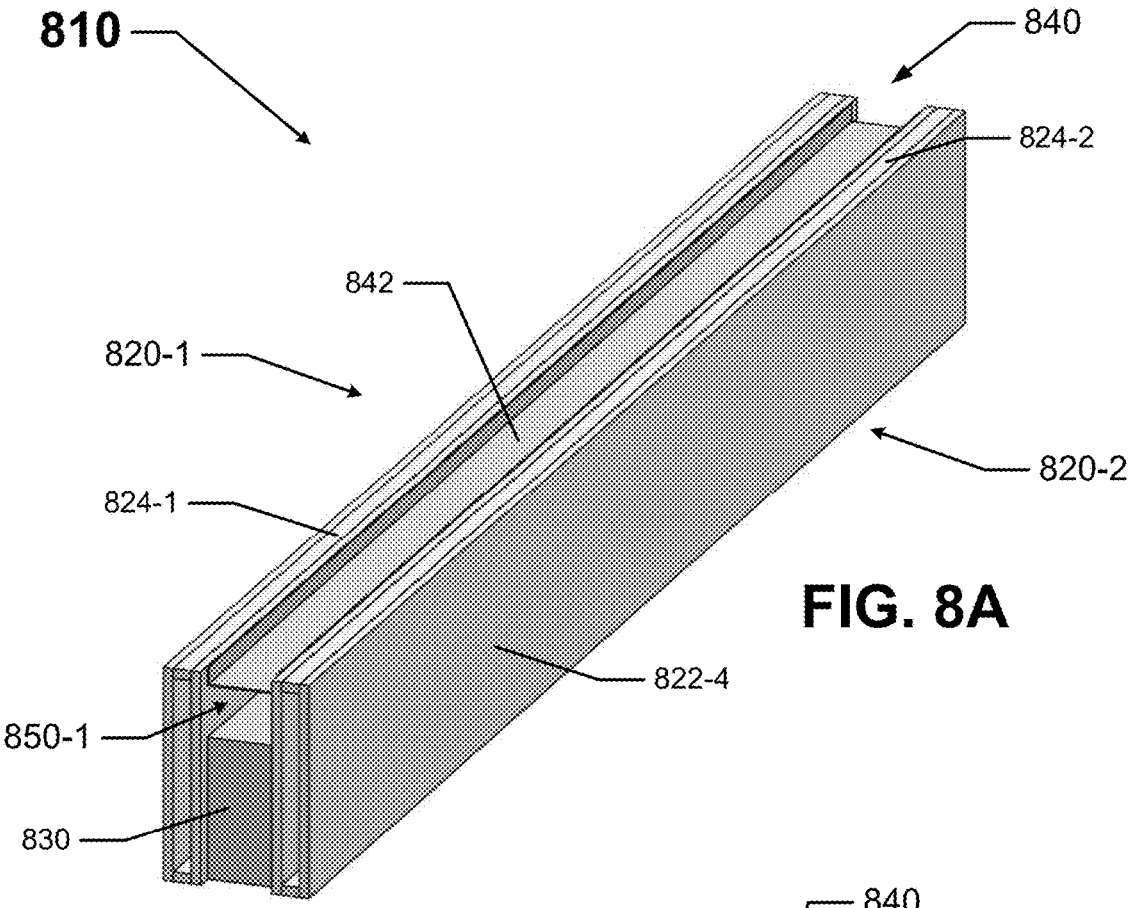
FIGS. 8A and 8B show a cross-sectional perspective view and a cross-sectional front view, respectively, of a portion of still another luminaire in accordance with certain example embodiments.
Figure 8B:
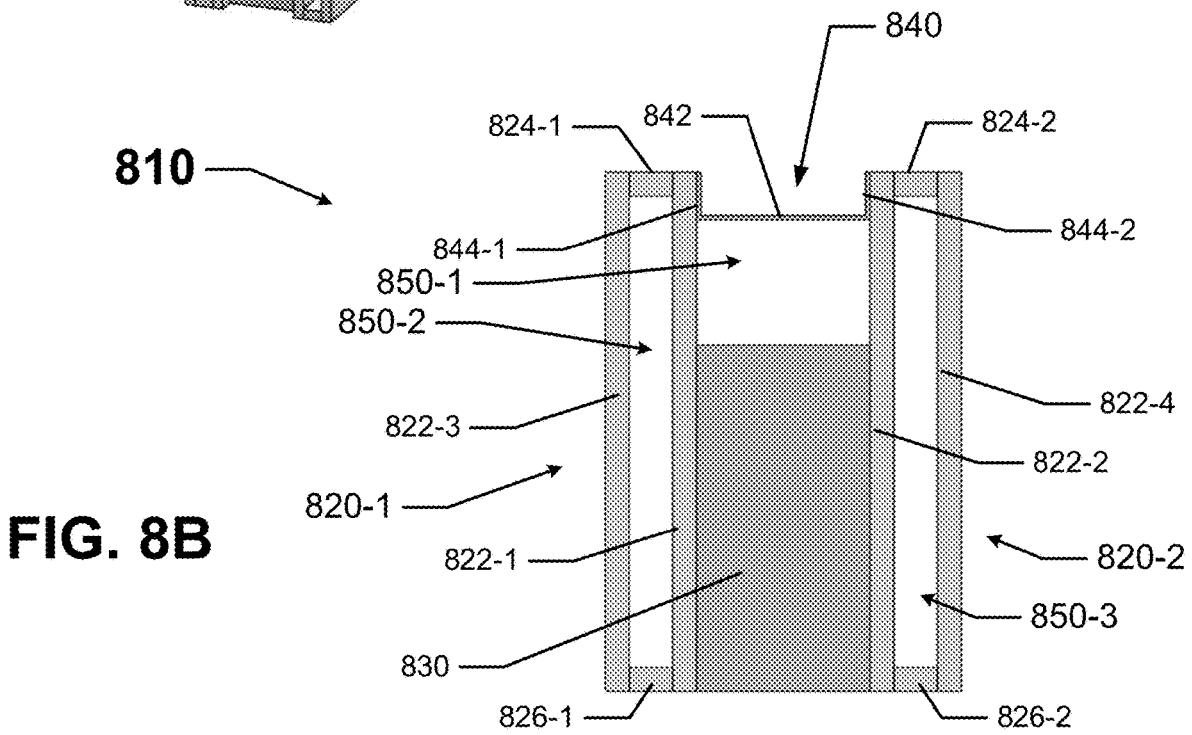

FIGS. 8A and 8B show a cross-sectional perspective view and a cross-sectional front view, respectively, of a portion of still another luminaire 810 in accordance with certain example embodiments. Referring to FIGS. 1 through 8B, the portion of the luminaire 810 of FIGS. 8A and 8B has two acoustic features 820. Specifically, acoustic feature 820-1 is on one side (e.g., the left side) of the portion of the luminaire 810, and acoustic feature 820-2 is on the opposite side (e.g., the right side) of the portion of the luminaire 810 relative to acoustic feature 820-1.

Acoustic feature 820-1 includes an inner side wall 822-1 and an outer side wall 822-3 that are planar (not wedge-shaped) when viewed from the front and in this case are in parallel with each other. Acoustic feature 820-1 also includes a top wall 824-1 and a bottom wall 826-1, which are also planar. The width of the inner side wall 822-1, the outer side wall 822-3, the bottom wall 826-1, and the top wall 824-1 is substantially uniform along their lengths. The top wall 824-1 is disposed between the top of the inner side wall 822-1 and the top of the outer side wall 822-3 in a substantially horizontal direction. Similarly, the bottom wall 826-1 is disposed between the bottom of the inner side wall 822-1 and the outer side wall 822-3 in a substantially horizontal direction (and so is in parallel with the top wall 824-1). The inner surface of the inner side wall 822-1 is coupled to a side wall 844-1 of the light engine tray 840 and to the power source housing 830. This means that one air chamber 850-1 is formed by and disposed between the inner side wall 822-1, the outer side wall 822-1, the top wall 824-1, and the bottom wall 826-1 of the acoustic feature 820-1.

Acoustic feature 820-2 in this case is a mirror image of acoustic feature 820-1 relative to a vertical axis through the portion of the luminaire 810. Specifically, acoustic feature 820-2 includes an inner side wall 822-2 and an outer side wall 822-3 that are planar (not wedge-shaped) when viewed from the front and in this case are in parallel with each other. Acoustic feature 820-2 also includes a top wall 824-2 and a bottom wall 826-2, which are also planar. The width of the inner side wall 822-2, the outer side wall 822-3, the bottom wall 826-2, and the top wall 824-2 is substantially uniform along their lengths. The top wall 824-2 is disposed between the top of the inner side wall 822-2 and the top of the outer side wall 822-3 in a substantially horizontal direction.

Similarly, the bottom wall 826-2 is disposed between the bottom of the inner side wall 822-2 and the outer side wall 822-3 in a substantially horizontal direction (and so is in parallel with the top wall 824-2). The inner surface of the inner side wall 822-2 is coupled to a side wall 844-2 of the light engine tray 840 and to the power source housing 830. This means that one air chamber 850-2 is formed by and disposed between the inner side wall 822-2, the outer side wall 822-2, the top wall 824-2, and the bottom wall 826-2 of the acoustic feature 820-2. In this case, inner side wall 822-1, outer side wall 822-3, inner side wall 822-2, and outer side wall 822-4 are parallel to each other. Also, top wall 824-1 and top wall 824-2 are substantially planar with each other, and bottom wall 826-1 and bottom wall 826-2 are substantially planar with each other.

Even though inner side wall 822-1, outer side wall 822-3, inner side wall 822-2, and outer side wall 822-4 are planar and parallel to each other, these side walls 822 can help diffuse sound, limit destructive interference, and mitigate distortion of that sound based on the material of acoustic feature 820-1 and acoustic feature 820-2. Acoustic feature 820-1 and acoustic feature 820-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 820-1 can be the same as, or different than, the one or more materials of acoustic feature 820-2. Similarly, the configuration of acoustic feature 820-1 can be the same as, or different than, the configuration of acoustic feature 820-2.

The portion of the luminaire 810 of FIGS. 8A and 8B also includes a light engine tray 840, which includes mounting surface 842, side wall 844-1 disposed at one end (e.g., the left end) of the mounting surface 842, and side wall 844-2 disposed at the opposite end (e.g., the right end) of the mounting surface 842. Side wall 844-1 and side wall 844-2 are substantially parallel to each other and are substantially perpendicular to the mounting surface 842. In this case, side wall 844-1 is coupled to the upper part of the inner surface of the inner side wall 822-1 of acoustic feature 820-1, and side wall 844-2 is coupled to the upper part of the inner surface of the inner side wall 822-2 of acoustic feature 820-2. The light engine tray 840 can be substantially similar to the light engine trays discussed above with respect to its form, purpose, and function.

The portion of the luminaire 810 of FIGS. 8A and 8B also includes a power source housing 830. The power source housing 830 of the portion of the luminaire 810 of FIGS. 8A and 8B can be substantially similar to the power source housings discussed above. In this case, there is an air chamber 850-3, separate from air chamber 850-1 and air chamber 850-2, disposed between the power source housing 830, the mounting surface 842 of the light engine tray 840, and the inner surfaces of inner side wall 822-1 and inner side wall 822-2.

In this case, when viewed from the front, each of the three air chambers 850 has a rectangular cross-sectional shape. Each of the air chambers 850 (in this case, air chamber 850-1, air chamber 850-2, and air chamber 850-3) can be formed by changing the length of one or more of the side walls 822, changing the length of the top walls 824 and/or the bottom walls 826, and/or by reducing the height of the power source housing 830 relative to the corresponding components of luminaires currently used in the art, such as the luminaire 199 of FIG. 1 and the luminaire 298 of FIG. 2. Increasing the number of the air chambers 850 and the number of attenuation surfaces (e.g., side walls 822) can allow for increased attenuation. In certain example embodiments, each of the air chambers 850 of FIGS. 8A and 8B can be considered a type of acoustic feature (as with acoustic features 820-1 and acoustic feature 820-2).

Figure 9A:
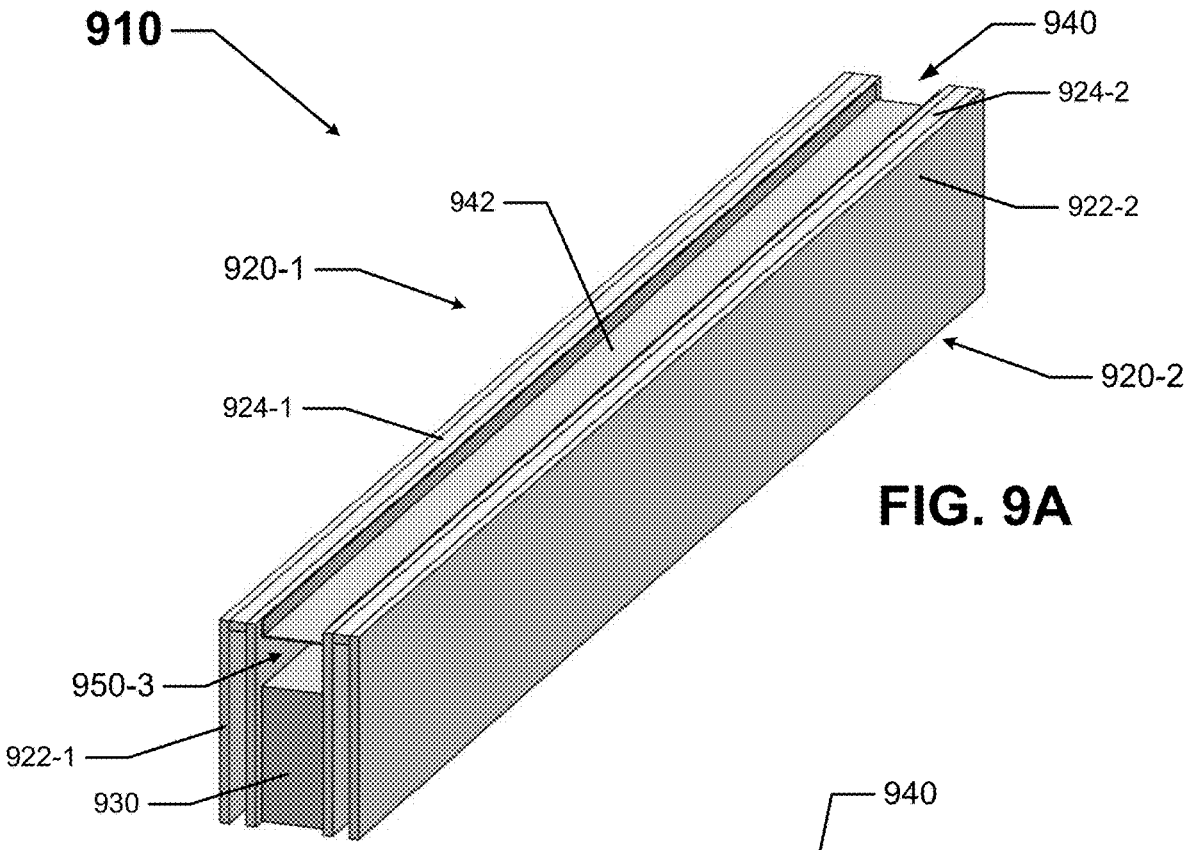
FIGS. 9A and 9B show a cross-sectional perspective view and a cross-sectional front view, respectively, of a portion of yet another luminaire in accordance with certain example embodiments.
Figure 9B:
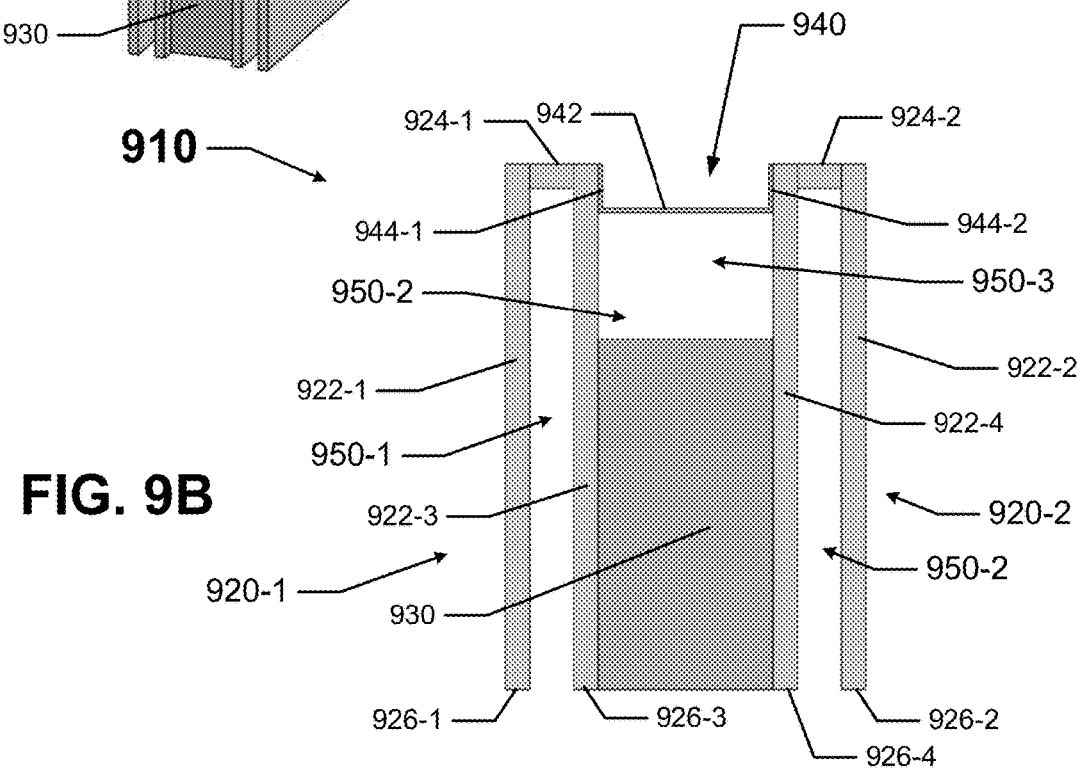

FIGS. 9A and 9B show a cross-sectional perspective view and a cross-sectional front view, respectively, of a portion of yet another luminaire 910 in accordance with certain example embodiments. Referring to FIGS. 1 through 9B, the portion of the luminaire 910 of FIGS. 9A and 9B has two acoustic features 920. Specifically, acoustic feature 920-1 is on one side (e.g., the left side) of the portion of the luminaire 910, and acoustic feature 920-2 is on the opposite side (e.g., the right side) of the portion of the luminaire 910 relative to acoustic feature 920-1. Acoustic feature 920-1 and acoustic feature 920-2 are substantially the same as acoustic feature 820-1 and acoustic feature 820-2 of FIGS. 8A and 8B, except that acoustic feature 920-1 and acoustic feature 920-2 of FIGS. 9A and 9B do not have a bottom wall.

As such, acoustic feature 920-1 includes an inner side wall 922-1 and an outer side wall 922-3 that are planar (not wedge-shaped) when viewed from the front and in this case are in parallel with each other. Acoustic feature 920-1 also includes a top wall 924-1, which is also planar. The width of the inner side wall 922-1, the outer side wall 922-3, and the top wall 924-1 is substantially uniform along their lengths. The top wall 924-1 is disposed between the top of the inner side wall 922-1 and the top of the outer side wall 922-3 in a substantially horizontal direction. The inner surface of the inner side wall 922-1 is coupled to a side wall 944-1 of the light engine tray 940 and to the power source housing 930. This means that one air chamber 950-1 is open-ended and is formed by and disposed between the inner side wall 922-1, the outer side wall 922-1, and the top wall 924-1 of the acoustic feature 920-1.

Acoustic feature 920-2 in this case is a mirror image of acoustic feature 920-1 relative to a vertical axis through the portion of the luminaire 910. Specifically, acoustic feature 920-2 includes an inner side wall 922-2 and an outer side wall 922-3 that are planar (not wedge-shaped) when viewed from the front and in this case are in parallel with each other. Acoustic feature 920-2 also includes a top wall 924-2, which is also planar. The width of the inner side wall 922-2, the outer side wall 922-3, and the top wall 924-2 is substantially uniform along their lengths. The top wall 924-2 is disposed between the top of the inner side wall 922-2 and the top of the outer side wall 922-3 in a substantially horizontal direction.

The inner surface of the inner side wall 922-2 is coupled to a side wall 944-2 of the light engine tray 940 and to the power source housing 930. This means that one air chamber 950-2 is open-ended and is formed by and disposed between the inner side wall 922-2, the outer side wall 922-2, and the top wall 924-2 of the acoustic feature 920-2. In this case, inner side wall 922-1, outer side wall 922-3, inner side wall 922-2, and outer side wall 922-4 are parallel to each other. Also, top wall 924-1 and top wall 924-2 are substantially planar with each other.

Even though inner side wall 922-1, outer side wall 922-3, inner side wall 922-2, and outer side wall 922-4 are planar and parallel to each other, these side walls 922 can help diffuse sound, limit destructive interference, and mitigate distortion of that sound based on the material of acoustic feature 920-1 and acoustic feature 920-2. Acoustic feature 920-1 and acoustic feature 920-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 920-1 can be the same as, or different than, the one or more materials of acoustic feature 920-2. Similarly, the configuration of acoustic feature 920-1 can be the same as, or different than, the configuration of acoustic feature 920-2.

The portion of the luminaire 910 of FIGS. 9A and 9B also includes a light engine tray 940, which includes mounting surface 942, side wall 944-1 disposed at one end (e.g., the left end) of the mounting surface 942, and side wall 944-2 disposed at the opposite end (e.g., the right end) of the mounting surface 942. Side wall 944-1 and side wall 944-2 are substantially parallel to each other and are substantially perpendicular to the mounting surface 942. In this case, side wall 944-1 is coupled to the upper part of the inner surface of the inner side wall 922-1 of acoustic feature 920-1, and side wall 944-2 is coupled to the upper part of the inner surface of the inner side wall 922-2 of acoustic feature 920-2. The light engine tray 940 can be substantially similar to the light engine trays discussed above with respect to its form, purpose, and function.

The portion of the luminaire 910 of FIGS. 9A and 9B also includes a power source housing 930. The power source housing 930 of the portion of the luminaire 910 of FIGS. 9A and 9B can be substantially similar to the power source housings discussed above. In this case, there is an air chamber 950-3, separate from air chamber 950-1 and air chamber 950-2, disposed between the power source housing 930, the mounting surface 942 of the light engine tray 940, and the inner surfaces of inner side wall 922-1 and inner side wall 922-2.

In this case, when viewed from the front, each of the three air chambers 950 has a rectangular cross-sectional shape. Each of the air chambers 950 (in this case, air chamber 950-1, air chamber 950-2, and air chamber 950-3) can be formed by changing the length of one or more of the side walls 922, changing the length of the top walls 924 and/or the bottom walls 926, and/or by reducing the height of the power source housing 930 relative to the corresponding components of luminaires currently used in the art, such as the luminaire 199 of FIG. 1 and the luminaire 299 of FIG. 2. In certain example embodiments, each of the air chambers 950 of FIGS. 9A and 9B can be considered a type of acoustic feature (as with acoustic features 920-1 and acoustic feature 920-2).

Figure 10A:
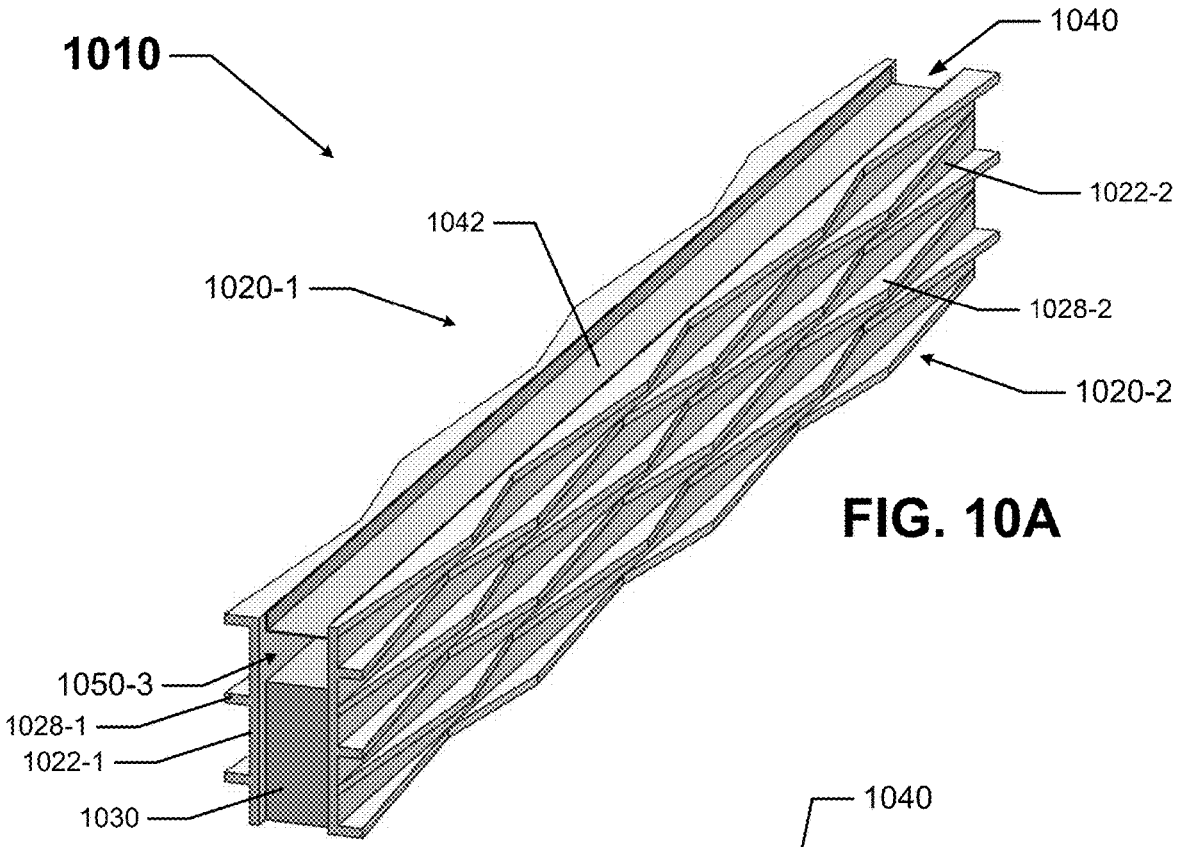
FIGS. 10A and 10B show a cross-sectional perspective view and a cross-sectional front view, respectively, of a portion of still another luminaire in accordance with certain example embodiments.
Figure 10B:
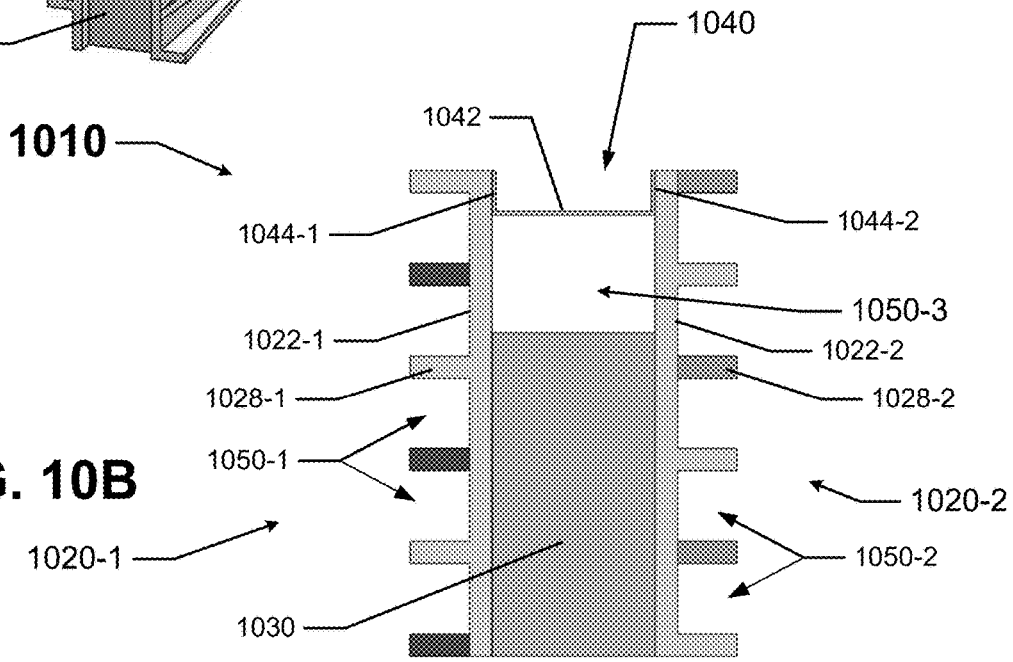

FIGS. 10A and 10B show a cross-sectional perspective view and a cross-sectional front view, respectively, of a portion of still another luminaire 1010 in accordance with certain example embodiments. Referring to FIGS. 1 through 10B, the portion of the luminaire 1010 of FIGS. 10A and 10B has two acoustic features 1020. Specifically, acoustic feature 1020-1 is on one side (e.g., the left side) of the portion of the luminaire 1010, and acoustic feature 1020-2 is on the opposite side (e.g., the right side) of the portion of the luminaire 1010 relative to acoustic feature 1020-1.

Acoustic feature 1020-1 includes a side wall 1022-1 and a number (in this case, six) of horizontally-oriented outward-directed lateral extensions 1028-1 that are planar (not wedge-shaped) when viewed from the front. In this case, the lateral extensions 1028-1 are in parallel with each other and perpendicular with the side wall 1022-1. Each lateral extension 1028-1 in this case is a series of elongated triangular segments placed in an end-to-end series. A lateral extension 1028-1 is offset by approximately ½ of a triangular segment relative to each adjacent lateral extension 1028-1. The width of the side wall 1022-1 and each extension 1028-1 is substantially uniform along their lengths. In certain example embodiments, the space formed between adjacent extensions 1028-1 and the side wall 1022-1 can be considered an open-ended air chamber 1050-1.

Acoustic feature 1020-2 in this case is a mirror image of acoustic feature 1020-1 relative to a vertical axis through the portion of the luminaire 1010. Specifically, acoustic feature 1020-2 includes a side wall 1022-2 and a number (in this case, six) of horizontally-oriented outward-directed lateral extensions 1028-2 that are planar (not wedge-shaped) when viewed from the front. In this case, the lateral extensions 1028-2 are in parallel with each other and perpendicular with the side wall 1022-2. Each lateral extension 1028-2 in this case is a series of elongated triangular segments placed in an end-to-end series. A lateral extension 1028-2 is offset by approximately ½ of a triangular segment relative to each adjacent lateral extension 1028-2. The width of the side wall 1022-2 and each extension 1028-2 is substantially uniform along their lengths. In certain example embodiments, the space formed between adjacent extensions 1028-2 and the side wall 1022-2 can be considered an open-ended air chamber 1050-2.

An extension 1028 can have any shape and/or size. An extension 1028 can be continuous along the length of the luminaire 1010 (or portion thereof). In this case, the extension 1028 is continuous along the length of the corresponding side wall 1022. Any sound waves that pass through acoustic feature 1020-1 or acoustic feature 1020-2 can be further attenuated or eliminated using the extensions 1028. In other words, the extensions 1028 can trap and/or attenuate additional sound, and the multiple air chambers 1050-1 and 1050-2 formed by the extensions 1028 can greatly reduce or eliminate sound waves from escaping the air chamber once they are attenuated. The extensions 1028 can also reduce or eliminate destructive interference, increase sound diffusion, and provide better sound reduction quality without distortion or deadening.

Even though side wall 1022-1 and side wall 1022-2 are planar and parallel to each other, side wall 1022-1 and side wall 1022-2, when combined with the various extensions 1028-1 and 1028-2, can help diffuse sound, limit destructive interference, and mitigate distortion of that sound. In addition to the configuration (e.g., number, shape, size) of each extension 1028, the material of acoustic feature 1020-1 and acoustic feature 1020-2 can also help to provide acoustic control. Acoustic feature 1020-1 and acoustic feature 1020-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1020-1 can be the same as, or different than, the one or more materials of acoustic feature 1020-2. Similarly, the configuration of acoustic feature 1020-1 can be the same as, or different than, the configuration of acoustic feature 1020-2.

The portion of the luminaire 1010 of FIGS. 10A and 10B also includes a light engine tray 1040, which includes mounting surface 1042, side wall 1044-1 disposed at one end (e.g., the left end) of the mounting surface 1042, and side wall 1044-2 disposed at the opposite end (e.g., the right end) of the mounting surface 1042. Side wall 1044-1 and side wall 1044-2 are substantially parallel to each other and are substantially perpendicular to the mounting surface 1042. In this case, side wall 1044-1 is coupled to the inner surface of the side wall 1022-1 of acoustic feature 1020-1, and side wall 1044-2 is coupled to the inner surface of the side wall 1022-2 of acoustic feature 1020-2. The light engine tray 1040 can be substantially similar to the light engine trays discussed above with respect to its form, purpose, and function.

The portion of the luminaire 1010 of FIGS. 10A and 10B also includes a power source housing 1030. The power source housing 1030 of the luminaire 1010 of FIGS. 10A and 10B can be substantially similar to the power source housings discussed above. In this case, there is an air chamber 1050-3 (also called an air gap 1050-3) between the power source housing 1030, the mounting surface 1042 of the light engine tray 1040, the inner surface of side wall 1022-1, and the inner surface of side wall 1022-2.

In this case, when viewed from the front, the air chamber 1050-3 has a rectangular cross-sectional shape. The air chamber 1050-3 can be formed by extending the length of the side walls 1022 and/or by reducing the height of the power source housing 1030 relative to the corresponding components of luminaires currently used in the art, such as the luminaire 199 of FIG. 1 and the luminaire 298 of FIG. 2. Similarly, each air chamber 1050-1 and each air chamber 1050-2 can be formed by changing one or more characteristics of the extensions 1028, the number of extensions 1028, the spacing between adjacent extensions 1028, and/or any of a number of other factors. In certain example embodiments, air chambers 1050-1, air chambers 1050-2, and air chamber 1050-3 can each be considered a type of acoustic feature (as with acoustic features 1020-1 and acoustic feature 1020-2).

A portion of air chambers 1050-1, 1050-2, and/or 1050-3 can be filled with no material. Alternatively, some or all of a portion of air chambers 1050-1, 1050-2, and/or 1050-3 can be filled with one or more of a number of materials (e.g., fiberglass) that can help the portion of air chambers 1050-1, 1050-2, and/or 1050-3 perform one or more acoustic functions, including but not limited to attenuating sound, diffusing sound, limiting destructive interference, and mitigating distortion of sound.

Figure 11A:
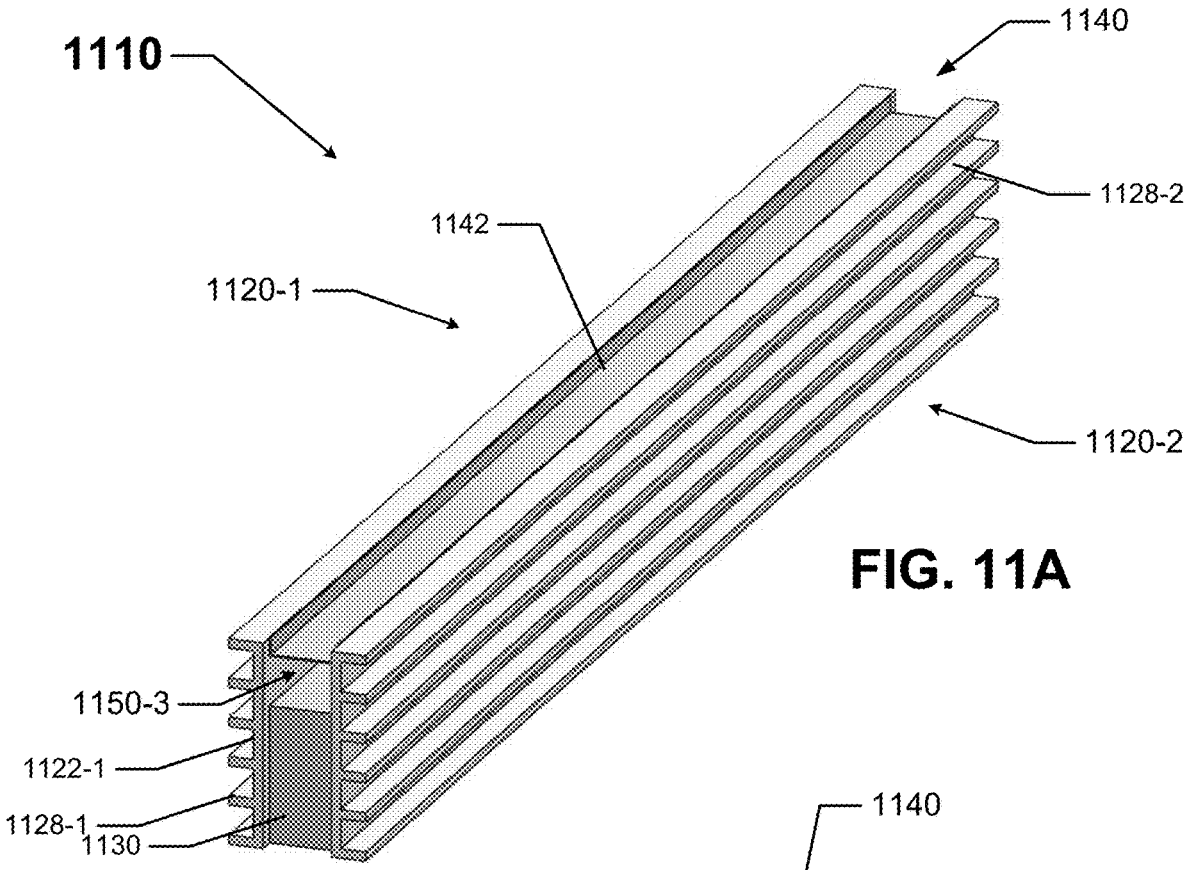
FIGS. 11A and 11B show a cross-sectional perspective view and a cross-sectional front view, respectively, of a portion of yet another luminaire in accordance with certain example embodiments.
Figure 11B:
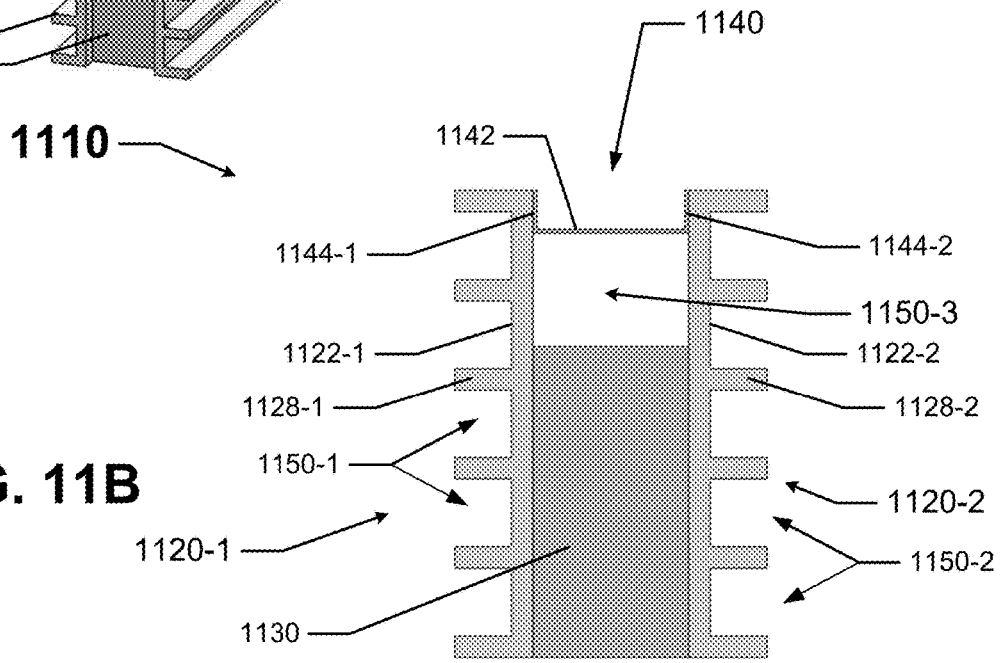

FIGS. 11A and 11B show a cross-sectional perspective view and a cross-sectional front view, respectively, of a portion of yet another luminaire 1110 in accordance with certain example embodiments. Referring to FIGS. 1 through 11B, the portion of the luminaire 1110 of FIGS. 11A and 11B has two acoustic features 1120. Specifically, acoustic feature 1120-1 is on one side (e.g., the left side) of the portion of the luminaire 1110, and acoustic feature 1120-2 is on the opposite side (e.g., the right side) of the portion of the luminaire 1110 relative to acoustic feature 1120-1.

Acoustic feature 1120-1 includes a side wall 1122-1 and a number (in this case, six) of horizontally-oriented outward-directed lateral extensions 1128-1 that are planar (not wedge-shaped) when viewed from the front. In this case, the lateral extensions 1128-1 are in parallel with each other and perpendicular with the side wall 1122-1. Each lateral extension 1128-1 in this case is of uniform length. The width of the side wall 1122-1 and each extension 1128-1 is substantially uniform along their lengths. In certain example embodiments, the space formed between adjacent extensions 1128-1 and the side wall 1122-1 can be considered an open-ended air chamber 1150-1.

Acoustic feature 1120-2 in this case is a mirror image of acoustic feature 1120-1 relative to a vertical axis through the portion of the luminaire 1110. Specifically, acoustic feature 1120-2 includes a side wall 1122-2 and a number (in this case, six) of horizontally-oriented outward-directed lateral extensions 1128-2 that are planar (not wedge-shaped) when viewed from the front. In this case, the lateral extensions 1128-2 are in parallel with each other and perpendicular with the side wall 1122-2. Each lateral extension 1128-2 in this case is of uniform length. The width of the side wall 1122-2 and each extension 1128-2 is substantially uniform along their lengths. In certain example embodiments, the space formed between adjacent extensions 1128-2 and the side wall 1122-2 can be considered an open-ended air chamber 1150-2.

An extension 1128 can have any shape and/or size. An extension 1128 can be continuous along the length of the luminaire 1110 (or portion thereof). In this case, the extension 1128 is continuous along the length of the corresponding side wall 1122. Any sound waves that pass through acoustic feature 1120-1 or acoustic feature 1120-2 can be further attenuated or eliminated using the extensions 1128. In other words, the extensions 1128 can trap and/or attenuate additional sound, and the multiple air chambers 1150-1 and 1150-2 formed by the extensions 1128 can greatly reduce or eliminate sound waves from escaping the air chamber once they are attenuated. The extensions 1128 can also reduce or eliminate destructive interference, increase sound diffusion, and provide better sound reduction quality without distortion or deadening.

Even though side wall 1122-1 and side wall 1122-2 are planar and parallel to each other, side wall 1122-1 and side wall 1122-2, when combined with the various extensions 1128-1 and 1128-2, can help diffuse sound, limit destructive interference, and mitigate distortion of that sound. In addition to the configuration (e.g., number, shape, size) of each extension 1128, the material of acoustic feature 1120-1 and acoustic feature 1120-2 can also help to provide acoustic control. Acoustic feature 1120-1 and acoustic feature 1120-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1120-1 can be the same as, or different than, the one or more materials of acoustic feature 1120-2. Similarly, the configuration of acoustic feature 1120-1 can be the same as, or different than, the configuration of acoustic feature 1120-2.

The portion of the luminaire 1110 of FIGS. 11A and 11B also includes a light engine tray 1140, which includes mounting surface 1142, side wall 1144-1 disposed at one end (e.g., the left end) of the mounting surface 1142, and side wall 1144-2 disposed at the opposite end (e.g., the right end) of the mounting surface 1142. Side wall 1144-1 and side wall 1144-2 are substantially parallel to each other and are substantially perpendicular to the mounting surface 1142. In this case, side wall 1144-1 is coupled to the inner surface of the side wall 1122-1 of acoustic feature 1120-1, and side wall 1144-2 is coupled to the inner surface of the side wall 1122-2 of acoustic feature 1120-2. The light engine tray 1140 can be substantially similar to the light engine trays discussed above with respect to its form, purpose, and function.

The portion of the luminaire 1110 of FIGS. 11A and 11B also includes a power source housing 1130. The power source housing 1130 of the luminaire 1110 of FIGS. 11A and 11B can be substantially similar to the power source housings discussed above. In this case, there is an air chamber 1150-3 (also called an air gap 1150-3) between the power source housing 1130, the mounting surface 1142 of the light engine tray 1140, the inner surface of side wall 1122-1, and the inner surface of side wall 1122-2.

In this case, when viewed from the front, the air chamber 1150-3 has a rectangular cross-sectional shape. The air chamber 1150-3 can be formed by extending the length of the side walls 1122 and/or by reducing the height of the power source housing 1130 relative to the corresponding components of luminaires currently used in the art, such as the luminaire 199 of FIG. 1 and the luminaire 298 of FIG. 2. Similarly, each air chamber 1150-1 and each air chamber 1150-2 can be formed by changing one or more characteristics of the extensions 1128, the number of extensions 1128, the spacing between adjacent extensions 1128, and/or any of a number of other factors. In certain example embodiments, air chambers 1150-1, air chambers 1150-2, and air chamber 1150-3 can each be considered a type of acoustic feature (as with acoustic features 1120-1 and acoustic feature 1120-2).

A portion of air chambers 1150-1, 1150-2, and/or 1150-3 can be filled with no material. Alternatively, some or all of a portion of air chambers 1150-1, 1150-2, and/or 1150-3 can be filled with one or more of a number of materials (e.g., fiberglass) that can help the portion of air chambers 1150-1, 1150-2, and/or 1150-3 perform one or more acoustic functions, including but not limited to attenuating sound, diffusing sound, limiting destructive interference, and mitigating distortion of sound.

Figure 12A:
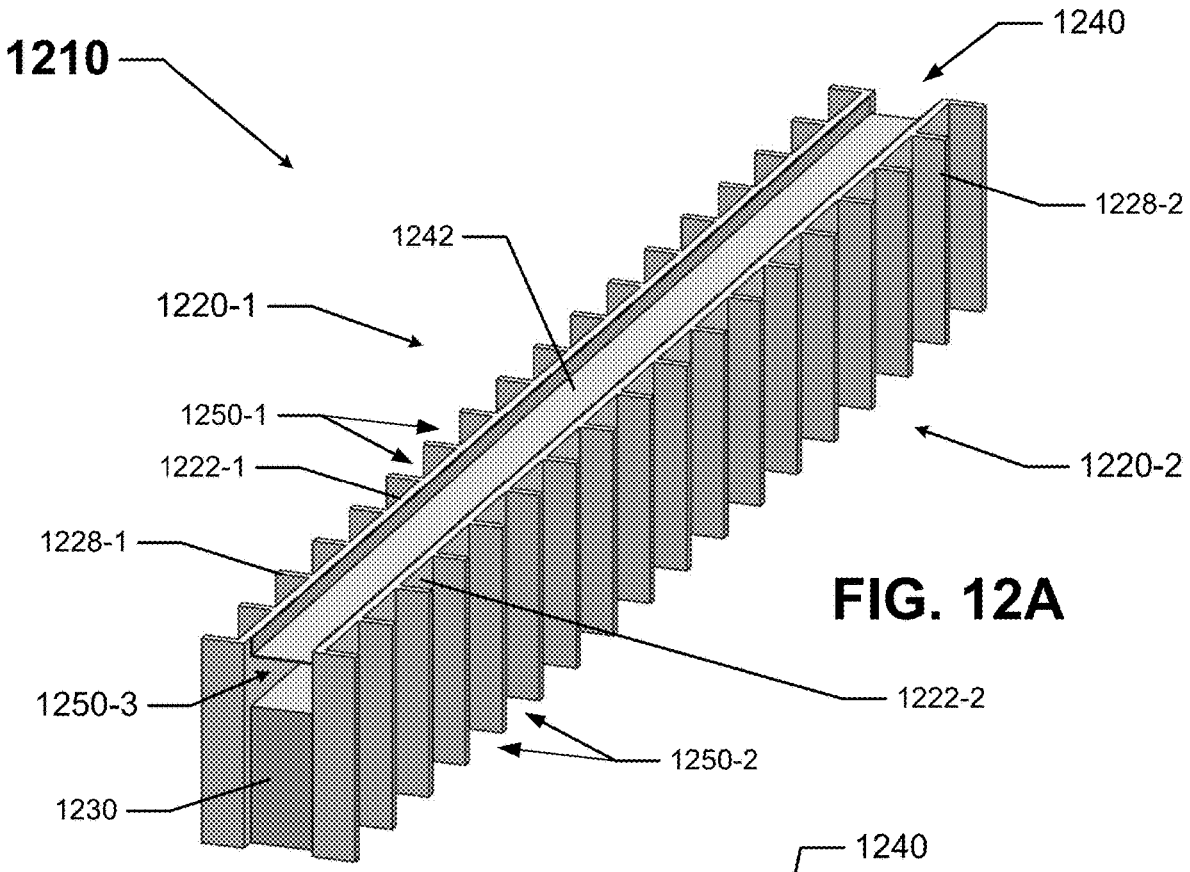
FIGS. 12A and 12B show a cross-sectional perspective view and a cross-sectional front view, respectively, of a portion of still another luminaire in accordance with certain example embodiments.
Figure 12B:
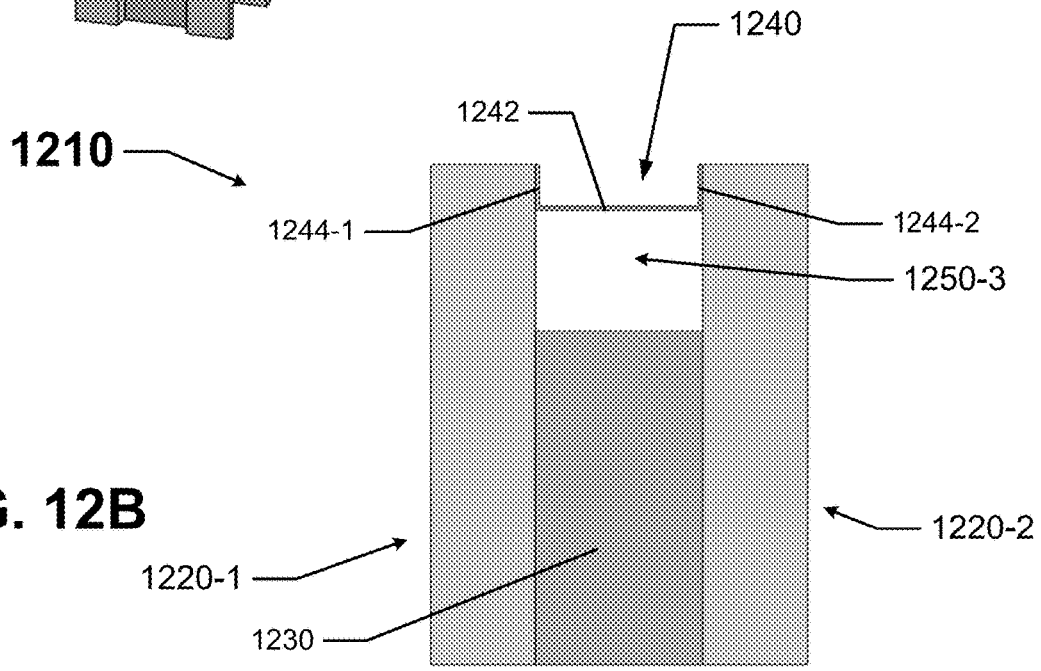

FIGS. 12A and 12B show a cross-sectional perspective view and a cross-sectional front view, respectively, of a portion of still another luminaire 1210 in accordance with certain example embodiments. Referring to FIGS. 1 through 12B, the portion of the luminaire 1210 of FIGS. 12A and 12B has two acoustic features 1220. Specifically, acoustic feature 1220-1 is on one side (e.g., the left side) of the portion of the luminaire 1210, and acoustic feature 1220-2 is on the opposite side (e.g., the right side) of the portion of the luminaire 1210 relative to acoustic feature 1220-1.

Acoustic feature 1220-1 includes a side wall 1222-1 and a number (in this case, 18) of vertically-oriented outward-directed lateral extensions 1228-1 that are planar (not wedge-shaped) when viewed from the front. In this case, the lateral extensions 1228-1 are in parallel with each other and perpendicular with the side wall 1222-1. Each lateral extension 1228-1 in this case is of uniform length. The width of the side wall 1222-1 and each extension 1228-1 is substantially uniform along their lengths. In certain example embodiments, the space formed between adjacent extensions 1228-1 and the side wall 1222-1 can be considered an open-ended air chamber 1250-1.

Acoustic feature 1220-2 in this case is a mirror image of acoustic feature 1220-1 relative to a vertical axis through the portion of the luminaire 1210. Specifically, acoustic feature 1220-2 includes a side wall 1222-2 and a number (in this case, 18) of vertically-oriented outward-directed lateral extensions 1228-2 that are planar (not wedge-shaped) when viewed from the front. In this case, the lateral extensions 1228-2 are in parallel with each other and perpendicular with the side wall 1222-2. Each lateral extension 1228-2 in this case is of uniform length. The width of the side wall 1222-2 and each extension 1228-2 is substantially uniform along their lengths. In certain example embodiments, the space formed between adjacent extensions 1228-2 and the side wall 1222-2 can be considered an open-ended air chamber 1250-2.

An extension 1228 can have any shape and/or size. An extension 1228 can be continuous along the height of the luminaire 1210 (or portion thereof). In this case, the extension 1228 is continuous along the height of the corresponding side wall 1222. Any sound waves that pass through acoustic feature 1220-1 or acoustic feature 1220-2 can be further attenuated or eliminated using the extensions 1228. In other words, the extensions 1228 can trap and/or attenuate additional sound, and the multiple air chambers 1250-1 and 1250-2 formed by the extensions 1228 can greatly reduce or eliminate sound waves from escaping the air chamber once they are attenuated. The extensions 1228 can also reduce or eliminate destructive interference, increase sound diffusion, and provide better sound reduction quality without distortion or deadening.

Even though side wall 1222-1 and side wall 1222-2 are planar and parallel to each other, side wall 1222-1 and side wall 1222-2, when combined with the various extensions 1228-1 and 1228-2, can help diffuse sound, limit destructive interference, and mitigate distortion of that sound. In addition to the configuration (e.g., number, shape, size) of each extension 1228, the material of acoustic feature 1220-1 and acoustic feature 1220-2 can also help to provide acoustic control. Acoustic feature 1220-1 and acoustic feature 1220-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1220-1 can be the same as, or different than, the one or more materials of acoustic feature 1220-2. Similarly, the configuration of acoustic feature 1220-1 can be the same as, or different than, the configuration of acoustic feature 1220-2.

The portion of the luminaire 1210 of FIGS. 12A and 12B also includes a light engine tray 1240, which includes mounting surface 1242, side wall 1244-1 disposed at one end (e.g., the left end) of the mounting surface 1242, and side wall 1244-2 disposed at the opposite end (e.g., the right end) of the mounting surface 1242. Side wall 1244-1 and side wall 1244-2 are substantially parallel to each other and are substantially perpendicular to the mounting surface 1242. In this case, side wall 1244-1 is coupled to the inner surface of the side wall 1222-1 of acoustic feature 1220-1, and side wall 1244-2 is coupled to the inner surface of the side wall 1222-2 of acoustic feature 1220-2. The light engine tray 1240 can be substantially similar to the light engine trays discussed above with respect to its form, purpose, and function.

The portion of the luminaire 1210 of FIGS. 12A and 12B also includes a power source housing 1230. The power source housing 1230 of the luminaire 1210 of FIGS. 12A and 12B can be substantially similar to the power source housings discussed above. In this case, there is an air chamber 1250-3 (also called an air gap 1250-3) between the power source housing 1230, the mounting surface 1242 of the light engine tray 1240, the inner surface of side wall 1222-1, and the inner surface of side wall 1222-2.

In this case, when viewed from the front, the air chamber 1250-3 has a rectangular cross-sectional shape. The air chamber 1250-3 can be formed by extending the length of the side walls 1222 and/or by reducing the height of the power source housing 1230 relative to the corresponding components of luminaires currently used in the art, such as the luminaire 199 of FIG. 1 and the luminaire 298 of FIG. 2. Similarly, each air chamber 1250-1 and each air chamber 1250-2 can be formed by changing one or more characteristics of the extensions 1228, the number of extensions 1228, the spacing between adjacent extensions 1228, and/or any of a number of other factors. In certain example embodiments, air chambers 1250-1, air chambers 1250-2, and air chamber 1250-3 can each be considered a type of acoustic feature (as with acoustic features 1220-1 and acoustic feature 1220-2).

A portion of air chambers 1250-1, 1250-2, and/or 1250-3 can be filled with no material. Alternatively, some or all of a portion of air chambers 1250-1, 1250-2, and/or 1250-3 can be filled with one or more of a number of materials (e.g., fiberglass) that can help the portion of air chambers 1250-1, 1250-2, and/or 1250-3 perform one or more acoustic functions, including but not limited to attenuating sound, diffusing sound, limiting destructive interference, and mitigating distortion of sound.

Figure 13A:
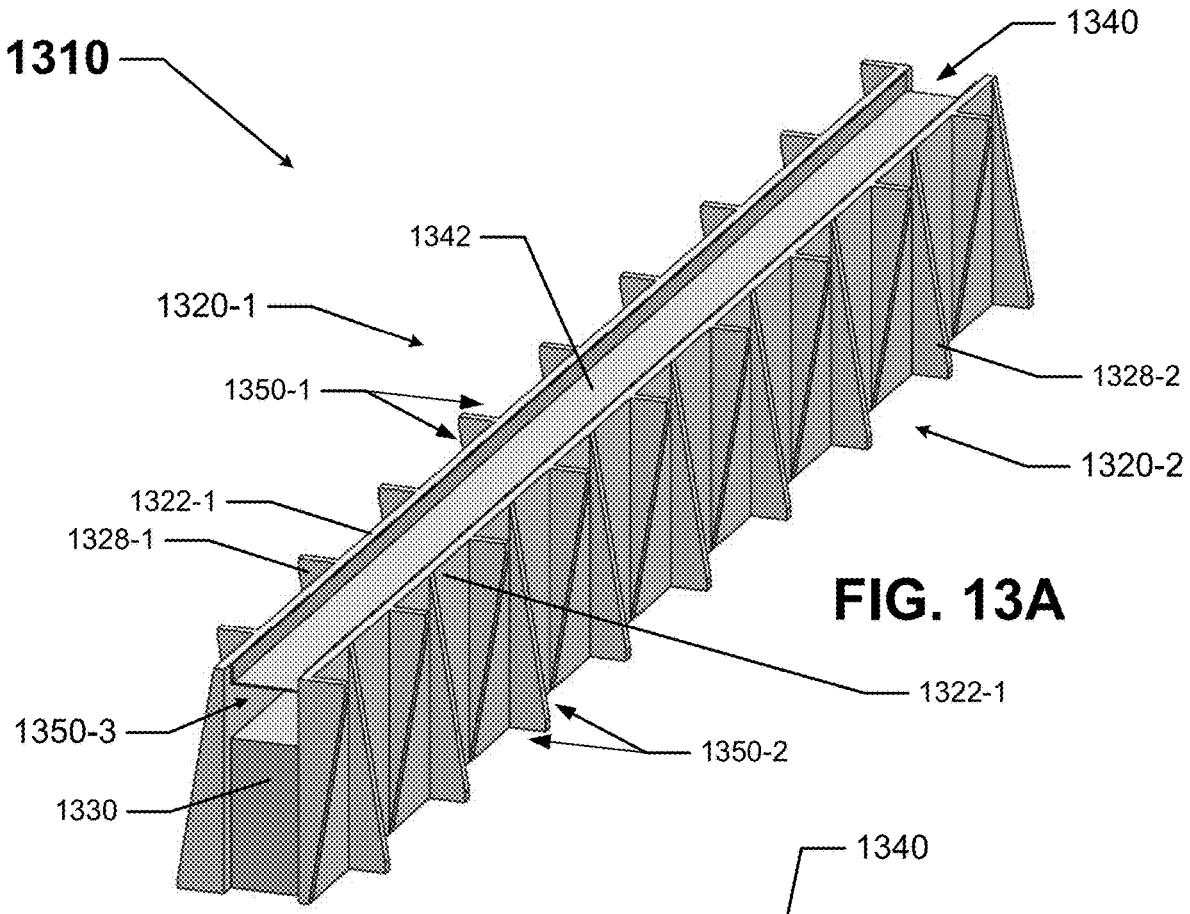
FIGS. 13A and 13B show a cross-sectional perspective view and a cross-sectional front view, respectively, of a portion of yet another luminaire in accordance with certain example embodiments.
Figure 13B:
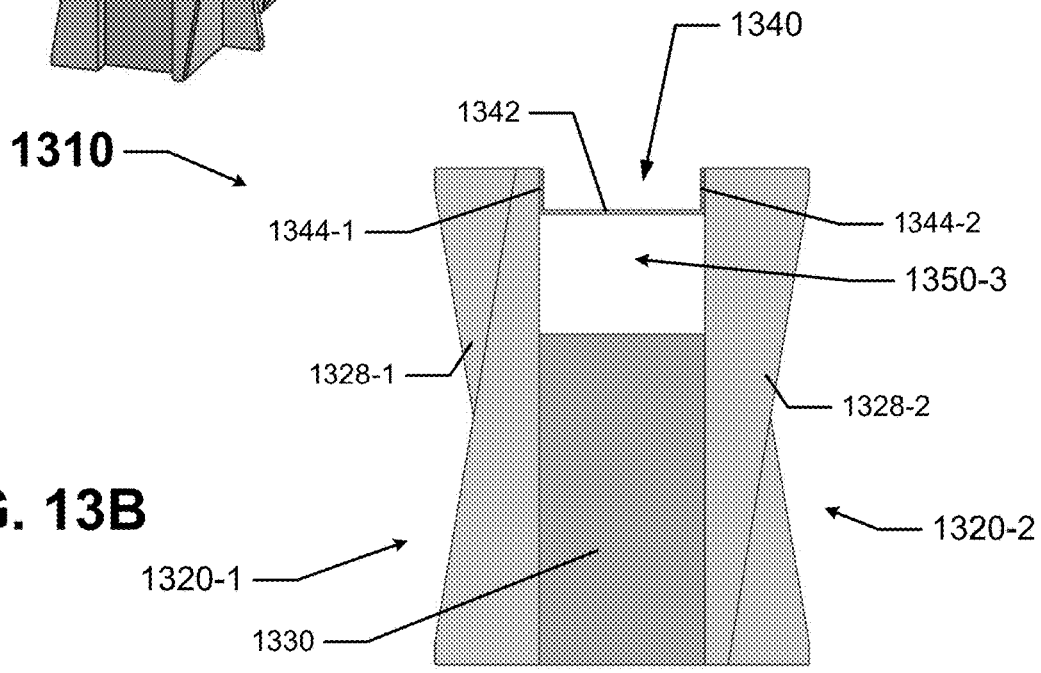

FIGS. 13A and 13B show a cross-sectional perspective view and a cross-sectional front view, respectively, of a portion of yet another luminaire 1310 in accordance with certain example embodiments. Referring to FIGS. 1 through 13B, the portion of the luminaire 1310 of FIGS. 13A and 13B has two acoustic features 1320. Specifically, acoustic feature 1320-1 is on one side (e.g., the left side) of the portion of the luminaire 1310, and acoustic feature 1320-2 is on the opposite side (e.g., the right side) of the portion of the luminaire 1310 relative to acoustic feature 1320-1.

Acoustic feature 1320-1 includes a side wall 1322-1 and a number (in this case, 18) of vertically-oriented outward-directed lateral extensions 1328-1 that are planar (not wedge-shaped) when viewed from the front. In this case, the lateral extensions 1328-1 are in parallel with each other and perpendicular with the side wall 1322-1. Each lateral extension 1328-1 in this case is of uniform length and is shaped as a right triangle. For each extension 1328-1, the long leg of the right triangle abuts against the side wall 1322-1, but each extension 1328-1 is inverted relative to each adjacent extension 1328-1. The width of the side wall 1322-1 and each extension 1328-1 is substantially uniform along their lengths. In certain example embodiments, the space formed between adjacent extensions 1328-1 and the side wall 1322-1 can be considered an open-ended air chamber 1350-1.

Acoustic feature 1320-2 in this case is a mirror image of acoustic feature 1320-1 relative to a vertical axis through the portion of the luminaire 1310. Specifically, acoustic feature 1320-2 includes a side wall 1322-2 and a number (in this case, 18) of vertically-oriented outward-directed lateral extensions 1328-2 that are planar (not wedge-shaped) when viewed from the front. In this case, the lateral extensions 1328-2 are in parallel with each other and perpendicular with the side wall 1322-2. Each lateral extension 1328-2 in this case is of uniform length and is shaped as a right triangle. For each extension 1328-2, the long leg of the right triangle abuts against the side wall 1322-2, but each extension 1328-2 is inverted relative to each adjacent extension 1328-2. The width of the side wall 1322-2 and each extension 1328-2 is substantially uniform along their lengths. In certain example embodiments, the space formed between adjacent extensions 1328-2 and the side wall 1322-2 can be considered an open-ended air chamber 1350-2.

An extension 1328 can have any shape (in this case, a right triangle when viewed from above) and/or size. An extension 1328 can be continuous along the height of the luminaire 1310 (or portion thereof). In this case, the extension 1328 is continuous along the height of the corresponding side wall 1322. Any sound waves that pass through acoustic feature 1320-1 or acoustic feature 1320-2 can be further attenuated or eliminated using the extensions 1328. In other words, the extensions 1328 can trap and/or attenuate additional sound, and the multiple air chambers 1350-1 and 1350-2 formed by the extensions 1328 can greatly reduce or eliminate sound waves from escaping the air chamber once they are attenuated. The extensions 1328 can also reduce or eliminate destructive interference, increase sound diffusion, and provide better sound reduction quality without distortion or deadening.

Even though side wall 1322-1 and side wall 1322-2 are planar and parallel to each other, side wall 1322-1 and side wall 1322-2, when combined with the various extensions 1328-1 and 1328-2, can help diffuse sound, limit destructive interference, and mitigate distortion of that sound. In addition to the configuration (e.g., number, shape, size) of each extension 1328, the material of acoustic feature 1320-1 and acoustic feature 1320-2 can also help to provide acoustic control. Acoustic feature 1320-1 and acoustic feature 1320-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1320-1 can be the same as, or different than, the one or more materials of acoustic feature 1320-2. Similarly, the configuration of acoustic feature 1320-1 can be the same as, or different than, the configuration of acoustic feature 1320-2.

The portion of the luminaire 1310 of FIGS. 13A and 13B also includes a light engine tray 1340, which includes mounting surface 1342, side wall 1344-1 disposed at one end (e.g., the left end) of the mounting surface 1342, and side wall 1344-2 disposed at the opposite end (e.g., the right end) of the mounting surface 1342. Side wall 1344-1 and side wall 1344-2 are substantially parallel to each other and are substantially perpendicular to the mounting surface 1342. In this case, side wall 1344-1 is coupled to the inner surface of the side wall 1322-1 of acoustic feature 1320-1, and side wall 1344-2 is coupled to the inner surface of the side wall 1322-2 of acoustic feature 1320-2. The light engine tray 1340 can be substantially similar to the light engine trays discussed above with respect to its form, purpose, and function.

The portion of the luminaire 1310 of FIGS. 13A and 13B also includes a power source housing 1330. The power source housing 1330 of the luminaire 1310 of FIGS. 13A and 13B can be substantially similar to the power source housings discussed above. In this case, there is an air chamber 1350-3 (also called an air gap 1350-3) between the power source housing 1330, the mounting surface 1342 of the light engine tray 1340, the inner surface of side wall 1322-1, and the inner surface of side wall 1322-2.

In this case, when viewed from the front, the air chamber 1350-3 has a rectangular cross-sectional shape. The air chamber 1350-3 can be formed by extending the length of the side walls 1322 and/or by reducing the height of the power source housing 1330 relative to the corresponding components of luminaires currently used in the art, such as the luminaire 199 of FIG. 1 and the luminaire 298 of FIG. 2. Similarly, each air chamber 1350-1 and each air chamber 1350-2 can be formed by changing one or more characteristics of the extensions 1328, the number of extensions 1328, the spacing between adjacent extensions 1328, and/or any of a number of other factors. In certain example embodiments, air chambers 1350-1, air chambers 1350-2, and air chamber 1350-3 can each be considered a type of acoustic feature (as with acoustic features 1320-1 and acoustic feature 1320-2).

A portion of air chambers 1350-1, 1350-2, and/or 1350-3 can be filled with no material. Alternatively, some or all of a portion of air chambers 1350-1, 1350-2, and/or 1350-3 can be filled with one or more of a number of materials (e.g., fiberglass) that can help the portion of air chambers 1350-1, 1350-2, and/or 1350-3 perform one or more acoustic functions, including but not limited to attenuating sound, diffusing sound, limiting destructive interference, and mitigating distortion of sound.

Figure 14A:
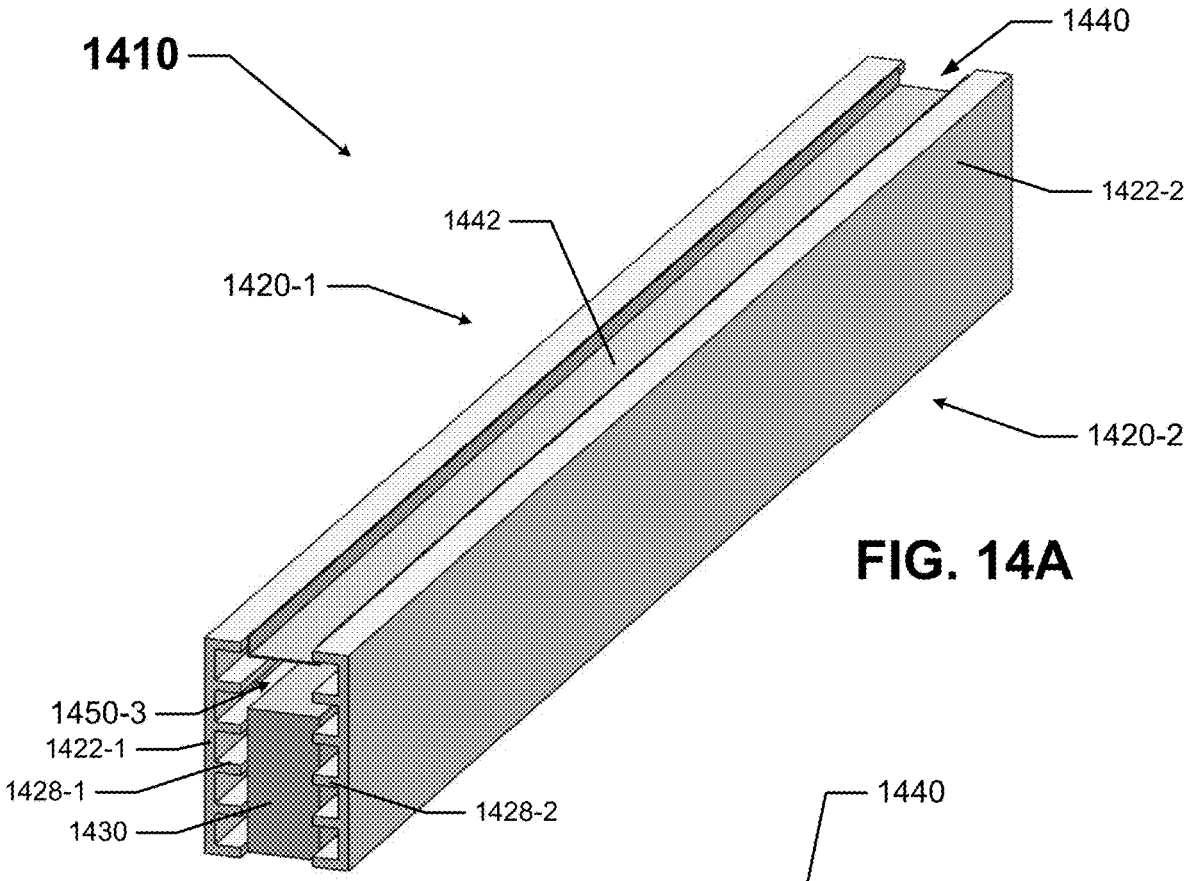
FIGS. 14A and 14B show a cross-sectional perspective view and a cross-sectional front view, respectively, of a portion of still another luminaire in accordance with certain example embodiments.
Figure 14B:
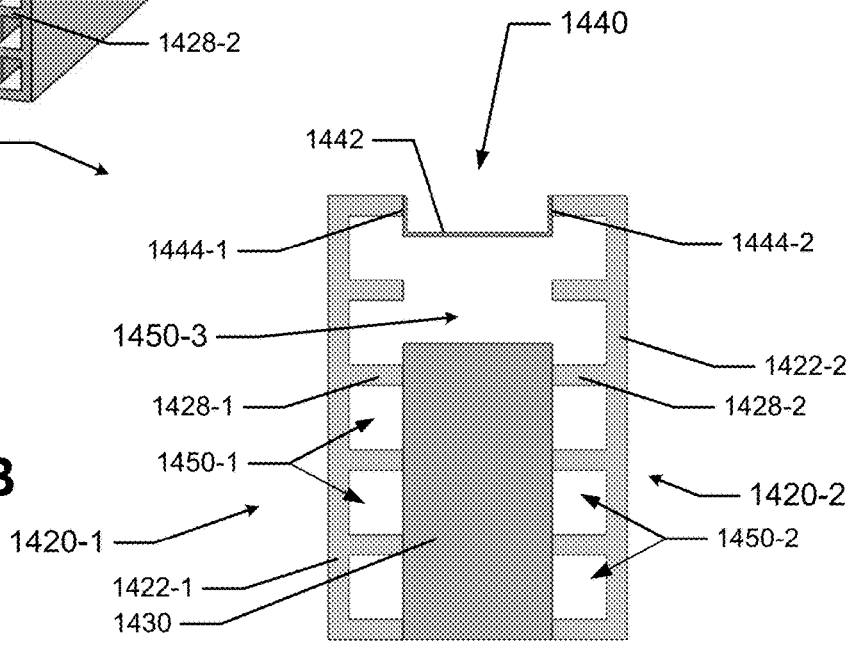

FIGS. 14A and 14B show a cross-sectional perspective view and a cross-sectional front view, respectively, of a portion of still another luminaire 1410 in accordance with certain example embodiments. Referring to FIGS. 1 through 14B, the portion of the luminaire 1410 of FIGS. 14A and 14B has two acoustic features 1420. Specifically, acoustic feature 1420-1 is on one side (e.g., the left side) of the portion of the luminaire 1410, and acoustic feature 1420-2 is on the opposite side (e.g., the right side) of the portion of the luminaire 1410 relative to acoustic feature 1420-1.

Acoustic feature 1420-1 includes a side wall 1422-1 and a number (in this case, six) of horizontally-oriented inward-directed lateral extensions 1428-1 that are planar (not wedge-shaped) when viewed from the front. In this case, the lateral extensions 1428-1 are in parallel with each other and perpendicular with the side wall 1422-1. Each lateral extension 1428-1 in this case is of uniform length. The width of the side wall 1422-1 and each extension 1428-1 is substantially uniform along their lengths. In certain example embodiments, the space formed between at least some of the adjacent extensions 1428-1 (specifically in this case, the extensions 1428-1 toward the bottom) and the side wall 1422-1 can be considered an open-ended air chamber 1450-1.

Acoustic feature 1420-2 in this case is a mirror image of acoustic feature 1420-1 relative to a vertical axis through the portion of the luminaire 1410. Specifically, acoustic feature 1420-2 includes a side wall 1422-2 and a number (in this case, six) of horizontally-oriented inward-directed lateral extensions 1428-2 that are planar (not wedge-shaped) when viewed from the front. In this case, the lateral extensions 1428-2 are in parallel with each other and perpendicular with the side wall 1422-2. Each lateral extension 1428-2 in this case is of uniform length. The width of the side wall 1422-2 and each extension 1428-2 is substantially uniform along their lengths. In certain example embodiments, the space formed between at least some of the adjacent extensions 1428-2 (specifically in this case, the extensions 1428-2 toward the bottom) and the side wall 1422-2 can be considered an open-ended air chamber 1450-2.

An extension 1428 can have any shape (in this case, rectangular when viewed from above) and/or size. An extension 1428 can be continuous along the length of the luminaire 1410 (or portion thereof). In this case, the extension 1428 is continuous along the length of the corresponding side wall 1422. Any sound waves that pass through acoustic feature 1420-1 or acoustic feature 1420-2 can be further attenuated or eliminated using the extensions 1428. In other words, the extensions 1428 can trap and/or attenuate additional sound, and the multiple air chambers 1450-1 and 1450-2 formed by the extensions 1428 can greatly reduce or eliminate sound waves from escaping the air chamber once they are attenuated.

Even though side wall 1422-1 and side wall 1422-2 are planar and parallel to each other, side wall 1422-1 and side wall 1422-2, when combined with the various extensions 1428-1 and 1428-2, can help diffuse sound, limit destructive interference, and mitigate distortion of that sound. In addition to the configuration (e.g., number, shape, size) of each extension 1428, the material of acoustic feature 1420-1 and acoustic feature 1420-2 can also help to provide acoustic control. Acoustic feature 1420-1 and acoustic feature 1420-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1420-1 can be the same as, or different than, the one or more materials of acoustic feature 1420-2. Similarly, the configuration of acoustic feature 1420-1 can be the same as, or different than, the configuration of acoustic feature 1420-2.

The portion of the luminaire 1410 of FIGS. 14A and 14B also includes a light engine tray 1440, which includes mounting surface 1442, side wall 1444-1 disposed at one end (e.g., the left end) of the mounting surface 1442, and side wall 1444-2 disposed at the opposite end (e.g., the right end) of the mounting surface 1442. Side wall 1444-1 and side wall 1444-2 are substantially parallel to each other and are substantially perpendicular to the mounting surface 1442. In this case, side wall 1444-1 is coupled to the top-most extension 1428-1 of acoustic feature 1420-1, and side wall 1444-2 is coupled to the top-most extension 1428-2 of acoustic feature 1420-2. The light engine tray 1440 can be substantially similar to the light engine trays discussed above with respect to its form, purpose, and function.

The portion of the luminaire 1410 of FIGS. 14A and 14B also includes a power source housing 1430. The power source housing 1430 of the luminaire 1410 of FIGS. 14A and 14B can be substantially similar to the power source housings discussed above. In this case, there is an air chamber 1450-3 (also called an air gap 1450-3) between the power source housing 1430, the mounting surface 1442 of the light engine tray 1440, the upper three-most extensions 1428-1, the inner surface of side wall 1422-1, the upper three-most extensions 1428-2, and the inner surface of side wall 1422-2.

The air chamber 1450-3 can be formed by extending the length of the side walls 1422 and/or by reducing the height of the power source housing 1430 relative to the corresponding components of luminaires currently used in the art, such as the luminaire 199 of FIG. 1 and the luminaire 298 of FIG. 2. Similarly, each air chamber 1450-1 and each air chamber 1450-2 can be formed by changing one or more characteristics of the extensions 1428, the number of extensions 1428, the spacing between adjacent extensions 1428, and/or any of a number of other factors. In certain example embodiments, air chambers 1450-1, air chambers 1450-2, and air chamber 1450-3 can each be considered a type of acoustic feature (as with acoustic features 1420-1 and acoustic feature 1420-2). The multiple closed air chambers 1450 prevent attenuated waves from escaping.

A portion of air chambers 1450-1, 1450-2, and/or 1450-3 can be filled with no material. Alternatively, some or all of a portion of air chambers 1450-1, 1450-2, and/or 1450-3 can be filled with one or more of a number of materials (e.g., fiberglass) that can help the portion of air chambers 1450-1, 1450-2, and/or 1450-3 perform one or more acoustic functions, including but not limited to attenuating sound, diffusing sound, limiting destructive interference, and mitigating distortion of sound.

Figure 15A:
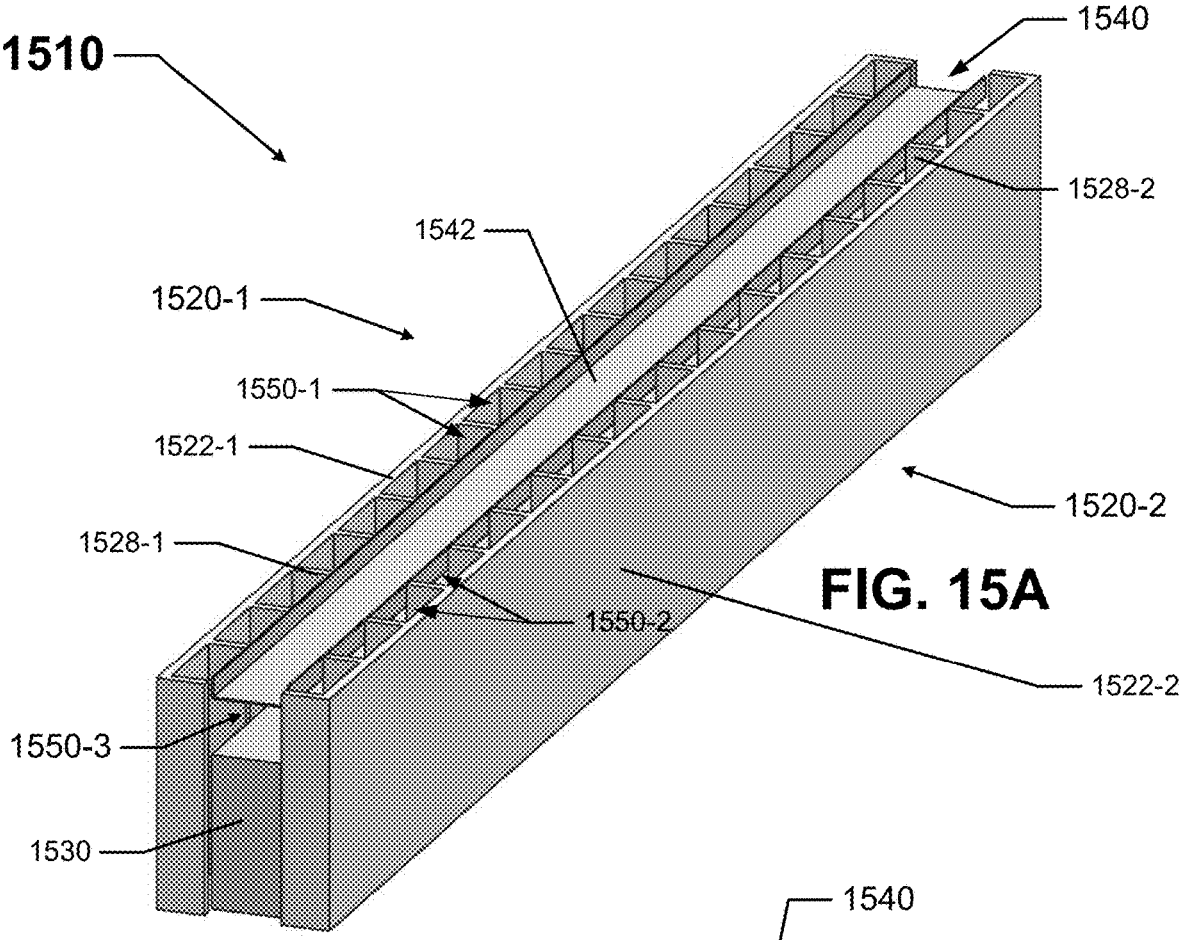
FIGS. 15A and 15B show a cross-sectional perspective view and a cross-sectional front view, respectively, of a portion of yet another luminaire in accordance with certain example embodiments.
Figure 15B:
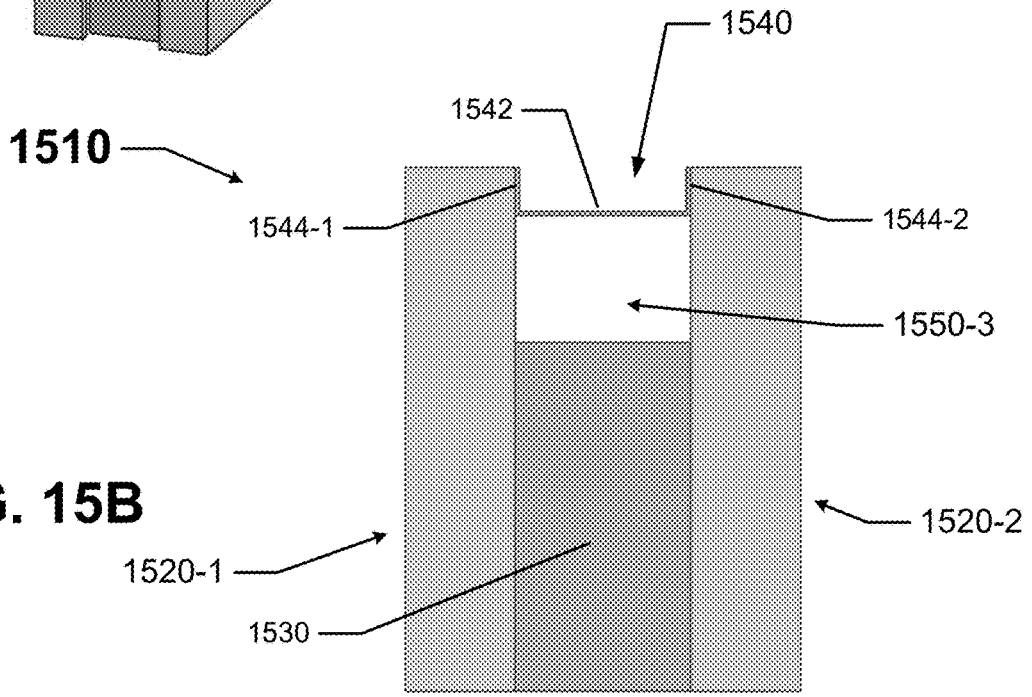

FIGS. 15A and 15B show a cross-sectional perspective view and a cross-sectional front view, respectively, of a portion of yet another luminaire 1501 in accordance with certain example embodiments. Referring to FIGS. 1 through 15B, the portion of the luminaire 1510 of FIGS. 15A and 15B has two acoustic features 1520. Specifically, acoustic feature 1520-1 is on one side (e.g., the left side) of the portion of the luminaire 1510, and acoustic feature 1520-2 is on the opposite side (e.g., the right side) of the portion of the luminaire 1510 relative to acoustic feature 1520-1.

Acoustic feature 1520-1 includes a side wall 1522-1 and a number (in this case, 18) of vertically-oriented inward-directed lateral extensions 1528-1 that are planar (not wedge-shaped) when viewed from the front. In this case, the lateral extensions 1528-1 are in parallel with each other and perpendicular with the side wall 1522-1. Each lateral extension 1528-1 in this case is of uniform length. The width of the side wall 1522-1 and each extension 1528-1 is substantially uniform along their lengths. In certain example embodiments, the space formed between the adjacent extensions 1528-1 and the side wall 1522-1 can be considered an open-ended air chamber 1550-1.

Acoustic feature 1520-2 in this case is a mirror image of acoustic feature 1520-1 relative to a vertical axis through the portion of the luminaire 1510. Specifically, acoustic feature 1520-2 includes a side wall 1522-2 and a number (in this case, 18) of vertically-oriented inward-directed lateral extensions 1528-2 that are planar (not wedge-shaped) when viewed from the front. In this case, the lateral extensions

1528-2 are in parallel with each other and perpendicular with the side wall 1522-2. Each lateral extension 1528-2 in this case is of uniform length. The width of the side wall 1522-2 and each extension 1528-2 is substantially uniform along their lengths. In certain example embodiments, the space formed between the adjacent extensions 1528-2 and the side wall 1522-2 can be considered an open-ended air chamber 1550-2.

An extension 1528 can have any shape (in this case, rectangular when viewed from the front) and/or size. An extension 1528 can be continuous along the height of the luminaire 1510 (or portion thereof). In this case, the extension 1528 is continuous along the height of the corresponding side wall 1522. Any sound waves that pass through acoustic feature 1520-1 or acoustic feature 1520-2 can be further attenuated or eliminated using the extensions 1528. In other words, the extensions 1528 can trap and/or attenuate additional sound, and the multiple air chambers 1550-1 and 1550-2 formed by the extensions 1528 can greatly reduce or eliminate sound waves from escaping the air chamber once they are attenuated.

Even though side wall 1522-1 and side wall 1522-2 are planar and parallel to each other, side wall 1522-1 and side wall 1522-2, when combined with the various extensions 1528-1 and 1528-2, can help diffuse sound, limit destructive interference, and mitigate distortion of that sound. In addition to the configuration (e.g., number, shape, size) of each extension 1528, the material of acoustic feature 1520-1 and acoustic feature 1520-2 can also help to provide acoustic control. Acoustic feature 1520-1 and acoustic feature 1520-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1520-1 can be the same as, or different than, the one or more materials of acoustic feature 1520-2. Similarly, the configuration of acoustic feature 1520-1 can be the same as, or different than, the configuration of acoustic feature 1520-2.

The portion of the luminaire 1510 of FIGS. 15A and 15B also includes a light engine tray 1540, which includes mounting surface 1542, side wall 1544-1 disposed at one end (e.g., the left end) of the mounting surface 1542, and side wall 1544-2 disposed at the opposite end (e.g., the right end) of the mounting surface 1542. Side wall 1544-1 and side wall 1544-2 are substantially parallel to each other and are substantially perpendicular to the mounting surface 1542. In this case, side wall 1544-1 is coupled to the top-most parts of the inner surface of the extensions 1528-1 of acoustic feature 1520-1, and side wall 1544-2 is coupled to the top-most parts of the inner surface of the extensions 1528-2 of acoustic feature 1520-2. The light engine tray 1540 can be substantially similar to the light engine trays discussed above with respect to its form, purpose, and function.

The portion of the luminaire 1510 of FIGS. 15A and 15B also includes a power source housing 1530. The power source housing 1530 of the luminaire 1510 of FIGS. 15A and 15B can be substantially similar to the power source housings discussed above. In this case, there is an air chamber 1550-3 (also called an air gap 1550-3) between the power source housing 1530, the mounting surface 1542 of the light engine tray 1540, portions of the extensions 1528-1, the inner surface of side wall 1522-1, portions of the extensions 1528-2, and the inner surface of side wall 1522-2.

The air chamber 1550-3 can be formed by extending the length of the side walls 1522 and/or by reducing the height of the power source housing 1530 relative to the corresponding components of luminaires currently used in the art, such as the luminaire 199 of FIG. 1 and the luminaire 298 of FIG. 2. Similarly, each air chamber 1550-1 and each air chamber 1550-2 can be formed by changing one or more characteristics of the extensions 1528, the number of extensions 1528, the spacing between adjacent extensions 1528, and/or any of a number of other factors. In this case, the air chambers 1550-1 and the air chambers 1550-2 overlap with air chamber 1550-3. In certain example embodiments, air chambers 1550-1, air chambers 1550-2, and air chamber 1550-3 can each be considered a type of acoustic feature (as with acoustic features 1520-1 and acoustic feature 1520-2). The multiple closed air chambers 1550 prevent attenuated waves from escaping.

A portion of air chambers 1550-1, 1550-2, and/or 1550-3 can be filled with no material. Alternatively, some or all of a portion of air chambers 1550-1, 1550-2, and/or 1550-3 can be filled with one or more of a number of materials (e.g., fiberglass) that can help the portion of air chambers 1550-1, 1550-2, and/or 1550-3 perform one or more acoustic functions, including but not limited to attenuating sound, diffusing sound, limiting destructive interference, and mitigating distortion of sound.

Figure 16A:
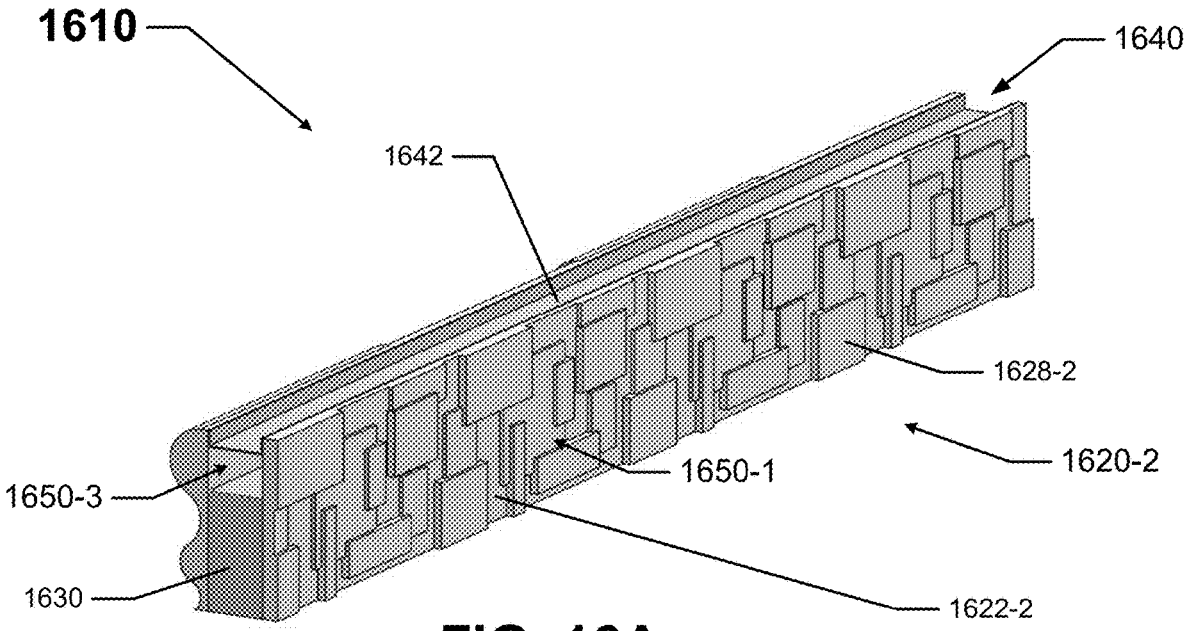
FIGS. 16A through 16C show various views of a portion of still another luminaire in accordance with certain example embodiments.
Figure 16B:
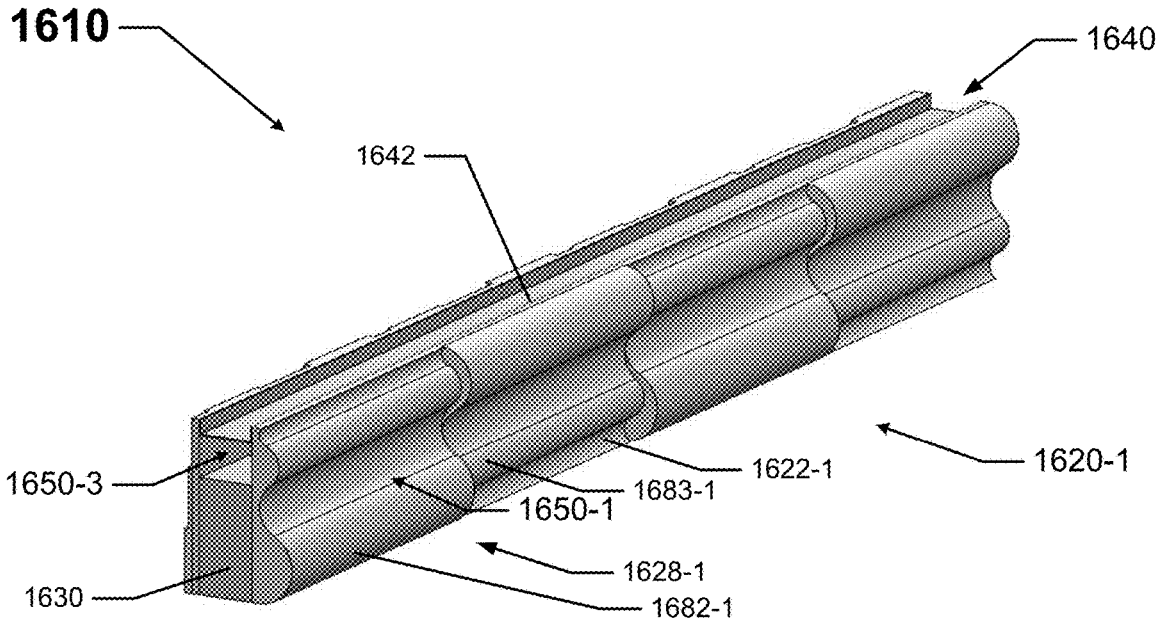
Figure 16C:
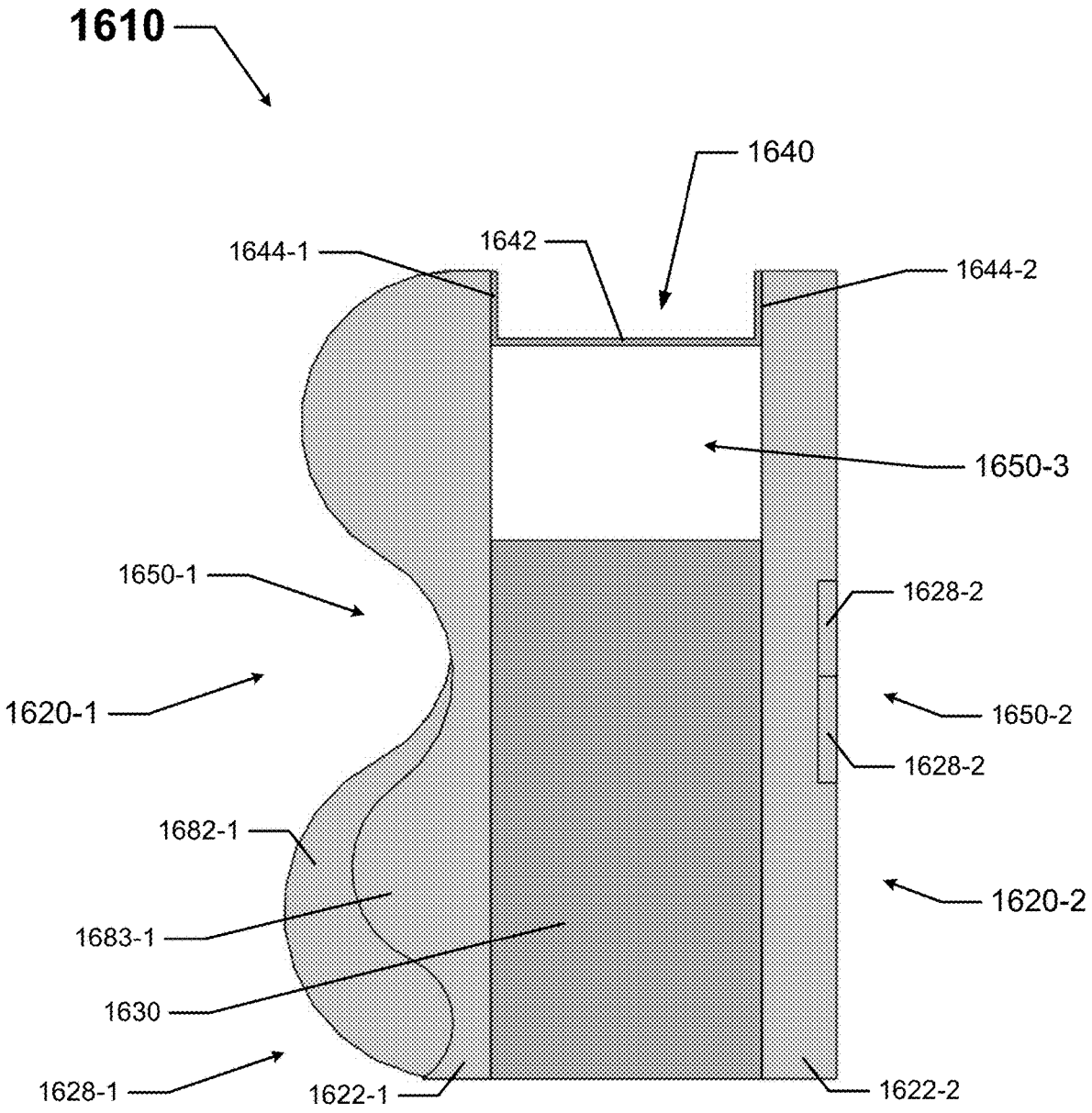

FIGS. 16A through 16C show various views of a portion of still another luminaire 1610 in accordance with certain example embodiments. Specifically, FIG. 16A shows a cross-sectional perspective view of the luminaire 1610. FIG. 16B shows a different cross-sectional perspective view of the luminaire 1610. FIG. 16C shows a cross-sectional front view of the luminaire 1610. Referring to FIGS. 1 through 16C, the portion of the luminaire 1610 of FIGS. 16A through 16C has two acoustic features 1620. Specifically, acoustic feature 1620-1 is on one side (e.g., the left side) of the portion of the luminaire 1610, and acoustic feature 1620-2 is on the opposite side (e.g., the right side) of the portion of the luminaire 1610 relative to acoustic feature 1620-1.

Acoustic feature 1620-1 includes a side wall 1622-1 and a number (in this case, four) extensions 1628-1 disposed on the side wall 1622-1, where each extension 1628-1 is a vertical piece that includes a small outward horizontally-oriented curved protrusion 1683-1 at one end (e.g., at the top end) and a relatively larger outward horizontally-oriented curved protrusion 1682-1 when viewed from the front. In this case, the extensions 1628-1 are placed side by side along the length of the side wall 1622-1, where on extension 1628-1 is inverted relative to each adjacent extension 1628-1. Each extension 1628-1 in this case is identically configured with respect to each other, with every other extension 1628-1 being inverted. The width of the side wall 1622-1 is substantially uniform along its length. In certain example embodiments, the space formed between protrusion 1682-1 and protrusion 1683-1 of each extension 1628-1 can be considered an open-ended air chamber 1650-1.

Acoustic feature 1620-2 is configured completely different from acoustic feature 1620-1 in this case. Specifically, acoustic feature 1620-2 includes a side wall 1622-1 with a large number of extensions 1628-2, where each extension 1628-2 has varying rectangular cross-sectional shapes with varying thicknesses. Each of the extensions 1628-2 can take on any of a number of other cross-sectional shapes, including but not limited to circles, ovals, hexagons, and random. Despite the various sizes of the extensions 1628-2, the extensions 1628-2 are arranged in a regularly-occurring pattern that is repeated 4 times along the length of the acoustic feature 1620-2. In certain example embodiments, the spaces formed between various extensions 1628-2 can be considered open-ended air chambers 1650-2.

Any sound waves that pass through acoustic feature 1620-1 or acoustic feature 1620-2 can be further attenuated or eliminated using the extensions 1628. In other words, the extensions 1628 can trap and/or attenuate additional sound, and the multiple air chambers 1650-1 and 1650-2 formed by the extensions 1628 can greatly reduce or eliminate sound waves from escaping the air chamber once they are attenuated. Diffusion of sound can be accomplished by the varied surfaces of the extensions 1628. These varied surfaces of the extensions 1628 can reduce or eliminate destructive interference, and also provide sound attenuation of different frequencies. Also, these varied surfaces of the extensions 1628 can provide for a unique and/or customizable aesthetic appearance.

Even though side wall 1622-1 and side wall 1622-2 are planar and parallel to each other, side wall 1622-1 and side wall 1622-2, when combined with the various extensions 1628-1 and 1628-2, can help diffuse sound, limit destructive interference, and mitigate distortion of that sound. In addition to the configuration (e.g., number, shape, size) of each extension 1628, the material of acoustic feature 1620-1 and acoustic feature 1620-2 can also help to provide acoustic control. Acoustic feature 1620-1 and acoustic feature 1620-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1620-1 can be the same as, or different than, the one or more materials of acoustic feature 1620-2. Similarly, the configuration of acoustic feature 1620-1 can be the same as, or different than, the configuration of acoustic feature 1620-2.

The portion of the luminaire 1610 of FIGS. 16A through 16C also includes a light engine tray 1640, which includes mounting surface 1642, side wall 1644-1 disposed at one end (e.g., the left end) of the mounting surface 1642, and side wall 1644-2 disposed at the opposite end (e.g., the right end) of the mounting surface 1642. Side wall 1644-1 and side wall 1644-2 are substantially parallel to each other and are substantially perpendicular to the mounting surface 1642. In this case, side wall 1644-1 is coupled to the top-most parts of the inner surface of wide wall 1622-1 of acoustic feature 1620-1, and side wall 1644-2 is coupled to the top-most parts of the inner surface of side wall 1622-2 of acoustic feature 1620-2. The light engine tray 1640 can be substantially similar to the light engine trays discussed above with respect to its form, purpose, and function.

The portion of the luminaire 1610 of FIGS. 16A through 16C also includes a power source housing 1630. The power source housing 1630 of the luminaire 1610 of FIGS. 16A through 16C can be substantially similar to the power source housings discussed above. In this case, there is an air chamber 1650-3 (also called an air gap 1650-3) between the power source housing 1630, the mounting surface 1642 of the light engine tray 1640, the inner surface of side wall 1622-1, and the inner surface of side wall 1622-2.

The air chamber 1650-3 can be formed by extending the length of the side walls 1622 and/or by reducing the height of the power source housing 1630 relative to the corresponding components of luminaires currently used in the art, such as the luminaire 199 of FIG. 1 and the luminaire 298 of FIG. 2. Similarly, each air chamber 1650-1 and each air chamber 1650-2 can be formed by changing one or more characteristics of the extensions 1628, the number of extensions 1628, the spacing between adjacent extensions 1628, and/or any of a number of other factors. In certain example embodiments, air chambers 1650-1, air chambers 1650-2, and air chamber 1650-3 can each be considered a type of acoustic feature (as with acoustic features 1620-1 and acoustic feature 1620-2).

A portion of air chambers 1650-1, 1650-2, and/or 1650-3 can be filled with no material. Alternatively, some or all of a portion of air chambers 1650-1, 1650-2, and/or 1650-3 can be filled with one or more of a number of materials (e.g., fiberglass) that can help the portion of air chambers 1650-1, 1650-2, and/or 1650-3 perform one or more acoustic functions, including but not limited to attenuating sound, diffusing sound, limiting destructive interference, and mitigating distortion of sound.

Figure 17A:
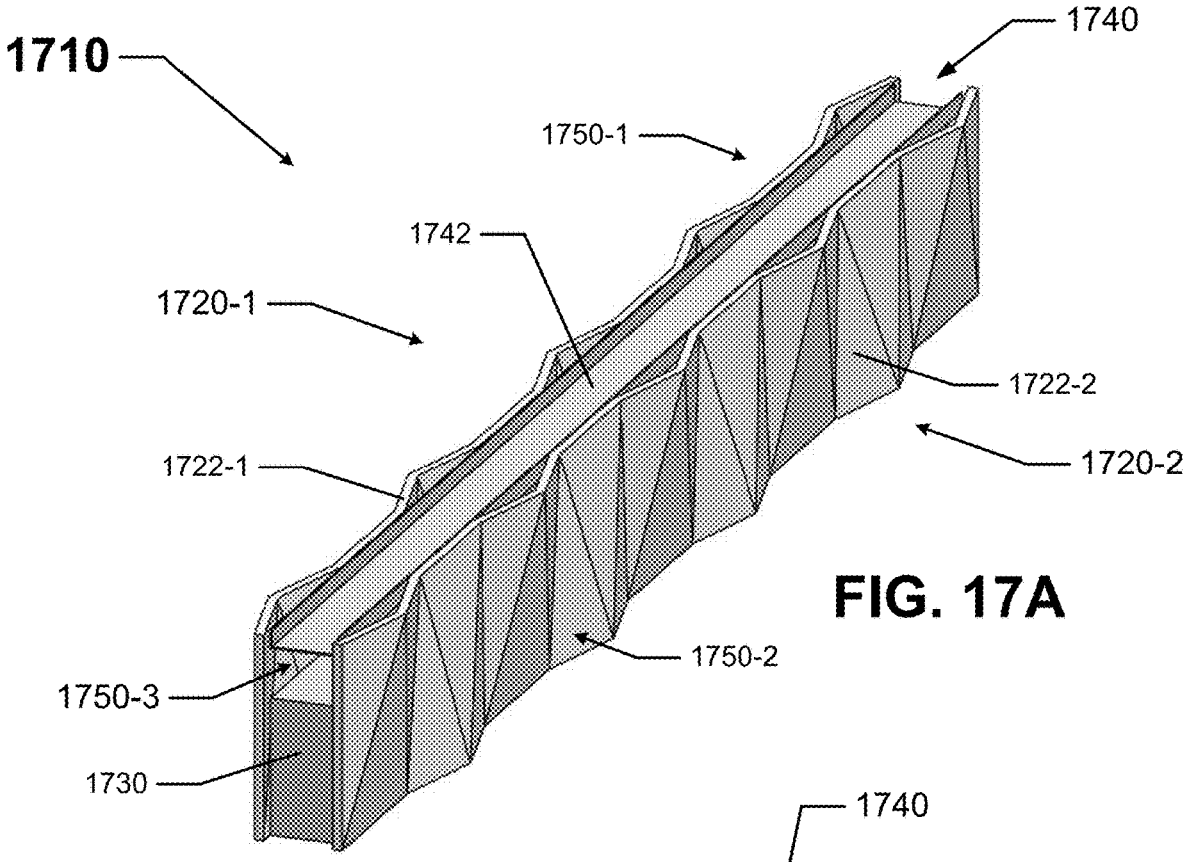
FIGS. 17A and 17B show a cross-sectional perspective view and a cross-sectional front view, respectively, of a portion of yet another luminaire in accordance with certain example embodiments.
Figure 17B:
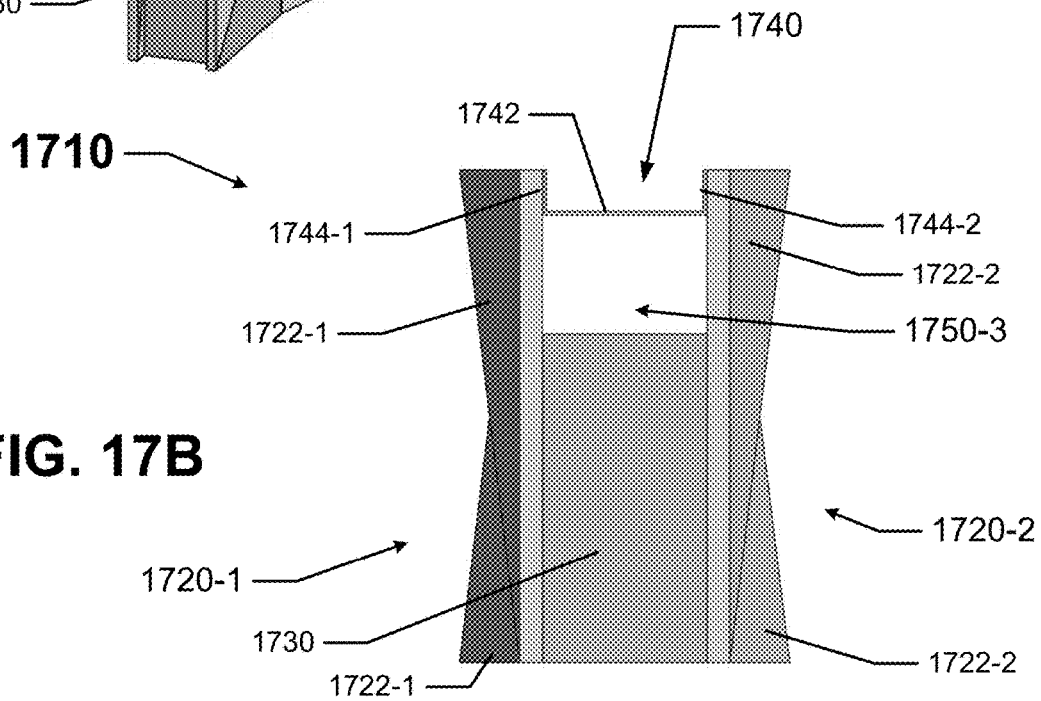

FIGS. 17A and 17B show a cross-sectional perspective view and a cross-sectional front view, respectively, of a portion of yet another luminaire 1710 in accordance with certain example embodiments. Referring to FIGS. 1 through 17B, the portion of the luminaire 1710 of FIGS. 17A and 17B has two acoustic features 1720. Specifically, acoustic feature 1720-1 is on one side (e.g., the left side) of the portion of the luminaire 1710, and acoustic feature 1720-2 is on the opposite side (e.g., the right side) of the portion of the luminaire 1710 relative to acoustic feature 1720-1.

Acoustic feature 1720-1 includes a side wall 1722-1 that is made of a number (in this case, 27) of planar segments that have a triangular shape. In this case, each segment of the side wall 1722-1 has the same shape and size as each other, but in alternative embodiments, the shape and/or size of one segment of the side wall 1722-1 can differ from the shape and/or size of at least one other segment of the side wall 1722-1. The segments of the side wall 1722-1 in this case are arranged in a pattern that repeats after every sixth segment. The width of each segment of the side wall 1722-1 is substantially uniform throughout the segment. In certain example embodiments, the space formed between the outer surface of adjacent segments of the side wall 1722-1 can be considered an open-ended air chamber 1750-1. Similarly, the space formed between the inner surface of adjacent segments of the side wall 1722-1 can be considered part of chamber 1750-3, discussed below.

Acoustic feature 1720-2 in this case is a mirror image of acoustic feature 1720-1 relative to a vertical axis through the portion of the luminaire 1710. Specifically, acoustic feature 1720-2 includes a side wall 1722-2 that is made of a number (in this case, 27) of planar segments that have a triangular shape. In this case, each segment of the side wall 1722-2 has the same shape and size as each other, but in alternative embodiments, the shape and/or size of one segment of the side wall 1722-2 can differ from the shape and/or size of at least one other segment of the side wall 1722-2. The segments of the side wall 1722-2 in this case are arranged in a pattern that repeats after every sixth segment. The width of each segment of the side wall 1722-2 is substantially uniform throughout the segment. In certain example embodiments, the space formed between the outer surface of adjacent segments of the side wall 1722-2 can be considered an open-ended air chamber 1750-2. Similarly, the space formed between the inner surface of adjacent segments of the side wall 1722-2 can be considered part of chamber 1750-3, discussed below.

Side wall 1722-1 and side wall 1722-2 can help diffuse sound, limit destructive interference, and mitigate distortion of that sound. In addition to the configuration (e.g., number, shape, size) of each segment of side wall 1722-1 and side wall 1722-2, the material of acoustic feature 1720-1 and acoustic feature 1720-2 can also help to provide acoustic control. Diffusion of sound can be accomplished by the varied surfaces of the extensions 1728. These varied surfaces of the extensions 1728 can reduce or eliminate destructive interference, and also provide sound attenuation of different frequencies. Also, these varied surfaces of the extensions 1728 can provide for a unique and/or customizable aesthetic appearance.

Acoustic feature 1720-1 and acoustic feature 1720-2 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of acoustic feature 1720-1 can be the same as, or different than, the one or more materials of acoustic feature 1720-2. Similarly, the configuration of acoustic feature 1720-1 can be the same as, or different than, the configuration of acoustic feature 1720-2.

The portion of the luminaire 1710 of FIGS. 17A and 17B also includes a light engine tray 1740, which includes mounting surface 1742, side wall 1744-1 disposed at one end (e.g., the left end) of the mounting surface 1742, and side wall 1744-2 disposed at the opposite end (e.g., the right end) of the mounting surface 1742. Side wall 1744-1 and side wall 1744-2 are substantially parallel to each other and are substantially perpendicular to the mounting surface 1742. In this case, side wall 1744-1 is coupled to the top-most parts of the inner surface of some of the portions of the side wall 1722-1 of acoustic feature 1720-1, and side wall 1744-2 is coupled to the top-most parts of the inner surface of some of the portions of the side wall 1722-2 of acoustic feature 1720-2. The light engine tray 1740 can be substantially similar to the light engine trays discussed above with respect to its form, purpose, and function.

The portion of the luminaire 1710 of FIGS. 17A and 17B also includes a power source housing 1730. The power source housing 1730 of the luminaire 1710 of FIGS. 17A and 17B can be substantially similar to the power source housings discussed above. In this case, there is an air chamber 1750-3 (also called an air gap 1750-3) between the power source housing 1730, the mounting surface 1742 of the light engine tray 1740, the inner surface of the various portions of the side wall 1722-1, and the inner surface of the various portions of the side wall 1722-2.

The air chamber 1750-3 can be formed by extending the length of the side walls 1722 (or portions thereof) and/or by reducing the height of the power source housing 1730 relative to the corresponding components of luminaires currently used in the art, such as the luminaire 199 of FIG. 1 and the luminaire 298 of FIG. 2. Similarly, each air chamber 1750-1 and each air chamber 1750-2 can be formed by changing one or more characteristics of the portions of the side walls 1722, the number of portions of a side wall 1722, and/or any of a number of other factors. In certain example embodiments, air chambers 1750-1, air chambers 1750-2, and air chamber 1750-3 can each be considered a type of acoustic feature (as with acoustic features 1720-1 and acoustic feature 1720-2).

A portion of air chambers 1750-1, 1750-2, and/or 1750-3 can be filled with no material. Alternatively, some or all of a portion of air chambers 1750-1, 1750-2, and/or 1750-3 can be filled with one or more of a number of materials (e.g., fiberglass) that can help the portion of air chambers 1750-1, 1750-2, and/or 1750-3 perform one or more acoustic functions, including but not limited to attenuating sound, diffusing sound, limiting destructive interference, and mitigating distortion of sound.

Figure 18A:
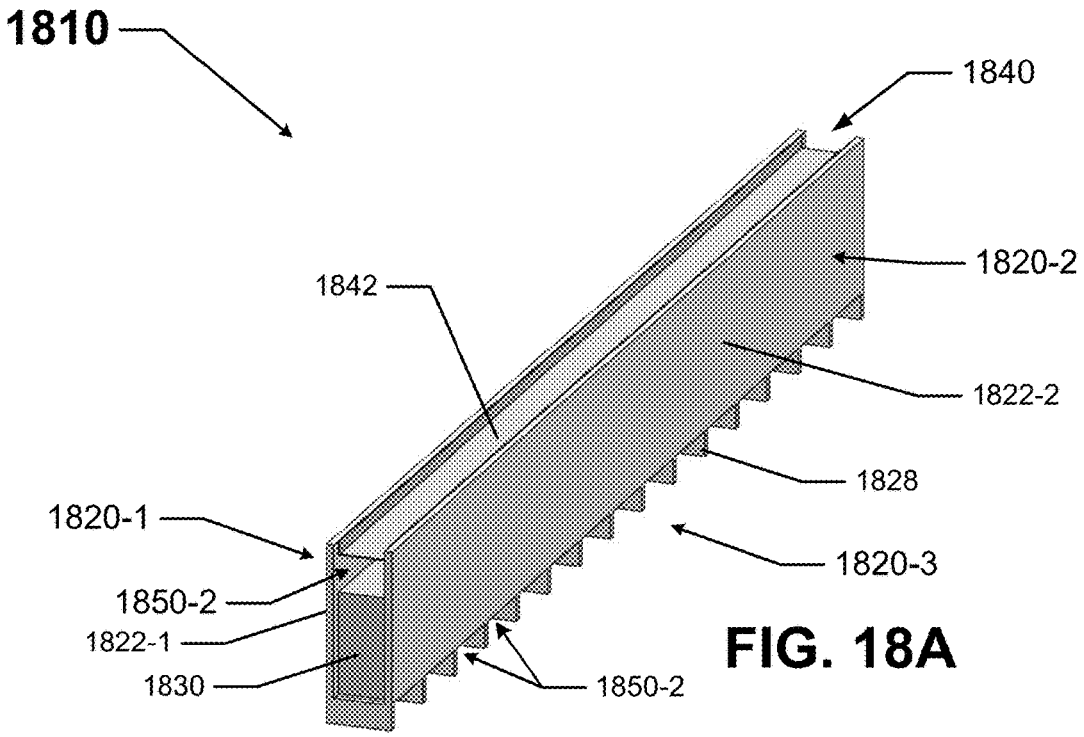
FIGS. 18A through 18C show various views of a portion of still another luminaire in accordance with certain example embodiments.
Figure 18B:
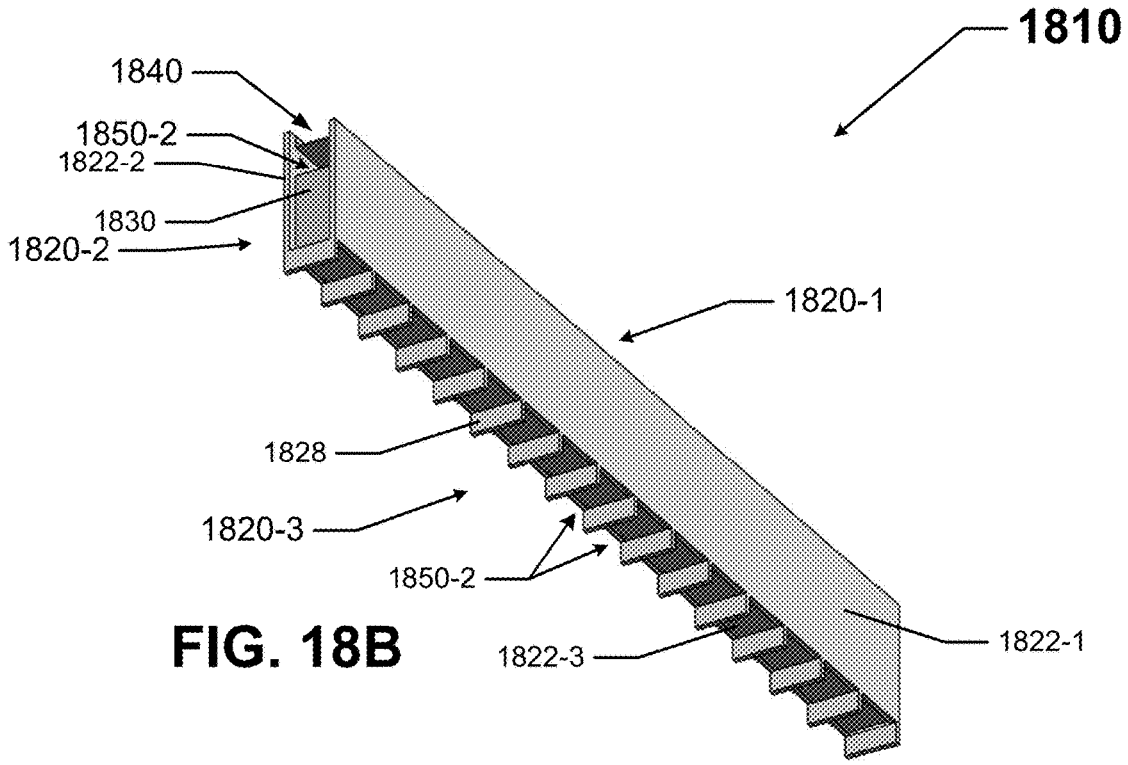
Figure 18C:
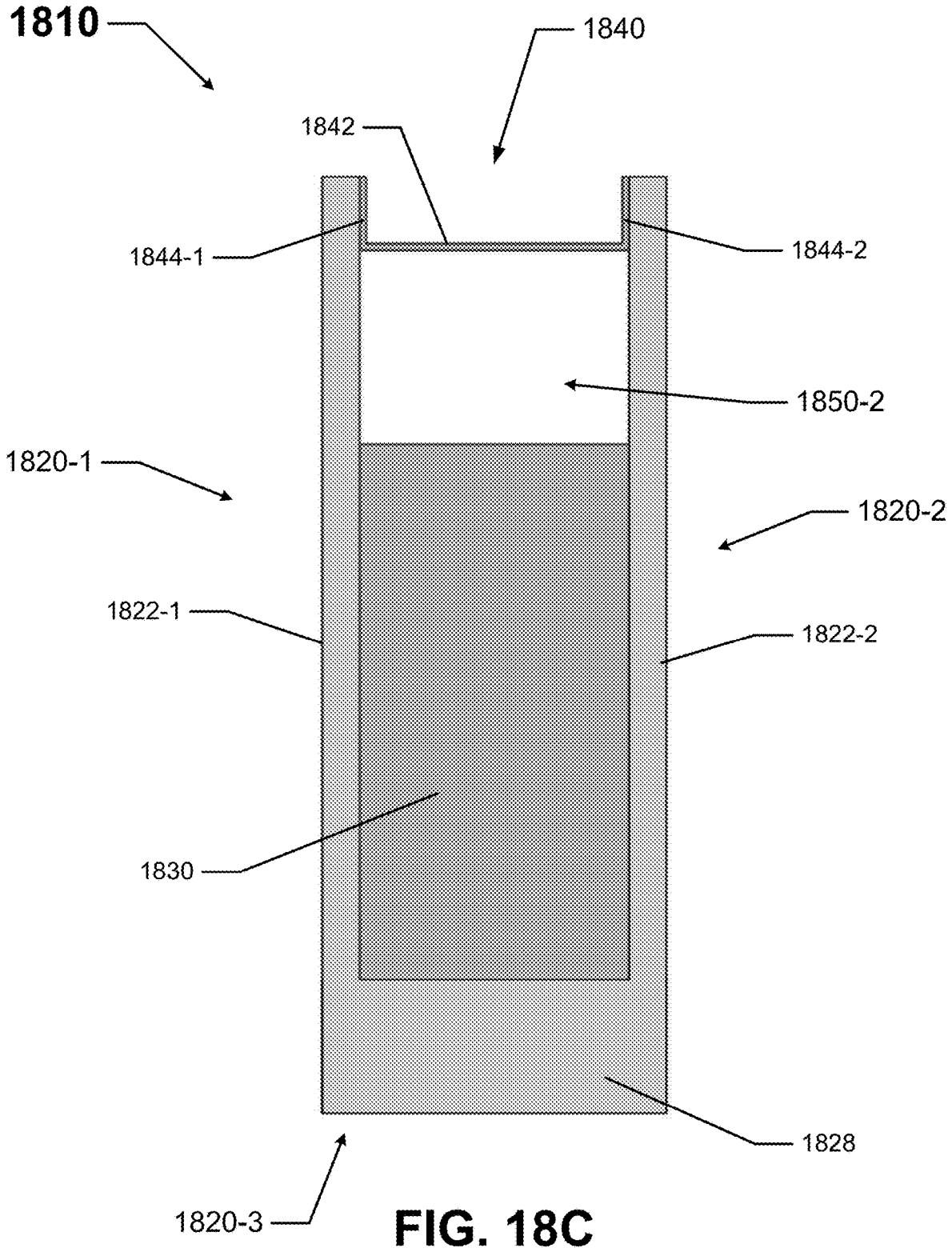

FIGS. 18A through 18C show various views of a portion of still another luminaire 1810 in accordance with certain example embodiments. Specifically, FIG. 18A shows a cross-sectional perspective view of the luminaire 1810. FIG. 18B shows a different cross-sectional perspective view of the luminaire 1810. FIG. 18C shows a cross-sectional front view of the luminaire 1810. Referring to FIGS. 1 through 18C, the portion of the luminaire 1810 of FIGS. 18A through 18C has three acoustic features 1820. Specifically, acoustic feature 1820-1 is on one side (e.g., the left side) of the portion of the luminaire 1810, acoustic feature 1820-2 is on the opposite side (e.g., the right side) of the portion of the luminaire 1810 relative to acoustic feature 1820-1, and acoustic feature 1820-3 is on the bottom side (in terms of FIGS. 18A through 18C) of the portion of the luminaire 1810.

Acoustic feature 1820-1 includes a side wall 1822-1 that is planar (not wedge-shaped) when viewed from the front. Acoustic feature 1820-2 in this case is a mirror image of acoustic feature 1820-1 relative to a vertical axis through the portion of the luminaire 1810. Specifically, acoustic feature 1820-2 includes a side wall 1822-2 that is planar (not wedge-shaped) when viewed from the front. Side wall 1822-1 and side wall 1822-2 each has a length that matches the length of the power source housing 1830 and the light engine tray 1840, both of which are discussed below. In this case, side wall 1822-1 and side wall 1822-2 are parallel to each other.

Acoustic feature 1820-3 includes a wall 1822-3 and a number (in this case, 16) of vertically-oriented outward-directed lateral extensions 1828-3 that are planar (e.g., not wedge-shaped) when viewed from the front. In this case, the lateral extensions 1828-3 are in parallel with each other and perpendicular with the wall 1822-3. Each lateral extension 1828-3 in this case is of uniform length. The width of the wall 1822-3 and each extension 1828-3 is substantially uniform along their lengths. In certain example embodiments, the space formed between adjacent extensions 1828-3 and the wall 1822-3 can be considered an open-ended air chamber 1850-1. Also, these extensions 1828 can provide for a unique and/or customizable aesthetic appearance.

Even though side wall 1822-1 and side wall 1822-2 are planar and parallel to each other, side wall 1822-1 and side wall 1822-2 can help diffuse sound, limit destructive interference, and mitigate distortion of that sound based on the material of acoustic feature 1820-1 and acoustic feature 1820-2. Similarly, wall 1822-3 can also be configured to alter acoustic waves based on the material of acoustic feature 1820-3. Acoustic feature 1820-1, acoustic feature 1820-2, and/or acoustic feature 1820-3 (or portions thereof) can be made of one or more of any of a number of suitable materials that can help with sound attenuation and/or other alterations of acoustics. Examples of such material can include, but are not limited to, compressed PET, fiberglass, wool, and cork. The one or more materials of one acoustic feature 1820 can be the same as, or different than, the one or more materials of one or both other acoustic features 1820. Similarly, the configuration of acoustic feature 1820-1 can be the same as, or different than, the configuration of acoustic feature 1820-2. Further, the configuration of acoustic feature 1820-3 can be the same as the configuration of acoustic feature 1820-1 and/or acoustic feature 1820-2.

The portion of the luminaire 1810 of FIGS. 18A through 18C also includes a light engine tray 1840, which includes mounting surface 1842, side wall 1844-1 disposed at one end (e.g., the left end) of the mounting surface 1842, and side wall 1844-2 disposed at the opposite end (e.g., the right end) of the mounting surface 1842. Side wall 1844-1 and side wall 1844-2 are substantially parallel to each other and are substantially perpendicular to the mounting surface 1842. In this case, side wall 1844-1 is coupled to the inner surface of the side wall 1822-1 of acoustic feature 1820-1, and side wall 1844-2 is coupled to the inner surface of the side wall 1822-2 of acoustic feature 1820-2. The light engine tray 1840 can be substantially similar to the light engine trays discussed above with respect to its form, purpose, and function.

The portion of the luminaire 1810 of FIGS. 18A through 18C also includes a power source housing 1830. The power source housing 1830 of the luminaire 1810 of FIGS. 18A through 18C can be substantially similar to the power source housings discussed above. In this case, there is an air chamber 1850-2 (also called an air gap 1850-2) between the power source housing 1830, the mounting surface 1842 of the light engine tray 1840, the inner surface of side wall 1822-1, the inner surface of side wall 1822-2, and the inner surface of wall 1822-3.

In this case, when viewed from the front, the air chamber 1850-2 has a rectangular cross-sectional shape. The air chamber 1850-2 can be formed by extending the length of the side walls 1822 and/or by reducing the height of the power source housing 1830 relative to the corresponding components of luminaires currently used in the art, such as the luminaire 199 of FIG. 1 and the luminaire 298 of FIG. 2. In certain example embodiments, air chambers 1850-1 and air chamber 1850-2 can be considered a type of acoustic feature (as with acoustic features 1820-1 and acoustic feature 1820-2).

A portion of one or more of the air chambers 1850-1 and/or the air chamber 1850-2 can be filled with no material. Alternatively, some or all of a portion of one or more of the air chambers 1850-1 and/or the air chamber 1850-2 can be filled with one or more of a number of materials (e.g., fiberglass) that can help those air chambers 1850 perform one or more acoustic functions, including but not limited to attenuating sound, diffusing sound, limiting destructive interference, and mitigating distortion of sound.

Figure 19:
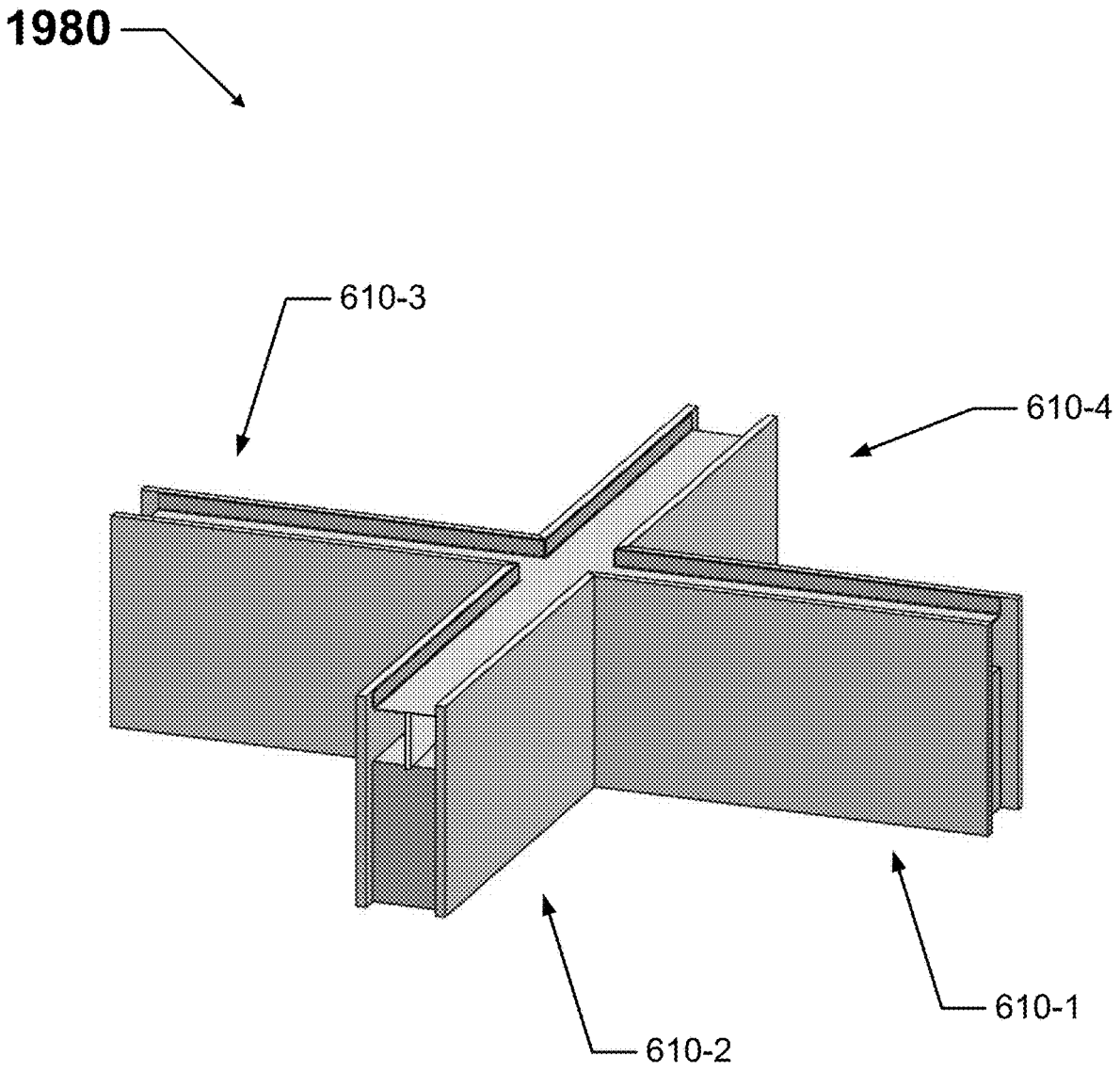
FIG. 19 shows a perspective view of a portion of yet another luminaire in accordance with certain example embodiments.

FIG. 19 shows a perspective view of a portion of yet another luminaire 1980 in accordance with certain example embodiments. Referring to FIGS. 1 through 19, the portion of the luminaire 1980 of FIG. 19 is X-shaped (when viewed from above). The linear portions 610 of the luminaire 1980 are configured identically to the portion of the luminaire 610 of FIGS. 6A and 6B. Specifically, linear segment 610-1, linear segment 610-2, linear segment 610-3, and linear segment 610-4 of the luminaire 1980 are of substantially equal length and height with respect to each other to form an "X".

Linear segment 610-1 is adjacent to and form a 90° angle with linear segment 610-2 and linear segment 610-4. Further, linear segment 610-1 and linear segment 610-3 are linearly aligned with each other. With the configuration of the portion of the luminaire 1910, one or more components (e.g., the light engine tray) can be a continuous piece. Alternatively, such components can be joined to or abut against each other. The angle formed between adjacent linear segments 610 (or any multiple segments of a luminaire discussed herein) can vary, and doing so can change attenuation and diffusion of sound. In some cases, one or more of the segments 610 is non-linear.

Figure 20:
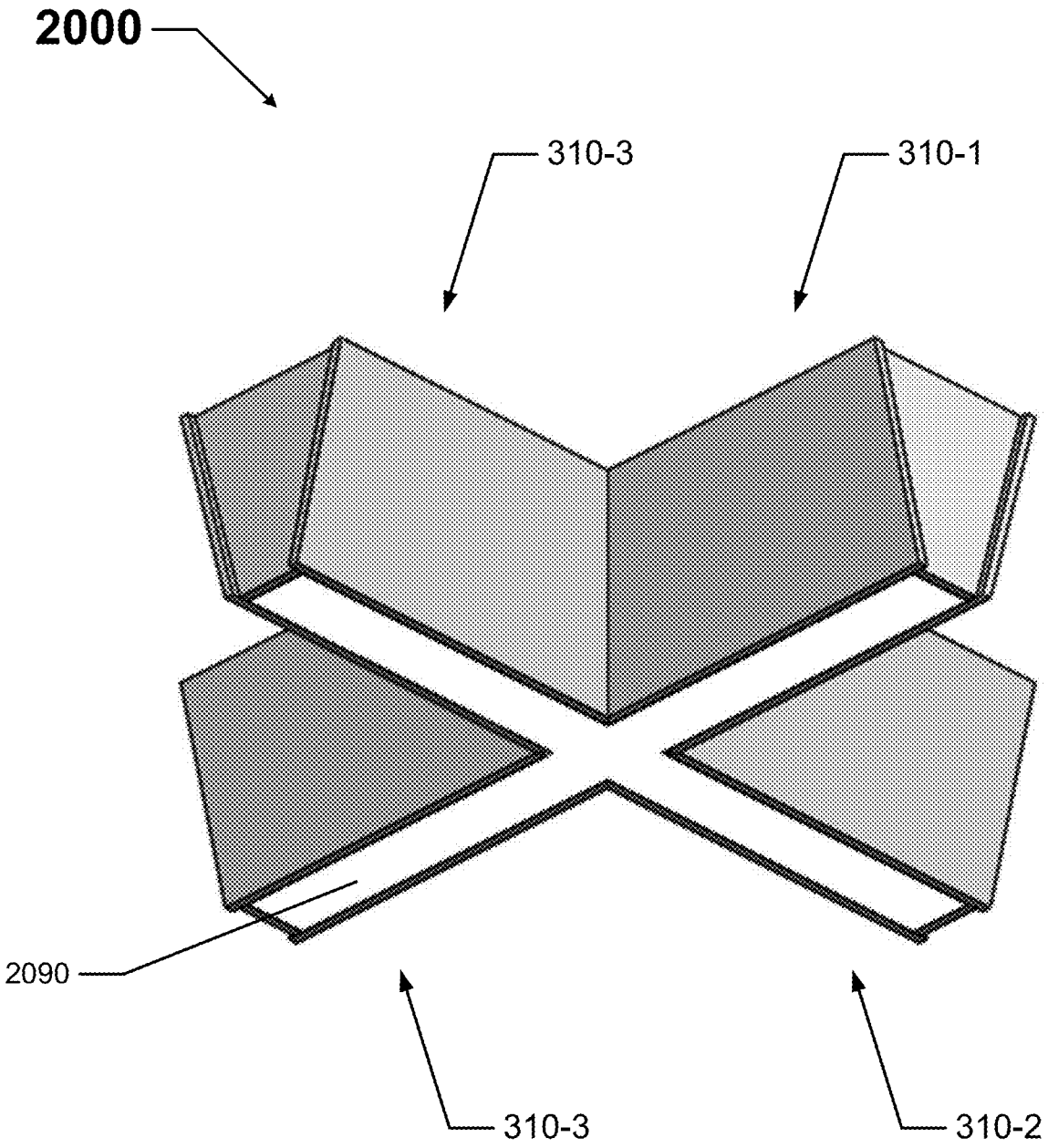
FIGS. 20 through 24 show various luminaires in accordance with certain example embodiments.

FIGS. 20 through 24 show various luminaires in accordance with certain example embodiments. Referring to FIGS. 1 through 24, the luminaire 2000 of FIG. 20 is X-shaped (when viewed from above). The linear portions 310 of the luminaire 2000 are configured identically to the portion of the luminaire 310 of FIGS. 3A and 3B. Specifically, linear segment 310-1, linear segment 310-2, linear segment 310-3, and linear segment 310-4 of the luminaire 2000 are of substantially equal length and height with respect to each other to form an "X".

Linear segment 310-1 is adjacent to and form a 90° angle with linear segment 310-2 and linear segment 310-4. Further, linear segment 310-1 and linear segment 310-3 are linearly aligned with each other. In addition to the linear segments 310, the luminaire 2000 of FIG. 20 includes a luminaire component 2090. Examples of a luminaire component 2090 can include, but are not limited to, a lens (as in this case), a cover, an acoustic feature, and a reflector.

Figure 21:
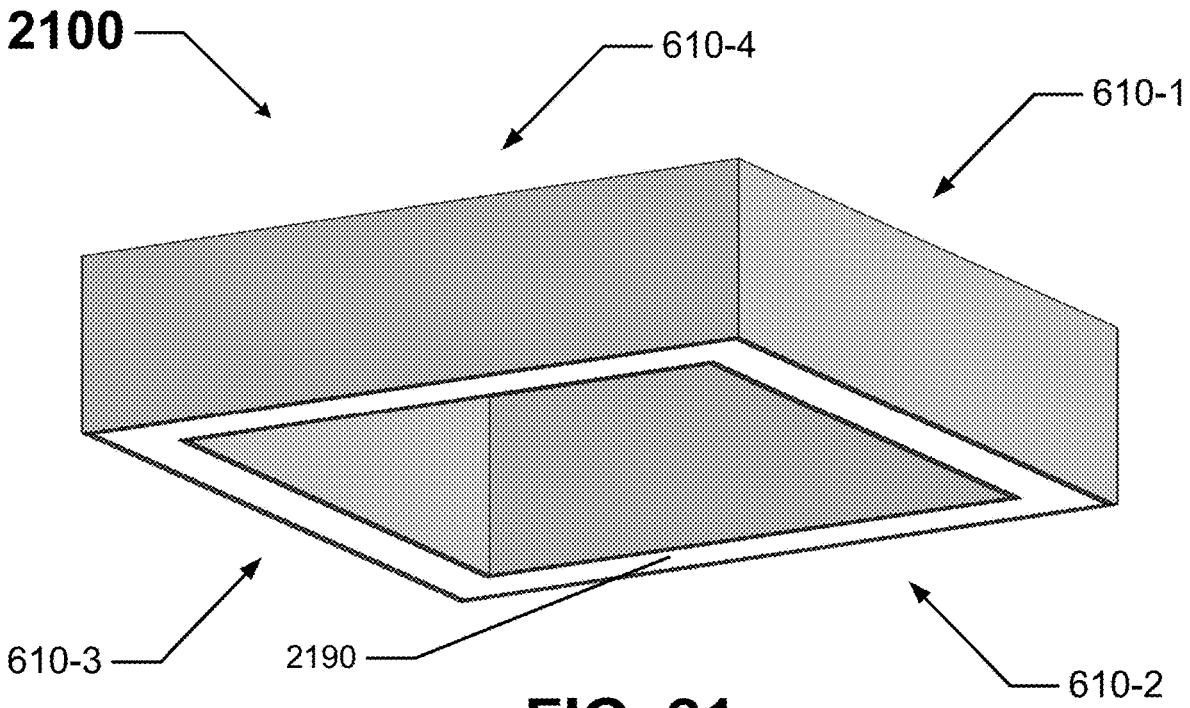

The luminaire 2100 of FIG. 21 includes four linear segments 610 that form a square (when viewed from above). The linear portions 610 of the luminaire 2100 are configured identically to the portion of the luminaire 610 of FIGS. 6A and 6B. Specifically, linear segment 610-1, linear segment 610-2, linear segment 610-3, and linear segment 610-4 of the luminaire 2100 are of substantially equal length and height with respect to each other to form a square. Linear segment 610-1 is adjacent to and form a 90° angle with linear segment 610-2 and linear segment 610-4. Further, linear segment 610-1 and linear segment 610-3 are parallel with each other. In addition to the linear segments 610, the luminaire 2100 of FIG. 21 includes a luminaire component 2190. Examples of a luminaire component 2190 can include, but are not limited to, a lens (as in this case), a cover, an acoustic feature, and a reflector.

Figure 22:
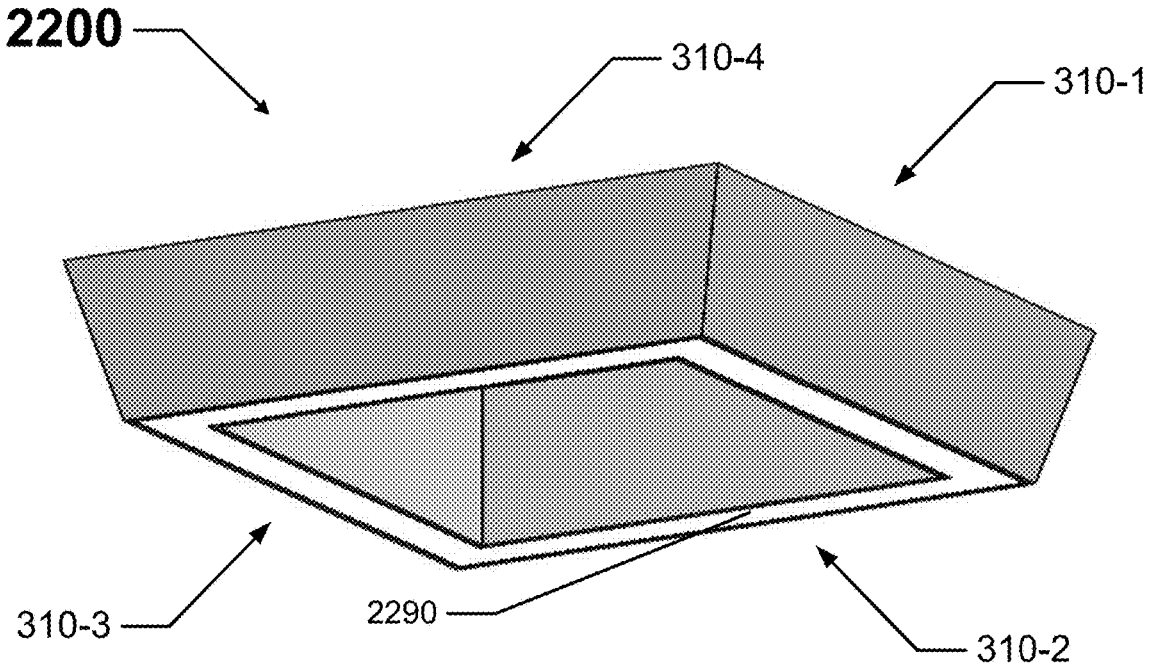

The luminaire 2200 of FIG. 22 includes four linear segments 310 that form a square (when viewed from above). The linear portions 310 of the luminaire 2200 are configured identically to the portion of the luminaire 310 of FIGS. 3A and 3B. Specifically, linear segment 310-1, linear segment 310-2, linear segment 310-3, and linear segment 310-4 of the luminaire 2200 are of substantially equal length and height with respect to each other to form a square. Linear segment 310-1 is adjacent to and form a 90° angle with linear segment 310-2 and linear segment 310-4. Further, linear segment 310-1 and linear segment 310-3 are parallel with each other. In addition to the linear segments 310, the luminaire 2200 of FIG. 22 includes a luminaire component 2290. Examples of a luminaire component 2290 can include, but are not limited to, a lens (as in this case), a cover, an acoustic feature, and a reflector.

Figure 23:
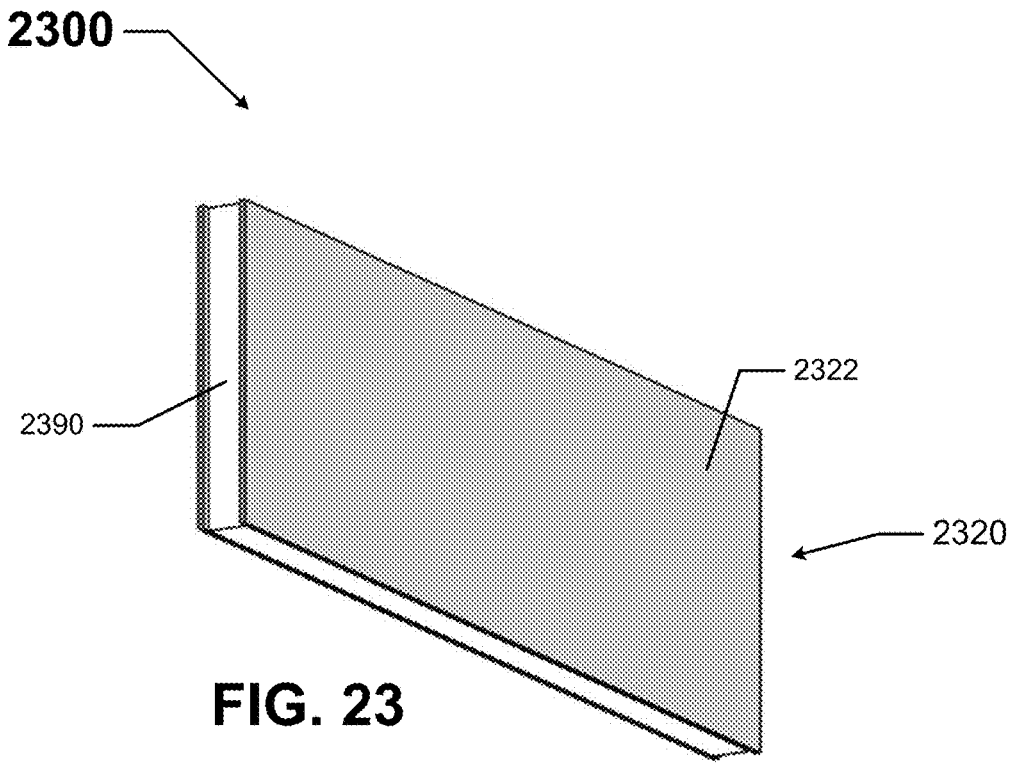

FIG. 23 shows a perspective view of a luminaire 2300 that has a lens 2390 disposed around all edges of the luminaire adjacent to an acoustic feature 2320 on one side and another acoustic feature (hidden from view in FIG. 23) on the opposing side. The acoustic feature 2320 includes a side wall 2322. The acoustic feature 2320 and associated side wall 2322 of the luminaire 2300 of FIG. 23 can be substantially the same as the acoustic features 620-1 and 620-2 and associated side walls 622-1 and 622-2 of the portion of the luminaire 610 of FIGS. 6A and 6B.

Figure 24:
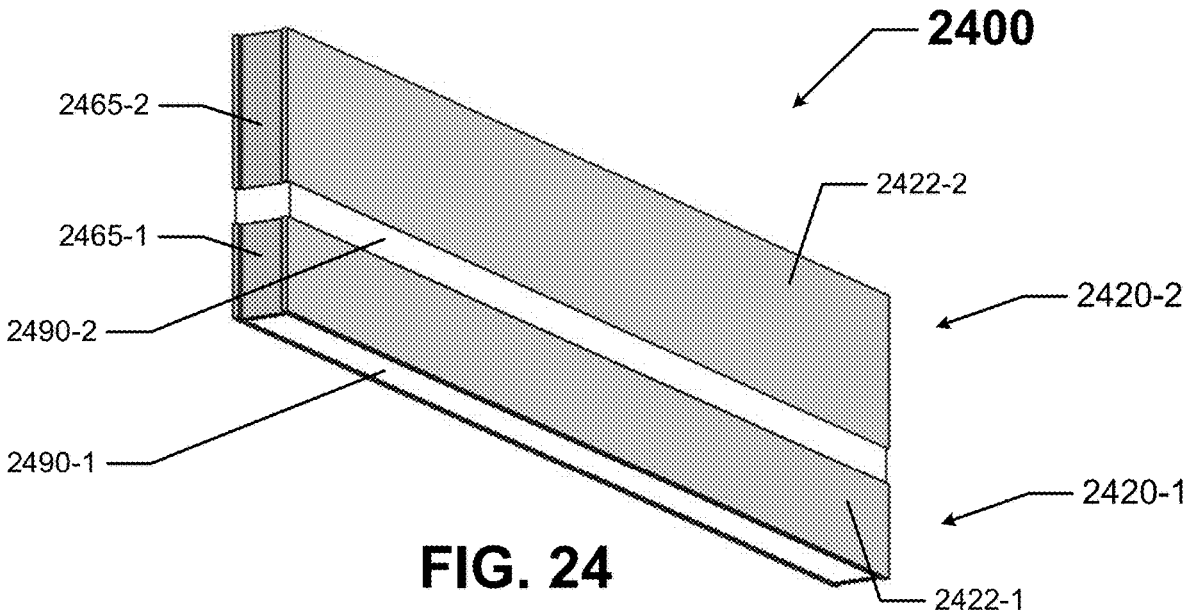

FIG. 24 shows a perspective view of a luminaire 2400 that has one lens 2490-1 disposed along the bottom (in terms of the view of FIG. 24) of the luminaire 2400 and a second lens 2490-2 disposed horizontally around the around the luminaire 2400 approximately ⅓ from the bottom. In addition, luminaire 2400 includes two acoustic features 2320-1 and 2320-2 on one side and another two acoustic features (hidden from view in FIG. 23) on the opposing side. Acoustic feature 2320-1 includes a side wall 2322-1 and an end cap 2465-1. Acoustic feature 2320-2 includes a side wall 2322-2 and an end cap 2465-2. The acoustic feature 2320-1 and acoustic feature 2320-2, as well as associated side wall 2322-1 and side wall 2322-2, can be substantially the same as the acoustic features 620-1 and 620-2 and associated side walls 622-1 and 622-2 of the portion of the luminaire 610 of FIGS. 6A and 6B.

Example embodiments show, describe, and contemplate various luminaires with acoustic features that can be used to help control or otherwise alter acoustics within a volume of space (e.g., a room) in which the luminaire is located. Such acoustic features can be integrated with one or more outer surfaces and/or outer walls of the luminaire. In addition, or in the alternative, such acoustic features can be integrated with one or more air chambers disposed within the luminaire and/or along features on an outer surface of the luminaire. Example acoustic features of a luminaire can involve materials, shapes, and/or any other characteristic that affect acoustics. An example acoustic feature can be adjusted by a user. Example embodiments greatly reduce or eliminate noise levels and improve acoustic quality compared to luminaires currently used in the current art.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a power source housing that houses at least one light fixture component;

a light engine tray disposed proximate to the power source housing; and a first acoustic feature coupled to the power source housing and the light engine tray, wherein the first acoustic feature comprises a first side wall and a first plurality of extensions extending away from the first side wall, wherein the first side wall and the first plurality of extensions have a first configuration, wherein the first configuration comprises the first plurality of extensions being substantially parallel with respect to each other, wherein the first configuration of the first side wall and the first plurality of extensions absorb sound.

2. The luminaire of claim 1, wherein the first side wall comprises compressed polyethylene terephthalate.

3. The luminaire of claim 1, wherein the first configuration of the first side wall is non-planar.

4. The luminaire of claim 1, wherein the first configuration comprises a non-vertical orientation of the first side wall.

5. The luminaire of claim 1, wherein the plurality of extensions extends away from the power source housing.

6. The luminaire of claim 1, wherein the plurality of extensions extends toward the power source housing.

7. The luminaire of claim 1, wherein the plurality of extensions are vertically-oriented with respect to the power source housing.

8. The luminaire of claim 1, wherein the plurality of extensions are horizontally-oriented with respect to the power source housing.

9. The luminaire of claim 1, wherein at least one characteristic of one extension of the plurality of extensions differs from the at least one characteristic of at least one of a remainder of the plurality of extensions, wherein the at least one characteristic comprises at least one selected from a group consisting of a height, a length, a width, a shape, and a material.

10. The luminaire of claim 1, further comprising:

a second acoustic feature coupled to the power source housing.

11. The luminaire of claim 10, wherein the second acoustic feature comprises a second side wall having the first configuration, wherein the second side wall is opposite the first side wall with respect to the power source housing.

12. The luminaire of claim 10, wherein the second acoustic feature comprises a second side wall having a second configuration, wherein the second side wall is opposite the first side wall with respect to the power source housing.

13. The luminaire of claim 10, wherein the second acoustic feature comprises an adjacent wall having a second configuration, wherein the adjacent wall is adjacent to the first side wall.

14. The luminaire of claim 1, further comprising:

an air chamber disposed between the power source housing and the light engine tray.

15. The luminaire of claim 14, wherein the air chamber is filled, at least in part, with a material that comprises at least one of a group consisting of fiberglass, wool, and cork.

16. The luminaire of claim 1, wherein the plurality of extensions form a plurality of additional air chambers that are open-ended.

17. The luminaire of claim 1, wherein at least part of the first configuration of the first acoustic feature is adjustable by a user.

18. The luminaire of claim 1, wherein the first side wall has a thickness that varies along its height.

19. The luminaire of claim 1, wherein the first configuration of the first acoustic feature further comprises an additional first side wall that forms an air chamber with the first side wall.

20. A luminaire comprising:

a power source housing that houses at least one light fixture component;

a light engine tray disposed proximate to the power source housing;

a first acoustic feature coupled to a side surface of the power source housing and the light engine tray, wherein the first acoustic feature comprises a first side wall that absorbs sound; and a second acoustic feature extending away from a bottom surface of the power source housing, wherein the second acoustic feature comprises a plurality of extensions that are substantially parallel with respect to each other.

* * * * *